US009017601B2

(12) United States Patent
Kondoh et al.

(10) Patent No.: US 9,017,601 B2
(45) Date of Patent: Apr. 28, 2015

(54) IRON-BASED SINTERED ALLOY, IRON-BASED SINTERED-ALLOY MEMBER AND PRODUCTION PROCESS FOR THEM

(75) Inventors: Mikio Kondoh, Toyoake (JP); Nobuhiko Matsumoto, Seto (JP); Toshitake Miyake, Nisshin (JP); Shigehide Takemoto, Toyota (JP); Hitoshi Tanino, Toyota (JP)

(73) Assignees: Kabushiki Kaisha Toyota Chuo Kenkyusho, Aichi-gun (JP); Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 12/629,239

(22) Filed: Dec. 2, 2009

(65) Prior Publication Data

US 2010/0074790 A1 Mar. 25, 2010

Related U.S. Application Data

(62) Division of application No. 11/578,591, filed as application No. PCT/JP2005/008276 on Apr. 22, 2005, now abandoned.

(30) Foreign Application Priority Data

Apr. 23, 2004 (JP) ..... 2004-128965
Apr. 30, 2004 (JP) ..... 2004-136158

(51) Int. Cl.
*B22F 3/12* (2006.01)
*C22C 33/02* (2006.01)

(Continued)

(52) U.S. Cl.
CPC ..... *C22C 33/0264* (2013.01); *B22F 2003/145* (2013.01);

(Continued)

(58) Field of Classification Search
USPC ..... 75/228–230, 243, 246, 255, 252; 419/10, 11, 23, 24, 30–43, 45–47, 56, 419/60
IPC ..... C22C 33/02; B22F 3/12,3/16
See application file for complete search history.

(56) References Cited

U.S. PATENT DOCUMENTS 4,913,739 A 4/1990 Thümmler et al.
5,108,492 A 4/1992 Kiyota et al.

(Continued)

FOREIGN PATENT DOCUMENTS

AT 308 160 B 6/1973
CN 1166802 A 12/1997

(Continued)

OTHER PUBLICATIONS

Z. Zhang and R. Sandstrom (Sandstroem), "Fe—Mn—Si master alloy steel by powder metallurgy processing," Journal of Alloys and Compounds, 363, Jan. 2004, pp. 197-202 (available online Jun. 25, 2003).*

(Continued)

*Primary Examiner* — Scott Kastler
*Assistant Examiner* — Vanessa Luk
(74) *Attorney, Agent, or Firm* — Oliff PLC

(57) ABSTRACT

An iron-based sintered alloy of the present invention is an iron-based sintered alloy, which is completed by sintering a powder compact made by press forming a raw material powder composed of Fe mainly, and is such that: when the entirety is taken as 100% by mass, carbon is 0.1-1.0% by mass; Mn is 0.01-1.5% by mass; the sum of the Mn and Si is 0.02-3.5% by mass; and the major balance is Fe. It was found out that, by means of an adequate amount of Mn and Si, iron-based sintered alloys are strengthened and additionally a good dimensional stability is demonstrated. As a result, it is possible to suppress or obsolete the employment of Cu or Ni, which has been believed to be essential virtually, the recyclability of iron-based sintered alloys can be enhanced, and further their cost reduction can be intended.

12 Claims, 10 Drawing Sheets
(1 of 10 Drawing Sheet(s) Filed in Color)

(51) Int. Cl.

| | |
|---|---|
| ***C22C 38/02*** | (2006.01) |
| ***C22C 38/04*** | (2006.01) |
| ***C22C 38/22*** | (2006.01) |
| *B22F 3/14* | (2006.01) |

(52) U.S. Cl.

CPC ..... *B22F 2998/10* (2013.01); *B22F 2999/00* (2013.01); *C22C 38/02* (2013.01); *C22C 38/04* (2013.01); *C22C 38/22* (2013.01)

(56) References Cited

U.S. PATENT DOCUMENTS

| | | | | |
|---|---|---|---|---|
| 5,188,659 | A | 2/1993 | Purnell | |
| 5,476,632 | A * | 12/1995 | Shivanath et al. | 419/57 |
| 5,872,322 | A * | 2/1999 | Mocarski et al. | 75/246 |
| 5,969,276 | A | 10/1999 | Lindberg | |
| 6,346,133 | B1 | 2/2002 | Narasimhan et al. | |
| 6,364,927 | B1 | 4/2002 | Narasimhan et al. | |
| 2002/0034453 | A1 * | 3/2002 | Kondo et al. | 419/10 |
| 2002/0185792 | A1 | 12/2002 | Kuniyoshi et al. | |
| 2005/0109157 | A1 | 5/2005 | Toyoshima et al. | |
| 2008/0025866 | A1 | 1/2008 | Kondoh et al. | |
| 2011/0206551 | A1 | 8/2011 | Kondoh et al. | |

FOREIGN PATENT DOCUMENTS

| | | | |
|---|---|---|---|
| DE | 32 19 324 | A1 | 11/1983 |
| DE | 689 27 094 | T2 | 2/1997 |
| DE | 693 27 728 | T2 | 9/2000 |
| DE | 101 19 772 | A1 | 10/2001 |
| DE | 698 27 094 | T2 | 10/2005 |
| EP | 1 170 075 | A1 | 1/2002 |
| JP | A 58-210147 | | 12/1983 |
| JP | A-61-052302 | | 3/1986 |
| JP | A-02-057664 | | 2/1990 |
| JP | A 07-138602 | | 5/1995 |
| JP | A-09-511546 | | 11/1997 |
| JP | A-10-219410 | | 8/1998 |
| JP | A 10-510007 | | 9/1998 |
| JP | A-11-181507 | | 7/1999 |
| JP | A-2001-089824 | | 4/2001 |
| JP | B2 3309970 | | 5/2002 |
| JP | A-2002-322503 | | 11/2002 |
| JP | A-2005-154847 | | 6/2005 |
| JP | A-2005-336608 | | 12/2005 |
| JP | A-2005-336609 | | 12/2005 |
| JP | A-2006-233331 | | 9/2006 |
| WO | WO 94/11124 | A1 | 5/1994 |
| WO | WO 95/21275 | A1 | 8/1995 |
| WO | WO 96/16759 | | 6/1996 |
| WO | WO 01/43900 | | 6/2001 |
| WO | WO 01/83139 | A1 | 11/2001 |
| WO | WO 2005/103315 | A1 | 11/2005 |

OTHER PUBLICATIONS

Z. Zhang, K. Frisk, A. Salwen, R. Sandstrom (Sandstroem), "Mechanical properties of Fe—Mo—Mn—Si—C sintered steels," Powder Metallurgy, vol. 47, No. 3, Sep. 2004, pp. 239-246.*

Klein A. N. et al., "High Strength Si—MN—Alloyed Sintered Steels," Powder Metallurgy International, vol. 17, No. 1, 1985.

Engstrom Ulf et al., "Effect of Sinter-Hardening on the Properties of High Temperature Sintered PM Steels," Advances in Powder Metallurgy & Particulate Materials, MPIF, 2002, part 13, pp. 1-13.

"New Focus on Chromium may Sidestep Alloy Cost Increases," MPR., Sep. 2004, pp. 16-19.

Ferguson, B. Lynn and Randall M. German, "Powder Compaction Methods & Sintering" from "Powder Shaping and Consolidation Techniques," vol. 7: Powder Metal Technologies and Applications, ASM Handbooks Online, ASM International, 2002.

Office Action mailed Jan. 5, 2009 for U.S. Appl. No. 11/578,591.

Office Action mailed Sep. 11, 2009 for U.S. Appl. No. 11/578,591.

Decision of Refusal issued Jun. 24, 2010 in corresponding Chinese Patent Application No. 2006580012662.X.

Schatt, W., "Powder Metallurgy Sintered and Compound Materials," Dr. Alfred Hüthig Verlag, Heidelberg, 1988, pp. 115-123.

Original and English-language translation of German Office Action for German Application No. 11 2005 000 921, mailed Dec. 2, 2010 and received Dec. 24, 2010.

Raffeinner; "Sintering Furnaces and Atmospheres, Shaping and Consolidation Technologies;" *Powder Metal Technologies and Applications*; 1998; pp. 453-467; vol. 7; ASM International.

U.S. Office Action dated Dec. 20, 2013 from U.S. Appl. No. 13/125,948.

International Search Report dated Jan. 26, 2010 from International Application No. PCT/JP2009/068991 (with English-language translation).

Chinese Office Action in Chinese Application No. 20058001266 2.X mailed Apr. 7, 2011, with its English-language translation.

Advisory Action dated Oct. 30, 2014 from U.S. Appl. No. 13/125,948.

U.S. Office Action dated Jul. 18, 2014 from U.S. Appl. No. 13/125,948.

Jan. 21, 2015 Office Action issued in U.S. Appl. No. 13/125,948.

* cited by examiner

Influence of Mn Amount Exerted to Transverse Rupture Strength of 1150°C-Sintered Body Influence of Mn Amount Exerted to Transverse Rupture Strength of 1250°C-Sintered Body Influence of Mn Amount Exerted to Deflection Amount in Transverse Test to 1150°C-Sintered Body Influence of Mn Amount Exerted to Deflection Amount in Transverse Test to 1250°C-Sintered Body Influence of Mn Amount to Dimensional Change of 1150°C-Sintered Body Influence of Mn Amount to Dimensional Change of 1250°C-Sintered Body Relationship between Sintered Density and Traverse Rupture Strength Relationship between Sintered Density and Deflection Amount Three-point Bending Fatigue Test Result E42:Fe-FMSVI-0.8LiSt E04:Fe-2Cu-0.8C+0.8LiSt Configuration, Tensile Test Piece Relationship between Tensile Strength and FMS Powder Composition Relationship between Elongation and FMS Powder Composition Relationship between Green Density and After-sintering Carbon Amount Appearance of Sample in which Blistering Occurred Cross-sectional Photograph of Sample in which Blistering Occurred

IRON-BASED SINTERED ALLOY, IRON-BASED SINTERED-ALLOY MEMBER AND PRODUCTION PROCESS FOR THEM

PRIORITY

The present application is a divisional application of application Ser. No. 11/578,591 filed Oct. 16, 2006, which is a U.S. National Stage Application of PCT/JP2005/008276, filed Apr. 22, 2005, which claims priority from Japanese Patent Applications Nos. JP 2004-128965, filed Apr. 23, 2004 and JP 2004-136158, filed Apr. 30, 2004. The disclosure of each of the prior applications is hereby incorporated by reference in its entirety.

TECHNICAL FIELD

The present invention relates to an iron-based sintered alloy and an iron-based sintered-alloy member, which are made by sintering a raw material powder including manganese (Mn) and (Si), and a production process for them. Specifically, the present invention relates to an iron-based sintered alloy, which is good in terms of the strength or dimensional stability and which makes Cu free or Ni free possible at reduced costs, and a production process for it (hereinafter, these inventions are referred to as a "first invention"). Moreover, the present invention relates to a high-density iron-based sintered-alloy member, which is of high strength and which is good in terms of the dimensional stability, and a production process for it (hereinafter, these inventions are referred to as a "second invention").

BACKGROUND ART

1. Background of the First Invention

In order to reduce the production costs of structural members, such as mechanical component parts, it is possible to think of utilizing iron-based sintered-alloy members, which are sintered by heating powder compacts which are made by press forming raw material powders in which iron is adapted to be the major component. When using iron-based sintered-alloy members, it becomes possible to obtain products (sintered bodies), which are close to the final configurations, and accordingly it is possible to intend the reduction of the production costs or material costs of structural members by means of machining reduction or material-yield improvement, and the like. In order to do so, the strength and before/after-sintering dimensional stability of iron-based sintered-alloy members become important.

From such viewpoints, Fe—Cu—C-system iron-based sintered alloys, which are made by sintering powder compacts composed of Fe—Cu—C-composition raw material powders, have been used heavily. It is because Cu is an element, which is effective for the strength improvement and before/after-sintering dimensional stableness of iron-based sintered alloys. Therefore, contrary to general iron/steel alloys, in the case of iron-based sintered alloys, Cu has been considered its essential component virtually.

2. Background of the Second Invention

In order to reduce the production costs of structural members, such as mechanical component parts, it is possible to think of utilizing iron-based sintered-alloy members, which are sintered by heating powder compacts which are made by press forming raw material powders in which iron is adapted to be the major component. When using iron-based sintered-alloy members, it becomes possible to obtain products (sintered bodies), which are close to the final configurations, and accordingly it is possible to intend the reduction of the production costs or material costs of structural members by means of the reduction of machining or material-yield improvement, and the like. In order to do so, the strength and before/after-sintering dimensional stability of iron-based sintered-alloy members become important. As measures therefor, the following methods have been adopted.

First of all, it is to employ Fe—Cu—C-system-composition raw material powders. It is because Cu is an element, which is effective for the strength improvement and before/after-sintering dimensional stableness of iron-based sintered alloys. However, even when raw material powders with such compositions are employed, if the density of sintered bodies is low, no high-strength sintered bodies are desired after all. Moreover, iron-based sintered-alloy members, which include Cu, are not preferable in view of costs, in view of recycling, and the like, as well.

As a method of heightening the density of sintered bodies, it is possible to think of a method of carrying out double-pressing and double-sintering (2P2S). However, since this method carries out pressing and forming repetitively, it causes the cost rise of sintered bodies so that it is not preferable. A powder forging method, in which sintered bodies are forged to make them denser (highly densify them), is also available. However, in this method, since the dimensional accuracy of sintered bodies cannot be maintained, the advantages of powder sintering method have been sacrificed, making the costs of structural members lower which relies on iron-based sintered-alloy members, the original purpose, cannot be intended.

[Patent Literature No. 1] U.S. Pat. No. 6,346,133
[Patent Literature No. 2] U.S. Pat. No. 6,364,927
[Patent Literature No. 3] Japanese Patent Publication No. 3309970
[Patent Literature No. 4] Japanese Unexamined Patent Publication (KOKAI) No. 58-210147
[Patent Literature No. 5] Domestic Re-publication of PCT International Publication for Patent Applications No. 10-510007
[Non-patent Literature No. 1] High Strength Si—Mn-Alloyed Sintered Steels. P. M. vol. 17 Int. No. 1 (1985)
[Non-patent Literature No. 2] "Effect of Sinter-Hardening on the Properties of High Temperature Sintered PM Steels," Advances in Powder Metallurgy & Particulate Materials, MPIF, 2002, part 13, pp. 1-13
[Non-patent Literature No. 3] "New focus on chromium may sidestep alloy cost increases," MPR. September (2004), pp. 16-19

DISCLOSURE OF THE INVENTION

Assignment to be Solved by the First Invention

However, Cu powders are such that the unit costs are high and the employment amounts in iron-based sintered alloys, too, are great comparatively. Accordingly, they result in raising the production costs of iron-based sintered alloys naturally. Further, Cu is an element, which becomes the cause of hot brittleness of iron/steel materials, but is an element, which is difficult to remove by smelting, and the like. Consequently, iron-based sintered alloys employing Cu are such that the mingling into scraps, and so forth, is disliked, their recycling is difficult, and the employment of iron-based sintered alloys, which include Cu, are not necessarily preferable for environmental protection.

Other than Cu, Ni is available as an element, which has been used heavily in iron-based sintered alloys. Ni too, similarly to Cu, is an element, which is effective for improving the strength, and the like, of iron-based sintered alloys. However, Ni powders are expensive as well, and raise the production costs of iron-based sintered alloys. Moreover, Ni is an allergic element, and accordingly there are cases where its employment is not preferable.

In aforementioned Patent Literature Nos. 1 and 2 or Non-patent Literature No. 1, iron-based sintered alloys, in which, without employing Cu, Mn or Si is contained to intend strength improvement, and the like, are disclosed. However, they are at laboratorial levels definitely, and are different from the later-described present invention in the way of the compositions or addition methods, and the like, of Mn or Si.

In Patent Literature No. 3, an ultra-high-density forming method for a powder compact is disclosed. In Patent Literature No. 4 and Patent Literature No. 5, an iron-based sintered alloy, which is made by compression forming and sintering a mixture powder of an Si—Mn—Fe-hardener pulverized powder and an iron powder, is disclosed. However, iron-based sintered alloys disclosed in these patent publications are such that the compositions of C, Mn, Si, and the like, differ from the later-described iron-based sintered alloy of the present invention, and accordingly those, at which the both sides aim, differ.

Moreover, in Patent Literature No. 5, an iron-based sintered alloy, in which Mo is contained instead of Ni, is disclosed as well. However, its strength is not necessarily sufficient, and it separately requires heat treatments, such as hardening and tempering, for further strengthening it highly. It is needless to say that such heat treatments require many times and man-hour requirements so that they have raised the production costs of iron-based sintered alloys.

With respect to this, in Non-patent Literature No. 2 or 3, there is a disclosure to the effect that a high-strength iron-based sintered alloy (sinter-hardening steel) is can be obtained while omitting heat treatments after the sintering step, though. However, Non-patent Literature No. 2, contrary to the present invention, does not disclose an iron-based sintered alloy in which Mn or Si is contained. In Non-patent Literature No. 3, a sinter-hardening steel, which contains Cr, Mn, Si and Mo, is disclosed. However, its sinter-hardening steel is such that the hardenability is not sufficient, and does not necessarily demonstrate sufficiently high strength by the sintering step alone.

Moreover, since the conventional sinter-hardening steels have been based on the assumption that they undergo forcible cooling with a comparatively large cooling rate after the heating in the sintering step, there arises the need of providing a conventional sintering furnace with a forcibly cooling facility separately. However, a large amount of expenses is required for the modification of production facility, and accordingly it has been rare to adopt it actually.

It is possible to think of improving the hardenability of sinter-hardening steels by employing Cr, and the like, abundantly. However, since a Cr-containing powder is very likely to be oxidized, and since its reduction is difficult, an iron-based sintered alloy, which uses such a powder, has not been put into practical application so far.

The present invention has been done in view of such circumstances, and it is an object to provide an iron-based sintered alloy, which can secure the mechanical characteristics, such as strength, or the before/after-sintering dimensional stability while suppressing the employment of Cu or Ni, though, and a production process for the same. Further, it is an object to provide an iron-based sintered alloy, which is can be produced at low costs while being good in terms of the strength and dimensional stability, though, and a production process for the same.

Assignment to be Solved by the Second Invention

The present inventors have already established a method for obtaining an ultra-high-density powder compact by single pressing (aforementioned Patent Literature No. 3). By sintering this powder compact, it becomes possible to obtain a high-density sintered body. Namely, it becomes possible to obtain an ultra-high-strength iron-based sintered-alloy member by single pressing and single sintering, without ever carrying out double-pressing and double-sintering.

However, in order to intend to further highly strengthen the iron-based sintered-alloy member, when the present inventors sintered the aforementioned ultra-high-strength powder compact at high temperatures while modifying the blended compositions of the raw material powder and the sintering temperatures, and the like, variously, there occurred blistering (blister) in the sintered bodies. The iron-based sintered-alloy members, in which such blistering has occurred, are naturally such that the dimensional stability has collapsed and its density and strength have been degraded.

The present invention has been done in view of such circumstances, and it is an object to provide a high-density and high-strength iron-based sintered-alloy member, in which the occurrence of blistering during sintering is restrained, and which is good in terms of the before/after-sintering dimensional stability, and a production process for the same.

Note that, in aforementioned Patent Literature Nos. 1 and 2 or Non-patent Literature No. 1, iron-based sintered alloys, in which Si is contained, are disclosed. However, they and the later-descried present invention differ in many respects, such as the assignment making the assumption, the density of powder compact and the Si composition, and accordingly the both sides have no relation practically. Moreover, in Patent Literature Nos. 4 and 5, iron-based sintered alloys, which are made by compression forming and sintering a mixture powder of an Si—Mn—Fe-hardener pulverized powder and an iron powder, are disclosed. However, in these cases too, the assignment making the assumption, and the like, differ from the later-described present invention, and accordingly there is not any practical relation between the both sides.

Solving Means of the First Invention

The present inventors, in order to solve this assignment, studied earnestly and repeated trial and error, as a result, they newly found out that, by containing an appropriate amount of Mn and Si, an iron-based sintered alloy, which is of high strength and which is good in terms of the dimensional stability, is can be obtained, and arrived at completing the present invention.

(1) Iron-Based Sintered Alloy

Namely, an iron-based sintered alloy of the present invention is an iron-based sintered alloy, being completed by sintering a powder compact made by press forming a raw material powder composed of iron (Fe) mainly, and is characterized in that:

when the entirety is taken as 100% by mass, carbon (C) is 0.1-1.0% by mass; manganese (Mn) is 0.01-1.5% by mass; the sum of the Mn and silicon (Si) is 0.02-3.5% by mass; and the major balance is Fe; and it is good in terms of the strength and dimensional stability.

The iron-based sintered alloy of the present invention, without ever containing Cu, and the like, daringly, is of high strength and is good in terms of the dimensional stability by containing C, Mn and Si in appropriate amounts. Compared with the case of employing Cu, Mn and Si can be acquired inexpensively comparatively, besides, their employment amounts come off with being less comparatively. Therefore, in accordance with the iron-based sintered alloy of the present invention, the reduction of raw material costs becomes possible as well.

In the case of including both of Mn and Si in appropriate amounts, the mechanical characteristics (strength, ductility, and the like) of the iron-based sintered alloy of the present invention improve greatly, and it further makes one which is good in terms of the dimensional stability, too.

Mn is an effective element for the strength improvement of iron-based sintered alloys particularly. When the entire iron-based sintered alloy is taken as 100%, the lower limit value of Mn can preferably be 0.01% by mass, 0.05% by mass, 0.1% by mass, 0.2% by mass, and 0.3% by mass. When Mn is less excessively, its effect is poor. However, depending on the types of alloying elements included in the raw material powder, even when Mn is a trace amount, the iron-based sintered alloy, which is of sufficient strength, can be obtained. On the other hand, the upper limit value of Mn can preferably be 2% by mass, 1.5% by mass, 1.2% by mass (especially, less than 1.2% by mass), 1.15% by mass, 1.1% by mass, 1.0% by mass (especially, less than 1.0% by mass), 0.9% by mass, and 0.8% by mass. When Mn becomes excessive, the elongation of the iron-based sintered alloy decreases so that the toughness degrades, and the dimensional change increases as well so that the dimensional stability is hampered. For example, the compositional range of Mn can preferably be 0.2-2% by mass, and further 0.3-1.5% by mass. Note that, in the present description, it should be notified that the respective upper limit values and respective lower limit values of the component elements are combinable arbitrarily unless otherwise specified particularly.

Si contributes to the strength improvement of iron-based sintered alloys as well, but contributes greatly to the dimensional stability of iron-based sintered alloys especially. In particular, this tendency is great when Si coexists with Mn. Mn acts in such a tendency that increases the dimension of iron-based sintered alloys, on the contrary, Si acts in such a tendency that decreases the dimension of iron-based sintered alloys. It is believed that, by the fact that both elements coexist, these tendencies cancel with each other so that the dimensional stability of the iron-based sintered alloy can be secured.

When Si is less excessively, the dimensional stability is poor, and, when it becomes excessive, the dimensional shrinkage magnitude becomes so large that it is not preferable. When the entire iron-based sintered alloy is taken as 100%, the lower limit value of Si can preferably be 0.1% by mass, 0.2% by mass, and 0.3% by mass. On the other hand, the upper limit value of Si can preferably be 3% by mass, 2.5% by mass, 2% by mass, and 1.2% by mass. Further, the compositional range of Si can preferably be 0.1-3% by mass, and further 0.2-2% by mass. When being referred to as the sum of Mn and Si, 0.3-5% by mass is preferable, and 0.5-3.5% by mass is further preferable.

The iron-based sintered alloy of the present invention includes an appropriate amount of C. C is an important strengthening element for iron-based sintered alloys. Not to mention that C diffuses during sintering so that iron-based sintered alloys are solution strengthened, by including C in an appropriate amount, the heat treatments, such as the hardening and tempering of iron-based sintered alloys, become possible, and thereby it is possible to improve the mechanical characteristics of iron-based sintered alloys even more greatly. When C is less excessively, its effect is poor; and, when C becomes excessive, the ductility degrades.

When the entire iron-based sintered alloy is taken as 100% by mass, the lower limit value of C can preferably be 0.1% by mass, 0.2% by mass, 0.3% by mass, 0.35% by mass, and 0.4% by mass. On the other hand, the upper limit value of C can preferably be 1.0% by mass, 0.8% by mass, 0.7% by mass, and 0.7% by mass. Further, the compositional range of C can preferably be 0.1-1.0% by mass, and further 0.2-0.8% by mass.

Further, in the case of the present invention, compared with general carbon steels, it is possible to intend to highly strengthen the high-strength iron-based sintered alloy with a much less C amount. This reason is not necessarily clear, however, it appears that the influences by means of Mn and Si are intense. Specifically, it is believed to result from the fact that, by means of adding Mn and Si, the material yield of C improves and further the hardenability has improved as well. In any case, since it is possible to intend to highly strengthen the iron-based sintered alloy on lower carbon amount sides than conventionally, it is possible to secure high toughness while intending the high strengthening. Namely, the iron-based sintered alloy can be obtained, iron-based sintered alloy which has made the strength and toughness, which are said to be in a conflicting relationship, compatible at a higher level.

Other than the aforementioned elements, it can contain alloying elements, such as molybdenum (Mo), chromium (Cr) and nickel (Ni). In particular, in the case of carrying out a heat treatment, such as refining, it is preferable to contain these elements. Since their suitable contents change depending on the C amount, and the like, they cannot be identified sweepingly, however, it is suitable that, when the entire iron-based sintered alloy is taken as 100% by mass, Mo can be included in an amount of 0.1-3% by mass, and further 0.2-2% by mass; Cr can be included in an amount of 0.2-5% by mass, and further 0.3-3.5% by mass; and Ni can be included in an amount of 0.5-6% by mass, and further 1-4% by mass, for example.

Note that, from the viewpoint of turning the iron-based sintered alloy into being free from Ni, one member or more of Cr or Mo is especially preferable as an alloying element. The details of the iron-based sintered alloy, which includes these alloying elements, will be described later.

The iron-based sintered alloy of the present invention, without ever having Cu contained, is of high strength, and is good in terms of the dimensional stability. When the iron-based sintered alloy of the present invention is a Cu-free iron-based sintered alloy, which does not include Cu substantially, the recyclability of the iron-based sintered alloy improves so that it is preferable in view of environmental protections. Moreover, by suppressing the employment of expensive Cu, the cost reduction of the iron-based sintered alloy can be intended. Furthermore, when the iron-based sintered alloy is Cu-free, the hot brittleness of the iron-based sintered alloy, which results from Cu, can be avoided.

On the other hand, Ni is an effective element for highly intensifying iron-based sintered alloys, and it is less likely that the recyclability, and the like, become problems. However, Ni is said to be an allergic element, and accordingly there are cases where the employment is not preferable. Therefore, it is preferable that the iron-based sintered alloy of the present invention can be an Ni-free iron-based sintered alloy. Therefore, it seems that a Cu-free or Ni-free iron-based sintered alloy like the present invention is such that, as an environmentally harmonizing-type high-strength sintered alloy, its utilization range will expand all the more from now on.

However, the iron-based sintered alloy, which is set forth in the present description, according to the present invention does not exclude the containment of Cu or Ni at all. The case of containing an appropriate amount of Cu or Ni in addition to the above-descried Mn and Si is involved in the scope of the present invention as well. Moreover, in the iron-based sintered alloy of the present invention, the green density of powder compact or the sintered density of iron-based sintered alloy does not necessarily matter. Moreover, through the entire present description, it should be notified that the iron-based sintered alloy is a wide concept that includes iron-based sintered-alloy members.

The "strength" and "dimensional stability" set forth in the present description depend on the compositions of raw material powders, the compacting pressures, the sintering conditions (temperature, time, atmosphere, and the like), and so forth. Therefore, it is not possible to identify those "strength" and "dimensional stability" sweepingly. If setting forth them daringly, the strength can preferably be 900 MPa or more, 1,000 MPa or more, 1,100 MPa or more, 1,200 MPa or more, 1,300 MPa or more, and further 1,400 MPa or more, by transverse rupture strength.

The dimensional stability can preferably be within ±1%, within ±0.5%, within ±0.3%, and further within ±0.1%, by before/after sintering dimensional change rate.

Moreover, the "iron-based sintered alloy," set forth in the present description, is such that its form does not matter, for example, can even be materials, such as ingot-shaped, rod-shaped, tube-shaped plate-shaped ones, and can even be final configurations or structural members (iron-based sintered-alloy members), which are close to them.

(2) Production Process for Iron-Based Sintered Alloy

The aforementioned iron-based sintered alloy, for example, can be produced by means of the following production method of the present invention. Specifically, a production process of the present invention for an iron-based sintered alloy, by which the above-described iron-based sintered alloy is obtainable after the following sintering step, is characterized in that is completed by being equipped with: a forming step of making a powder compact by press forming a raw material, in which an Fe-system powder, composed of at least one of pure iron and iron alloy, is mixed with a strengthening powder, containing manganese (Mn) and silicon (Si) as being a powder as a whole; and a sintering step of heating the powder compact to sinter it.

Here, on Mn and Si, which are important in view of securing the strength and dimensional stability of the iron-based sintered alloy of the present invention, additional remarks are made. Mn and Si, in addition to C, phosphorus (P) and sulfur (S), are referred to as the five elements of steels, and are general strengthening elements in melt produced iron/steel materials. However, these Mn and Si have hardly been employed in the field of iron-based sintered alloys. Mn and Si are such that the affinity to oxygen is high extremely so that they are likely to make oxides. Accordingly, it has been believed in general that they make iron-based sintered alloys, in which oxides intervene in the metallic structures, so that the mechanical characteristics deteriorate. Such circumstances are remarkable when adding Mn and Si into raw material powders as another powder independently of an Fe-system powder.

Although it is possible to think of using an Fe-system alloy which is alloyed with Mn and Si in advance, such an Fe-system alloy is very hard so that the forming of powder compacts itself becomes difficult. Hence, in the production process of the present invention, without alloying Mn and Si with an Fe-system powder, they are intermingled into a raw material powder as another strengthening powder, which is independent of an Fe-system powder.

The sintering step was carried out by heating a powder compact, which included Mn and Si, in an oxidation preventive atmosphere, which could restrain the oxidation of Mn and Si sufficiently, (heating step). The heating step in this sintering step can be carried out in a reducing atmosphere in which a hydrogen (H2) gas is intermingled into an inert gas, however, when carrying it out in an ultra-low-oxygen-partial-pressure inert gas atmosphere whose oxygen partial pressure is equivalent to $10^{-19}$ Pa or less, it is much safer and the cost reduction of the iron-based sintered alloy can be intended. Actually, the present inventors carried out the sintering step within such an ultra-low-oxygen-partial-pressure inert gas atmosphere, and obtained the above-described iron-based sintered alloy of the present invention. The details of this will be described later.

In any case, without ever employing Cu or Ni, they succeeded in obtaining an Fe—Mn—Si(—C)-system iron-based sintered alloy, whose characteristics surpass those of conventional Fe—Cu(—C)-system iron-based sintered alloys. In accordance with the iron-based sintered alloy of the present invention, it is also possible to let it demonstrate mechanical characteristics, which are at equivalent levels to those of carbon steels for mechanical structures.

(3) Iron-Based Sintered Alloy (Containing Cr, and Mo)

The present inventors found out an iron-based sintered alloy with a novel composition, which makes it possible to furthermore strengthen it highly. Namely, an iron-based sintered alloy of the present invention is an iron-based sintered alloy being completed by sintering a powder compact made by press forming a raw material powder composed of iron (Fe) mainly, and is characterized in that: when the entirety is taken as 100% by mass, Cr is 0.2-5.0% by mass; Mo is 0.1-1% by mass; Mn is 0.1-1.2% by mass; Si is 0.1-1.2% by mass; C is 0.1-0.7% by mass; and the major balance is composed of Fe; and it is good in terms of the strength and dimensional stability.

Since the iron-based sintered alloy of the present invention contains alloying elements (Cr and Mo), which facilitate the hardenability, in appropriate amounts, the hardenability improves, for example, even if the iron-based sintered alloy is a big product, sufficient hardening, which depends on the C content, can be done down to its inside.

The hardened iron-based sintered alloy is such that a martensitic structure is formed, and comes to be of high strength, but, in order to secure the toughness, such as elongation, it is advisable to carry out a heat treatment, such as tempering.

(4) Production Process for Iron-Based Sintered Alloy (Containing Cr, and Mo)

Such an iron-based sintered alloy, for example, can be obtained by way of the following production process. Namely, a production process of the present invention for an iron-based sintered alloy, by which the above-described iron-based sintered alloy is obtainable after the following sintering step, is characterized in that it is equipped with: a forming step of making a powder compact by press forming a raw material powder, in which an Fe-system powder, which contains Cr and Mo and in which the major balance is composed of Fe, and a C-system powder, in which C is the major component, are mixed with a strengthening powder, which contains manganese (Mn) and silicon (Si) as being a powder a whole; and a sintering step of heating the powder compact to sinter it in an oxidation preventive atmosphere.

By the way, the hardening of iron-based sintered alloy can be done by performing a heat treatment to an iron-based sintered alloy, which is obtained after a sintering step, however, in accordance with the present invention, there is not necessarily any need for it. Namely, it is possible as well to carry out hardening by utilizing a heating step, which is done in the sintering step, and a cooling step, which comes next to it. It is so-called sinter-hardening.

The heating step of the sintering step must be one in which it is austenite treated by being heated to the A1 transformation temperature (about 730° C.) or more, however, an ordinary sintering temperature is 1,050° C. or more, and further 1,100° C. or more. When intending to furthermore strengthen sintered bodies highly, a much higher sintering temperature, such as 1,200° C. or more, 1,250° C. or more, 1,300° C. or more, and further 1,350° C. or more, can be selected. For example, the sintering step of the present invention can preferably be equipped with a heating step in which heating is carried out in a 1,100-1,370° C. inert gas atmosphere.

The cooling step of the sintering step is done subsequently to the aforementioned heating step, and is a step which decreases the temperature of the iron-based sintered alloy from the sintering temperature down to around room temperature. Strictly speaking from the viewpoint of hardening, it becomes a step which decreases the temperature of the iron-based sintered alloy from the sintering temperature down to the Ms point or less.

By enlarging the cooling rate in this cooling step, it is possible to carry out hardening to the iron-based sintered alloy securely. For example, the cooling rate can preferably be adapted to 5° C./second or more, and further 10° C./second or more. However, in order to obtain such a cooling rate, since forcible cooling becomes necessary usually, and since an apparatus therefor becomes necessary separately, it does not make sinter-hardening, which can reduce the production costs.

In the case of the iron-based sintered alloy of the present invention, sufficient hardening can be done even when the cooling rate is small. Specifically, even when the cooling rate is 3° C./second or less, 2° C./second or less, and further 1° C./second or less, hardening is made possible. Speaking of the cooling rate being 1° C./second or less, it is the cooling rate of ordinary (belt-type) continuous sintering furnaces approximately. Therefore, in accordance with the present invention, without ever disposing a facility for forcible cooling separately, doing hardening to the iron-based sintered alloy is made possible. For example, the sintering step of the present invention can preferably be equipped with a cooling step, which carries out cooling whose cooling rate is 1° C./second or less, after said heating step.

Because of the fact that the sintering step of the present invention is equipped with the above-described heating step and cooling step, the above-described iron-based sintered alloy, which has a martensitic structure, can be obtained after the sintering step. And, since it is possible to complete hardening simultaneously with the completion of the sintering step, the production-cost reduction of the high-strength iron-based alloy can be intended. Additionally, it is not needed to ever dispose a quenching facility, and the like, separately, the practical application at industrial level is made possible sufficiently.

Although reason for making such sinter-hardening possible is not necessarily evident, the synergetic effects by means of Cr as well as Mo and Mn as well as Si, it is because of the fact that the hardenability of the iron-based sintered alloy has improved remarkably.

Note that it is needless to say that the present invention does not hinder carrying out a heat treatment separately in order to adjust the strength, the toughness, and the like, after completing the sintering step. For example, it is advisable as well to separately carry out tempering, and so forth, which have been usually carried out after hardening.

Solving Means of the Second Invention

The present inventors, in order to solve the above-described assignment, studied earnestly and repeated trial and error, as a result, they newly found out that, by having Si contained in an appropriate amount, an iron-based sintered-alloy member, which is free from the occurrence of blistering, and the like, which is of high strength and which is good in terms of the dimensional stability, can be obtained, and arrived at completing the present invention.

(1) Iron-Based Sintered-Alloy Member

Namely, an iron-based sintered-alloy member of the present invention is an iron-based sintered alloy member being completed by sintering a powder compact made by press forming a raw material powder composed of iron (Fe) mainly, and is characterized in that: it comprises, when the entirety is taken as 100% by mass, silicon (Si) in an amount of 0.01-2% by mass; carbon (C) in an amount of 0.1-0.8% by mass; and Fe being the major balance; and it is such a high density that a sintered density ratio ($\rho'/\rho_0'\times100\%$), the ratio of a sintered density ($\rho'$) to a theoretical density ($\rho_0'$), is 96% or more.

(2) Production Process for Iron-Based Sintered-Alloy Member

This iron-based sintered-alloy member, for example, can be obtained by means of the following production process of the present invention. Namely, a production process of the present invention for an iron-based sintered-alloy based member, by which the above-described high-density iron-based sintered-alloy member is obtainable after the following sintering step, is characterized in that it is equipped with: a forming step of press forming a raw material powder, in which an Fe-system powder, which is composed of at least one of pure iron and iron alloy, and a C-system powder, which includes C mainly, are mixed with an Si-system powder, which is composed of simple substance, alloy or compound of Si, thereby obtaining such a powder compact that a green density ratio ($\rho/\rho_0'\times100\%$), the ratio of a green density ($\rho$) to a sintered-body theoretical density ($\rho_0'$), is 96% or more; and a sintering step of heating the powder compact to sinter it in an oxidation preventive atmosphere.

(3) Detailed Background and Operation/Effect

The present inventors, as being found in above-described Patent Literature No. 3, established an industrial method in which a high-density powder compact can be obtained by a single pressing step. In accordance with the compacting method, such an ultra-high-density powder compact whose green density ratio is 96% or more and further 97% or more, for example, can be obtained. And, by sintering the ultra-high-density powder compact once, it becomes possible to obtain an ultra-high-density sintered body (iron-based sintered-alloy member) similarly.

By the way, the present inventors confirmed that, when it becomes such a high density that the green density ratio or the sintered-body density ratio is 96%-97% approximately, all the characteristics of powder compacts or sintered bodies change suddenly. For example, in the case of powder compacts, when a density ratio is up to 95% approximately, their strength increases as the increment of their strength, but, when a density ratio exceeds 96%-97% approximately, their strength comes to increase exponentially. The other mechanical properties (especially, the ductility, fatigue characteristic, and the like), and the magnetic characteristics, and so forth, show the same tendency.

As one of them, when sintering an ultra-high-density powder compact (for example, a green density ratio is 96% or more), it became newly apparent that blistering (blister) is likely to generate. When such blistering occurs, it is natural, though, that the before/after-sintering dimensional stability collapses extremely. Specifically, the dimensions of iron-based sintered-alloy members have enlarged more greatly than the dimensions of powder compacts, and accordingly the sintered density too has degraded. Moreover, the blistering becomes the internal defects of iron-based sintered-alloy members, and, when the blister is fierce, it bursts up so that sintered bodies do not keep their original shapes. In any case, iron-based sintered-alloy members have turned into defective products.

The cause for the occurrence of such blistering is believed to be the fact that moisture, oxides, and the like, which have adhered on the particulate surface of raw material powders, are reduced and decomposed during the heating of the sintering step so that various gases, such as $H_2O$, CO and $CO_2$, generate. It is believed that these gases are enclosed within powder compacts or within sealed holes inside sintered bodies, and expand during the heating of the sintering step so that blistering occurs in sintered bodies. Of course, when the density of powder compact is at such low levels as conventionally, since the generated gases are emitted to the outside through spaces made between the particles of raw material powders, it is less likely that the blistering as aforementioned occurs.

When being an ultra-high-density green compact whose density ratio is 96% or more like the present invention, the contacting circumstances of the respective constituent particles differ from those of conventional ones, and turn into such a state that the respective constituent particles adhere snugly. And, it seems that micro residual air holes, which exist in the inside, turn into independent air holes, which are sealed by the surrounding particles. It seems that gases, which generate at the air-pore portions, lose their way of escape; expand abnormally during the high-temperature heating of the sintering step; destroy the bond between the metallic particles; and had macro blistering occurred.

The extent of the occurrence of such blistering depends on the compositions of raw material powders, the powder particle diameters, the compacting pressures of powder compacts, the sintering conditions (especially, the temperature), and the like.

In the case where a raw material powder is composed of a pure iron powder or low-alloy powder alone, when sintering a powder compact, which has been subjected to high-density forming, the aforementioned blistering does not occur so much. However, when C (a graphite powder, and the like) is included in a raw material powder, the blistering happens often. It seems to result from the fact that oxygen and moisture, which adhere on the particle surface of the raw material powder, are reduced and decomposed to generate CO and $CO_2$ abundantly. In particular, when the blended amount of a graphite powder is 0.1-0.8% by mass, and further 0.3-0.5% by mass, with respect to an entire raw material powder taken as 100% by mass, it generates the fiercest blistering. This is believed to result from the fact that, when graphite carburizes into an Fe-system powder in the sintering step, it turns into CO gases to diffuse into Fe.

However, when a graphite particle, and the like, are contained excessively in a raw material adversely, the blistering of sintered bodies is less likely to occur. When sintering a high-density green compact, which is composed of such a raw material powder, the graphite in the powder compact diffuses, and the like, by means of reactions during sintering, the positions, at which the graphite particles existed originally, can turn into new air holes. The greater the graphite amount is the greater the air-hole amount becomes as well, and accordingly the sealed holes become less likely to be formed inside the sintered body. It seems that the CO gases, and the like, which have generated inside the sintered body, come to be emitted to the outside through those air holes, and so forth, so that blistering becomes less likely to occur.

Of course, as described above, when no graphite powder, and the like, are not contained in a raw material powder, blistering is restrainable. However, an iron-based sintered-alloy member, which does not include C, one of the important elements of steel materials, is not preferable, for it is less likely to intend the improvement of mechanical characteristics by means of heat treatment.

When sintering a high-density green compact whose green density ratio is 96% or more, and further 97% or more, it causes such blistering as described above, regardless of the particle diameter of an employed raw material powder. However, when employing a raw material powder with a fine particle diameter, the aforementioned blistering becomes much more likely to occur. It seems to result from the fact that the finer powder (for example, the particle diameter is 45 m or less) a raw material powder turns into, the higher the sealing property of the sealed pores inside a sintered body enhances so that the leakage of the generated CO gases, and the like, becomes less. The same can be said of the compacting pressures of powder compacts as well. That is, the higher their compacting pressures are heightened the more the sealing property of the inner sealed pores improves so that blistering is likely to occur. For example, when sintering a powder compact, which has been subjected to ultra-high-pressure compacting at 1,200 MPa or more, and further at 1,300 MPa or more, blistering is likely to occur.

However, it is sufficient to evaluate that the influences, which result from the grain sizes of raw material powders and the compacting pressures, to blistering with a green density ratio objectively, as the clogged status of a raw material powder (in other words, the finished status of sealed pores inside a sintered body).

By means of the sintering conditions (especially, the sintering temperature), too, the occurrence status of the blistering of sintered bodies is changeable. The CO gases, and the like, which are enclosed in the sealed pores inside a sintered body, the cause of blistering, are such that the higher the sintering temperature is the higher their gaseous pressures rise. As a result, the higher the sintering temperature is the larger blistering sintered bodies are likely to generate. Indeed, from the viewpoint of intending the strength improvement of sintered bodies, upon heightening the sintering temperature the higher to 1,150° C. or more, to 1,200° C. or more, to 1,250° C. or more, to 1,300° C. or more, and further to 1,350° C. or more, the more likely it was that blistering occurred in sintered bodies.

Based on such circumstances, even when sintering an ultra-high-density powder compact, which is composed of a raw material powder including a graphite powder, and the like, at high temperatures, an iron-based sintered-alloy member, which does not generate the aforementioned blistering, and the production process for the same have been required.

The present inventors, in order to solve this assignment, thought of suppressing the occurrence of the CO gases, and the like, which become the cause of blistering, itself. For this, before oxygen, which exists in a raw material powder, reacts with a graphite powder, and so forth, which are present around it, to generate gases, such as CO gases, it is advisable to fix the oxygen as a stable solid (oxide) inside the sintered body. The present inventors confirmed the fact that the effect is present in Mn or Si, whose affinity to O is stronger and oxide-formation free energy is lower than that of C, that is, the fact that an effect as an oxygen getter is present.

Mn or Si is such that the affinity to O is high extremely, and that the oxide-formation free energy is low sufficiently. Moreover, they are the fundamental elements of steels, are elements, which are procurable inexpensively comparatively, and additionally do not hinder the recyclability of iron-based sintered-alloy member, either. In particular, a (fine) powder (for example, an Fe—Mn—Si powder), which is composed of alloy or intermetallic compound of Fe, the major component of the iron-based sintered-alloy member, with Mn or Si, is such that the affinity to O is higher than that of Mn or Si simple substance, and that the oxide-formation free energy is low, too, besides, it is procurable more inexpensively. When employing such an Fe—Mn—Si powder, and the like, it is possible to obtain an iron-based sintered-alloy member, which is of high strength and of high density, at much lower costs, without having blistering occurred.

Further, according to what the present inventors studied using Fe—Mn—Si powders with various compositions, it was found out that the effect of restraining the sintered bodies' blistering is greater in Si than in Mn. Thus, the present inventors arrived at completing the above-described present invention.

Since the iron-based sintered-alloy member of the present invention is such that no blistering occurs virtually, it makes one, which inherits the dimensional accuracy and high density of a powder compact. Therefore, since the iron-based sintered-alloy member of the present invention is of high density and high strength, and additionally is good in terms of the dimensional accuracy, it is available at low costs.

In accordance with the production process of the present invention for an iron-based sintered-alloy member, since it is possible to obtain such a good iron-based sintered-alloy member, not by 2P2S like conventionally, but by single-press forming and single-sintering (1P1S), it is possible to suppress the production costs. Furthermore, in accordance with the production process of the present invention, since it is possible to obtain sintered products, which are close to the final configurations, too, it is possible to expect the machining-man-hour-requirement cut-down, material-yield improvement, reduction of products' unit prices, and the like, by means of (net) shaping.

By means of the present invention, it becomes possible to produce iron-based sintered-alloy members, which belong to a high-density region which has transcended the conventional concept, as well. As a result, the defense range of iron-based sintered-alloy members has extended from those of low density to those of ultra-high density, and accordingly the intended use for iron-based sintered-alloy members has expanded remarkably.

In the case of the present invention, Si is an important element in view of restraining the blistering of the iron-based sintered-alloy member. When Si is too less, the effect is poor; and, when it becomes excessive, the dimensional contraction amount upon sintering becomes so large that it is not preferable. The lower limit value of Si can preferably be 0.01% by mass, 0.02% by mass, and further 0.05% by mass. The upper limit value of Si can preferably be 2% by mass.

Note that, in the present invention, the C amount is adapted to 0.1-0.8% by mass, while considering the occurrence status of blistering as well as the versatility of the iron-based sintered-alloy member as structural members, and the like. When C is too less, no high-strength sintered-alloy member can be obtained; and, when C becomes excessive, the ductility degrades so that it is not preferable. C can preferably be 0.2-0.6% by mass, and further 0.3-0.5% by mass.

Mn, in addition to Si, is an element which improves the mechanical characteristics (strength or ductility, and the like) of iron-based sintered-alloy members. When being too less, the effect is poor; and, when becoming excessive, it results in the strength degradation, and the before/after-sintering dimensional stability too is hindered. Mn, when the entire iron-based sintered-alloy member is taken as 100% by mass, is such that the sum with Si can become 3.5% by mass or less, 3% by mass or less, and further 2.5% by mass or less; moreover, it can preferably be included so that the sum becomes 0.02% by mass or more, 0.03% by mass or more, and further 0.05% by mass. In this case, the lower limit value of Mn can preferably be 0% by mass, 0.01% by mass, 0.02% by mass, 0.05% by mass, 0.1% by mass, and further 0.2% by mass. The upper limit value of Mn can preferably be 1.5% by mass, 1.2% by mass (especially, less than 1.2% by mass), 1.15% by mass, 1.1% by mass, 1.05% by mass, and 1.0% by mass (especially, less than 1.0% by mass), and further it is advisable that it can fall in a range of 1-0.5% by mass as well.

Other than the aforementioned elements, it can contain alloying elements, such as molybdenum (Mo), chromium (Cr) and nickel (Ni). In particular, in the case of carrying out a heat treatment, such as refining, it is preferable to contain these elements. Since their suitable contents change depending on the C amount, and the like, they cannot be identified sweepingly, however, it is suitable that, when the entire iron-based sintered-alloy member is taken as 100% by mass, Mo can be included in an amount of 0.3-2% by mass, and further 0.5-1.5% by mass; Cr can be included in an amount of 0.3-5% by mass, and further 0.5-3.5% by mass; and Ni can be included in an amount of 0.5-6% by mass, and further 1-4% by mass, for example.

The iron-based sintered-alloy member of the present invention, without ever having Cu contained, is of high strength, and is good in terms of the dimensional stability. Namely, in accordance with the present invention, it is possible to make it a Cu-free iron-based sintered-alloy member, which does not include Cu, which is removed with difficulty by means of smelting, and the like, substantially. Therefore, the present invention improves the recyclability of iron-based sintered-alloy members, and is preferable in view of environmental protections. Further, by suppressing the employment of Cu, the material-cost reduction of iron-based sintered-alloy members can be intended, and additionally the hot brittleness of iron-based sintered-alloy members, which results from Cu, can be avoided. However, the iron-based sintered-alloy member, which is set forth in the present description, according to the present invention does not exclude the case of containing Cu entirely. The case of containing an appropriate amount of Cu in addition to the above-descried Si and C is involved in the scope of the present invention as well.

The "strength" and "dimensional stability" set forth in the present description depend on the compositions of raw material powders, the formed-body densities (or forming pressures), the sintering conditions (temperature, time, atmosphere, and the like), and so forth. Therefore, it is not possible to identify those "strength" and "dimensional stability" sweepingly. If setting forth them daringly, the strength can preferably be 1,000 MPa or more, 1,500 MPa or more, 2,000

MPa or more, 2,500 MPa or more, and further 3,000 MPa or more, by transverse rupture strength.

The dimensional stability, without causing blistering during sintering, can preferably be such that a before/after sintering dimensional change rate can be within ±1%, within ±0.5%, within ±0.3%, and further within ±0.1%. Note that, although this dimensional stability can be found from the measured results between a dimension of a powder compact and a dimension of a sintered body, which is made by sintering it, the measured location is adapted to measuring a dimension, which is likely to change dimensionally by means of blistering.

The dimensional stability, not by means of the aforementioned dimensional change rate, can be evaluated by the comparison between a green density ratio and a sintered-body density ratio. Namely, the iron-based sintered-alloy member of the present invention is such that said sintered-body density ratio can be within ±1%, within ±0.5%, within ±0.3%, and further within ±0.1%, with respect to said green density ratio.

The "iron-based sintered-alloy member," set forth in the present description, is such that its form does not matter, for example, can even be materials, such as ingot-shaped, rod-shaped, tube-shaped plate-shaped ones, and can even be final configurations or structural members, which are close to them. Therefore, this iron-based sintered-alloy member can be paraphrased simply as an "iron-based sintered alloy."

BRIEF DESCRIPTION OF THE DRAWINGS

The patent or application file contains at least one drawing executed in color. Copies of this patent or patent application publication with color drawings will be provided by the U.S. Patent and Trademark Office upon request and payment of the necessary fee.

BEST MODE FOR CARRYING OUT THE INVENTION

I. Embodiment Mode

Embodiment Mode for the First Invention

Figure 1:
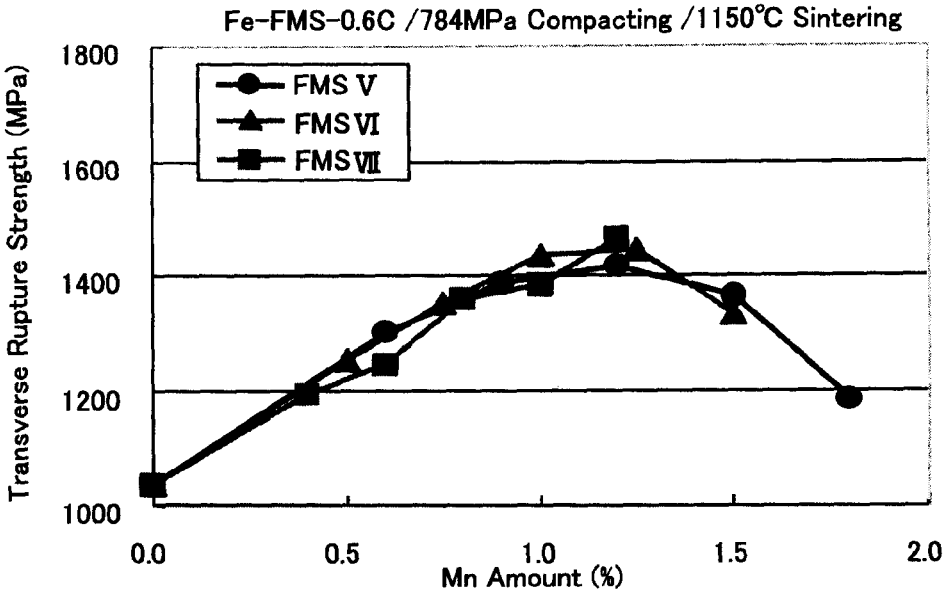
FIG. 1 is a graph for illustrating the relationships between the Mn amount and transverse rupture strength of a 1,150° C.-sintered body (iron-based sintered alloy).

While naming embodiment modes, the present invention will be explained in more detail. Note that it should be notified that, including the following embodiment modes, the contents explained in the present description can be applied appropriately not only to the iron-based sintered alloy according to the present invention but also to its production process. Moreover, an iron-based sintered alloy with improved hardenability, which contains Cr or Mo, and its production process are naturally involved in them. Furthermore, it should be notified that whether which one of the embodiment modes is best or not depends on objects, required performance, and the like.

(1) Raw Material Powder

A raw material powder comprises an Fe-system powder, which is the major component of the iron-based sintered alloy, and a strengthening powder, which includes Mn and Si.

The Fe-system powder can be either a pure iron powder or an iron alloy powder, or even a mixture powder of them. Alloying elements, which are included in the iron alloy powder, do not matter. As for these alloying elements, first of all, C, Mn, Si, P, S, and the like, are available. Mn and Si are added as the strengthening powder, but can be included in small amounts even in the Fe-system powder. However, when the contents of C, Mn, Si, and so forth, increase, the Fe-system powder becomes so hard that the compactibility degrades. Hence, when the Fe-system powder is an iron alloy powder, it is advisable so that C, 0.02% by mass or less, Mn: 0.2% by mass or less, and Si: 0.1% by mass or less.

As for alloying elements other than those, Mo, Cr, Ni, V, Co, Nb, W, and the like, are available. These alloying elements improve the thermal treatabilities of iron-based sintered alloys, and are effective elements for strengthening iron-based sintered alloys. These alloying elements, when the entire raw material powder is taken as 100% by mass, can suitably be included so that Mo: 0.1-3% by mass, and further 0.2-2% by mass, Cr: 0.2-5% by mass, and further 0.3-3.5% by mass, and Ni: 0.5-6% by mass, and further 1-4% by mass. Note that these alloying elements are not needed to be contained in the raw material powder as an iron alloy powder, but can be mixed in the raw material powder as powders, and so forth, of alloys or compounds other than Fe.

The strengthening powder is such that, as far as it includes Mn and Si as being a powder as a whole composed of one member or two members or more, its existing form does not matter. For example, the strengthening powder can be one member of Mn—Si-system powders, which are composed of alloys or compounds of Mn and Si. Moreover, it can be a composite powder in which an Mn-system powder, composed of Mn simple substance, alloy or compound, is combined with an Si-system powder, composed of Si simple substance, alloy or compound. Furthermore, it can be a composite powder in which two or more members of this Mn—Si-system powder, an Mn-system powder, composed of Mn simple substance, alloy or compound, and an Si-system powder, composed of Si simple substance, alloy or compound are combined.

The Mn—Si-system powder can preferably be an Fe—Mn—Si powder (hereinafter this powder will be referred to as an "FMS powder" wherever appropriate), which is composed of Fe, the major component of the iron-based sintered alloy, and an alloy or intermetallic compound of Mn and Si. This powder is such that it is possible to produce it inexpensively comparatively, or to procure it.

This FMS powder, when the entire FMS powder is taken as 100% by mass, can preferably be such that Mn is 15-75% by mass, Si is 15-75% by mass, the sum of Mn and Si is 35-95% by mass, and the major balance is Fe. When Mn and Si are too less, it turns into an iron alloy with ductility, and it becomes difficult to pulverize it to a fine powder. Moreover, the addition amount of the FMS powder in the raw material powder becomes greater, and it has raised the costs of the iron-based sintered alloy. On the other hand, when Mn and Si are excessive, it is not preferable because the cost for the compositional adjustment rises. It is more preferable that Mn can be 20-65% by mass, Si can be 20-65% by mass, and the sum of Mn and Si can be 50-90% by mass.

The composition ratio of Mn to Si in the FMS powder does not matter, but it is preferable that the composition ratio (Mn/Si) can be 1/3-3, and further 1/2-2, especially, the compositional ratio can be around 1 (0.9-1.1), that is, Mn and Si in the FMS powder can be proportions of the same extent (about 1:1). It is because, if such is the case, it is likely to obtain a well-balanced iron-based sintered alloy, which is good in terms of all of the strength, ductility, dimensional stability, and the like.

The FMS powder can preferably be such that the contained O amount is 0.4% by mass or less, and further 0.3% by mass or less. When the O amount in the raw material powder increases, the strengthening actions by means of Mn and Si cannot be demonstrated sufficiently. Further, when sintering such an ultra-high-density powder compact whose green density ratio exceeds 96%, O, which exists inside it, can become a cause for having blistering (blister) occurred in the sintered body. This issue will be described later.

The proportion of the strengthening powder, which is blended in the raw material powder, depends on the compositions of employing powders, or the desired characteristics (the compositions of Mn and Si in the iron-based sintered alloy) of the iron-based sintered alloy. For example, when employing an FMS powder (Mn is 15-75% by mass, Si is 15-75% by mass, and the sum of Mn and Si is 35-95% by mass), it is advisable to blend it in an amount of 0.05-5% by mass, and further 0.1-4% by mass, when the entire raw material powder is taken as 100% by mass. Furthermore, its lower limit value can preferably be 0.2% by mass, 0.3% by mass, 0.4% by mass, and further 0.5% by mass.

The smaller the particle diameter of the strengthening powder is the more the green density ratio and sintered density ratio improve so that it is likely that a homogenous iron-based sintered alloy, in which the compositional fluctuation or the segregation, and the like, are less, can be obtained. However, powders whose particle diameters are small excessively are procured with difficulty, and the costs are high. The agglomeration, and so forth, is likely to generate so that the handlability is bad. Hence, when the strengthening powder is such that the particle diameter is 100 μm or less, 63 μm or less, 45 μm or less, and further 25 μm or less, it is likely to disperse uniformly. It is advisable to employ those, which are procurable with ease, within the range. Note that the particle diameter set forth in the present description is one which is identified by means of sieving.

Although the iron-based sintered alloy of the present invention is strengthened by means of Mn and Si, much higher strengthening can be intended by containing C additionally. In particular, by means of heat treatments such as hardening and tempering, it becomes easy to better or adjust the mechanical characteristics of the iron-based sintered alloy.

For the introduction of C into the iron-based sintered alloy, it is possible to think of employing an Fe-system powder (Fe-system alloy powder), which includes C. However, in view of the compactibility of the raw material powder or the easiness of the blending adjustment of C amount, and the like, it is advisable to mix a C-system powder in the raw material powder. The C-system powder is such that a graphite powder (Gr powder) in which C is 100% substantially is representative, but, in addition to it, it is also possible to employ an Fe—C alloy powder, various carbide powders, and so forth. It is advisable that the blended amount of the C-system powder, and so on, as described above, can be adapted so that the C amount in the iron-based sintered alloy makes 0.1-1.0% approximately.

(2) Compacting Step

The production process of the present invention for an iron-based sintered alloy mainly comprises a compacting step, and a sintering step. Here, first of all, the compacting step will be explained in detail.

The production process of the present invention mainly comprises a compacting step, and a sintering. Here, the compacting step will be first explained in detail.

The compacting step is a step in which the raw material powder, in which the above-described Fe-system powder is mixed with the strengthening powder, is press compacted to make a powder compact. The compacting pressure in this instance, the density of the powder compact (or the green density ratio), the configuration of the powder compact, and the like, do not matter.

However, the compacting pressure and green density, considering the handlability of the powder compact, can be such an extent that it does not collapse with ease at least. For example, the compacting pressure can preferably be 350 MPa or more, 400 MPa or more, and further 500 MPa or more. When being referred to as the green density ratio, it is preferable to be 80% or more, 85% or more, and further 90% or more. The higher the compacting pressure or green density ratio is the more likely it is that the high-strength iron-based sintered alloy can be obtained, but it is advisable to select an optimum compacting pressure or green density rate depending on the intended use for the iron-based sintered alloy, and the specifications. Moreover, the compacting step can be either cold compaction or warm compaction, and an internal lubricant can be added into the raw material powder. When adding an internal lubricant, it is considered the raw material powder while including the internal lubricant as well.

By the way, the present inventors, as there is a disclosure in Patent Literature No. 3, established a compacting method for a powder compact, the compacting method which makes ultra-high-pressure compaction, which transcends general compacting pressures, possible. In accordance with this compacting method, at such ultra-high pressures as 1,000 MPa or more, 1,200 MPa or more, 1,500 MPa or more, and further about 2,000 MPa or more, powder compacting is made possible. The density of a powder compact, which can be obtained by means of this, can reach 96% or more, 97% or more, 98% or more, and further even up to 99%. Hereinafter, this good compacting method (hereinafter, this compacting method will be referred to as "die wall lubrication warm compaction method" wherever appropriate) will be explained.

The die wall lubrication warm compaction method (compacting step) comprises a filling step of filling said raw material powder in a die with a higher fatty acid-system lubricant applied on the inner surface, and a warm compacting step of generating a metallic soap film on the surface of the raw material powder, which contacts with the die inner surface, by warm pressurizing the raw material powder disposed within this die.

In accordance with this compacting method, even when making the compacting pressure lager considerably, such drawbacks that generate in general compacting methods do not generate. Specifically, the galling between the raw material powder and the inner surface of the die, the excessively enlarging ejection force, the degradation of the die longevity, and the like, can be restrained. Hereinafter, the filling step and warm compacting step of this compacting method will be explained in more detail.

(a) Filling Step

Before filling the raw material powder in a die (cavity), a higher fatty acid-system lubricant is applied on the inner surface of a die (applying step). The higher fatty acid-system lubricant employed herein, in addition to a higher fatty acid itself, can be the metallic salts of higher fatty acids as well. As the metallic salts of higher fatty acids, lithium salts, calcium salts, or zinc salts, and the like, are available. In particular, lithium stearate, calcium stearate, zinc stearate, and so forth, are preferable. In addition to these, it is possible to use barium stearate, lithium palmitate, lithium oleate, calcium palmitate, calcium oleate, and so on.

The applying step, for example, can be carried out by spraying a higher fatty acid-system lubricant, which is dispersed in water, an aqueous solution or an alcoholic solution, and the like, into a heated die. When a higher fatty acid-system lubricant is dispersed in water, and so forth, it is likely to spray the higher fatty acid-system lubricant onto the inner surface of a die uniformly. When it is sprayed into a heated die, the water content, and so on, evaporate quickly, and accordingly the higher fatty acid-system lubricant adheres onto the inner surface of the die uniformly. The heating temperature of a die is such that, although it is preferable to consider the temperature of the later-described warm compacting step, it is sufficient to heat it to 100° C. or more, for instance. However, in order to form a uniform film of a higher fatty acid-system lubricant, it is preferable to adapt the heating temperature to less than the melting point of the higher fatty acid-system lubricant. For example, when lithium stearate is used as a higher fatty acid-system lubricant, it is advisable to adapt the heating temperature to less than 220° C.

Note that, in dispersing a higher fatty acid-system lubricant in water, and the like, it is preferable that the higher fatty acid-system lubricant can be included in a such proportion as 0.1-5% by mass, and further 0.5-2% by mass, when the mass of its entire aqueous solution is taken as 100% by mass, because a uniform lubricant film is formed on the inner surface of a die.

Moreover, in dispersing a higher fatty acid-system lubricant in water, and the like, when a surfactant is added to the water, uniform dispersion of the higher fatty acid-system lubricant can be intended. As for such a surfactant, it is possible to use alkyl phenol-system surfactants, polyoxyethylene nonyl phenyl ether (EO) 6, polyoxyethylene nonyl phenol ether (EO) 10, anionic nonionic-type surfactants, boric acid ester-system emulbon T-80, and so forth, for instance. It is advisable as well to combine two or more members of these to employ. For example, when lithium stearate is used as a higher fatty acid-system lubricant, it is preferable to use three members of the surfactants, polyoxyethylene nonyl phenyl ether (EO) 6, polyoxyethylene nonyl phenol ether (EO) 10 and boric acid ester-system emulbon T-80, simultaneously. It is because, in this case, the dispersibility of lithium stearate in water, and so on, is activated all the more, compared with the case where only one member of them is added.

In order to obtain an aqueous solution of a higher fatty acid-system lubricant whose viscosity fits for spraying, it is preferable to adapt the proportion of a surfactant to 1.5-15% by volume when the volume of its entire aqueous solution is taken as 100% by volume.

In addition to this, it is advisable to add a small amount of an antifoaming agent (for example, a silicon-system antifoaming agent, and the like). It is because, if the bubbling of an aqueous solution is vigorous, a uniform film of a higher fatty acid-system lubricant is less likely to be formed on the inner surface of a die when spraying it. The addition proportion of an antifoaming agent can be 0.1-1% by volume approximately, for example, when the entire volume of its aqueous solution is taken as 100% by volume.

It is suitable that the particles of a higher fatty acid-system lubricant, which is dispersed in water, and the like, can be such that the maximum particle diameter is less than 30 μm. It is because, when the maximum particle diameter becomes 30 μm or more, the particles of a higher fatty acid-system lubricant are likely to precipitate in an aqueous solution so that it becomes difficult to apply the higher fatty acid-system lubricant onto the inner surface of a die uniformly.

For the application of an aqueous solution, in which a higher fatty acid-system lubricant is dispersed, it is possible to carry it out, using spraying guns, electrostatic guns, and the like, for coating, for instance. Note that, as a result that the present inventors examined the relationship between the applying amount of higher fatty acid-system lubricants and the ejection force for powder compacts, it is preferable to have a higher fatty acid-system lubricant film adhered on the inner surface of a die so that the film thickness becomes 0.5-1.5 μm approximately.

(b) Warm Compacting Step

It is believed that, when a raw material powder, which is filled in a die in which a higher fatty acid-system lubricant is applied on the inner surface, is warm compacted, a metallic soap film is formed on the surface of the raw material powder (or powder compact), which contacts with the die inner surface, so that ultra-high-pressure compacting at industrial level has become possible by the presence of this metallic soap film. This metallic soap film bonds firmly to the surface of the powder compact, and demonstrates far better lubricating performance than the higher fatty acid-system lubricant, which has been adhered on the inner surface of the die. As a result, it sharply reduces the frictional force between the contact surface of the inner surface of the die and the contact surface of the outer surface of the powder compact, and does not cause galling, and the like, despite high-pressure compacting. Moreover, it is possible to take a powder compact out of the die with a very low ejection force, and accordingly the die longevity's excessive shortening has disappeared as well.

The metallic soap film, for example, is an iron salt film of a higher fatty acid, which is formed by a mechanochemical reaction taken place between a higher fatty acid-system lubricant and Fe in a raw material powder under warm high pressure. A representative example of this is an iron stearate film, which is generated when lithium stearate or zinc stearate, a higher fatty acid-system lubricant, reacts with Fe.

"Warm," which is referred to in the present step, can be such an extent of heating state that the reaction between a raw material powder and a higher fatty acid-system lubricant is facilitated. Roughly speaking, it is advisable to adapt the compacting temperature to 100° C. or more. However, from the viewpoint of preventing the degenerative change of a higher fatty acid-system lubricant, it is advisable to adapt the compacting temperature to 200° C. or less. It is more suitable to adapt the compacting temperature to 120-180° C.

"Pressurizing," which is referred to in the present step, can be determined appropriately within a range where a metallic soap film is formed while considering the specifications of the iron-based sintered alloy. Considering the die longevity and the productivity, it is preferable to adapt the upper limit of the forming pressure to 2,000 MPa. When the compacting pressure becomes 1,500 MPa approximately, the density of the obtained powder compact, too, approaches the true density (becomes 98-99% by green density ratio), and no further high-densification can be desired even when pressurizing it to 2,000 MPa or more.

Note that, when using this die wall lubrication warm compaction method, it is not necessary to employ an internal lubricant, and a powder compact with much higher density can be obtained. Moreover, when the powder compact is sintered, there is no such case that the inside of a furnace is polluted accompanied by the decomposition, emission, and the like, of an internal lubricant. However, it should be notified that, in the present invention, the employment of an internal lubricant is not excluded.

(3) Sintering Step

The sintering step is a step in which a powder compact obtained in the compacting step is sintered by heating it in an oxidation preventive atmosphere.

The sintering temperature and sintering time are selected appropriately, considering the desired characteristics, productivity, and the like, of the iron-based sintered alloy. The higher the sintering temperature is in a shorter period of time the high-strength iron-based sintered alloy can be obtained. However, when the sintering temperature is too high, liquid phases arise, or dimensional contraction becomes large so that it is not preferable. When the sintering temperature is too low, the diffusion of alloying elements becomes insufficient so that it is not preferable. Moreover, the sintering time becomes long, and accordingly the productivity of the iron-based sintered alloy degrades. The sintering temperature can be 900-1,400° C., and further 1,100-1,350° C. In particular, when obtaining the high-strength iron-based sintered alloy, the sintering temperature can be adapted to 1,150° C. or more. Moreover, the sintering time can be adapted to 0.1-3 hours, and further 0.1-2 hours, while considering the sintering temperature, the specifications, productivity and costs of the iron-based sintered alloy, and so forth.

The sintering atmosphere can be an oxidation preventive atmosphere. Mn and Si, which are included in the strengthening powder, are such that the affinity to O is strong extremely so that they are elements which are very likely to be oxidized. In particular, when employing an FMS powder, the oxide-formation free energy is lower than those of the simple substances of Mn and Si so that there is a fear that it reacts even with scant O within a heating furnace to form the oxides of Mn and Si inside the sintered body. The intervention of such oxides is not preferable, because it deteriorates the mechanical properties of the iron-based sintered alloy. Hence, the sintering atmosphere can preferably be an oxidation preventive atmosphere, such as a vacuum atmosphere, an inert gas atmosphere and a nitrogen gas atmosphere. Even if it is such an atmosphere, when residual oxygen (oxygen partial pressure) therein further matters, it is advisable to employ a reducing atmosphere in which a hydrogen gas (high-purity hydrogen gas, which is purified to a low dew point (for example, −30° C. or less)) is mixed with a nitrogen gas in an amount of a few % by volume (for instance, 5-10%).

However, since the employment of a hydrogen gas is not preferable so much industrially, it is more preferable to carry out the sintering step of the present invention within an ultra-low-oxygen-partial-pressure inert gas atmosphere whose oxygen partial pressure is equivalent to $10^{-19}$ Pa or less (100 ppm or less by CO concentration). In such an ultra-low-oxygen-partial-pressure inert gas atmosphere, even when an FMS powder reacts with O, which has adhered, and the like, on a raw material powder so that composite oxides, and so forth, are formed, they are decomposed further. As a result, the iron-based sintered alloy with a healthy structure, which is free from intervening substances, such as oxides, can be obtained. Note that a continuous sintering furnace, which realizes an ultra-low-oxygen-partial-pressure inert gas (N2 gas) atmosphere, is commercially available (OXYNON furnace produced by KANTO YAKIN KOGYO Co., LTD.).

(4) Ultra-High-Density Iron-Based Sintered Alloy

The iron-based sintered alloy of the present invention does not question the high/low of its density. That is, like the conventional iron-based sintered alloys, it can be a low-density iron-based sintered alloy which is made by sintering a powder compact subjected to low-pressure compacting, or can be a high-density sintered alloy which is made by sintering a high-density powder compact subjected to high-pressure compacting using the above-described die wall lubrication warm compaction method. In either of the cases, the improvement of the iron-based sintered alloy's strength and dimensional stability can be intended by means of Mn and Si. However, in order to obtain such a high-strength iron-based sintered alloy that equals iron-based sintered bodies or forged sintered bodies, which can be obtained by means of double-pressing and double-sintering (2P2S), and further melt-produced materials, it is preferable that the powder compact or the sintered body can rather be of much higher density. For example, it is suitable that a green density ratio or a sintered density ratio can be 92% or more, 95% or more, 96% or more, and further 97% or more.

However, according to the present inventors' studies, when sintering such an ultra-high-density powder compact (for example, a green density ratio is 96% or more), it became apparent that blistering (blister) is likely to generate. In particular, when C is included in a raw material powder by means of a graphite powder, and the like, such blistering is likely to occur. When such blistering occurs, it is natural, though, that the before/after-sintering dimensional stability collapses extremely. Specifically, the dimensions of iron-based sintered alloys have enlarged more greatly than the dimensions of powder compacts abnormally, and accordingly the sintered density has degraded extremely. Further, blistering, which is made when air holes are formed inside iron-based sintered alloys, becomes not only the internal defects of iron-based sintered alloys, but also it is probable that such an instance occurs that, when the blister is fierce, it bursts up so that sintered bodies do not keep their original shapes. In any case, when such blistering occurs, iron-based sintered alloys have turned into defective products.

The cause that such blistering occurs lies in various gases, such as $H_2O$, CO and $CO_2$, which generate when moisture, oxides, and the like, which have adhered on the particulate surface of raw material powders, are reduced and decomposed during the heating of the sintering step. It is believed that these gases are enclosed within sealed holes inside sintered bodies, and expand during the heating of the sintering step so that blistering occurs in sintered bodies. Of course, when a powder compact is such a low density as conventionally, since the generated gases are emitted to the outside through spaces made between the particles of raw material powders, it seems that the occurrence of blistering as aforementioned is less.

When being an ultra-high-density green compact whose density ratio is 92% or more, and further 96% or more, like the present invention, the contacting circumstances of the respective constituent particles differ from those of conventional ones, and it seems that they turn into such a state that the respective constituent particles adhere snugly. And, micro residual air holes, which exist in the inside, too, turn into independent air holes, which are sealed by the surrounding particles. It seems that gases, which generate at the portions, lose their way of escape; become high pressures abnormally by means of the high-temperature heating during the sintering step; and further destroy the contact or bond between the metallic particles to expand; as a result, they have emerged as macro blistering.

In order to obtain an iron-based sintered alloy, which is of high strength and is good in terms of the dimensional stability, even when sintering an ultra-high-density powder compact, which is composed of a raw material powder including C such as graphite, at high temperatures, an iron-based sintered alloy, which does not generate the aforementioned blistering, and the production process for the same are required.

The present inventors thought of, before oxygen, which exists in a raw material powder, reacts with graphite, and the like, which are present around it, to generate gases, such as CO gases, restraining the occurrence of the CO gases, and so forth, by fixing the oxygen as a stable solid (oxide) in the sintered body. Specifically, they thought of adding a substance (namely oxygen getter), whose affinity to O is stronger and oxide-formation free energy is lower than that of C, to a raw material powder. And, they found out newly that the effect as an oxygen getter is present in Mn and Si (especially in Si).

Namely, by having Si, and the like, included in the iron-based sintered alloy, not only the improvement of the strength and dimensional stability as aforementioned can be intended, but also the blistering prevention comes to be intended when sintering ultra-high-density green compacts.

Thus, in accordance with the present invention, it becomes possible to obtain the iron-based sintered alloy, which is of high strength and is good in terms of the dimensional stability and furthermore which is low cost, in such a form that is provided with from a low density to an ultra-high density, and accordingly the application range (intended use) for the iron-based sintered alloy has come to expand remarkably. In particular, when utilizing the above-described die wall lubrication warm compaction method, the low-cost iron-based sintered alloy, which is of much higher strength and is good in terms of the dimensional stability as well, by single-pressing and single-sintering (1P1S), without ever employing the conventional 2P2S or powder forging method. Such an iron-based sintered alloy, which is of high density, and the production process for the same, can be identified as follows, for instance.

Namely, an iron-based sintered alloy can be identified in such a manner that it is an iron-based alloy, which is completed by sintering a powder compact made by press compacting a raw material powder composed of Fe mainly; and it is characterized in that, when the entirety is taken as 100% by mass, it comprises Si in an amount of 0.01-2% by mass, C in an amount of 0.1-1.0% by mass, and Fe, the major balance; and it is of such a high density that a sintered density ratio ($\rho'/\rho0'\times100\%$), the ratio of an apparent density ($\rho'$) to a theoretical density ($\rho0'$), is 92% or more, and further 96% or more.

Moreover, its production process can be identified in such a manner that it is characterized in that it is equipped with a compacting step of obtaining a powder compact, whose green density ratio ($\rho'/\rho0'\times100\%$), the ratio of a green density ($\rho'$) to a theoretical density ($\rho0'$), is 92% or more, and further 96% or more, by press compacting a raw material powder, in which an Fe-system powder, which is composed of at least one of pure iron and iron alloy, a C-system powder, which includes C mainly, and an Si-system powder, which is composed of Si simple substance, alloy or compound, are mixed; and a sintering step of heating the powder compact to sinter it; and the above-described iron-based sintered alloy, which is of high density, can be obtained after the sintering step.

(5) Before/after-Sintering Varied C Amount and Dimensional Stability

The present inventors found out newly that, when having an FMS powder mixed in a raw material powder, the C-amount variation before/after sintering becomes small remarkably. And, the smaller the varied C amount is the smaller the dimensional change of the iron-based sintered alloy becomes. Further, it was also understood that the varied C amount relates to the before-sintering density of the iron-based sintered alloy. That is, of the higher density the powder compact is the smaller the before/after-sintering varied C amount becomes, and accordingly it became apparent as well that, when a powder compact approaches the true density, the C amount hardly varies before and after sintering so that it stabilizes.

It has been believed natural so far that C dissipates during sintering so that the C amount decreases by 10-20% approximately before and after sintering. However, in accordance with the present invention, it is possible to make the varied C amount before/after sintering small extremely, and accordingly the yield ratio of a C-system powder, which is mixed in a raw material powder, improves, and consequently the cutback of the iron-based sintered alloy's raw material cost becomes possible. In particular, since a Gr powder is expensive comparatively, the raw material cost can be reduced by mean of the yield-ratio improvement.

Moreover, since the blended composition of a raw material powder is reflected as it is substantially to the after-sintering alloy composition, the production of the iron-based sintered alloy with desired compositions becomes possible. Thus, the strengthening action for the iron-based sintered alloy by means of C is demonstrated stably, too; and accordingly, from the viewpoint of the dimensional stability as well as the mechanical characteristics, such as the strength, the quality control of the iron-based sintered alloy becomes easy.

The reason why the varied C amount becomes small has not necessarily been clear yet, but it is believed as follows currently. That is, oxygen (O), which is included in a raw material powder, is taken in preferentially by an FMS powder, which is included similarly in the raw material powder, during sintering; as a result, it comes to hardly react with C, such as a Gr powder. Accordingly, it is believed that C, which turns into CO, $CO_2$, and the like, to be emitted to the outside, decreases sharply so that the decrement of the C amount in the iron-based sintered alloy comes to be suppressed remarkably. For example, according to the present inventors' experiments, it is confirmed that, when measuring an emitted oxygen amount in a range of from room temperature to 1,350° C., the emitted oxygen decreased from 0.1% to 0.06% with or without an FMS powder.

Based on the above fact, the present invention can preferably be such that the green density ratio ($\rho/\rho 0' \times 100\%$) of the powder compact can be 92% or more, 94%, 96% or more, and further 98% or more. Moreover, the compacting step according to the production process of the present invention can desirably be a step in which the iron-based sintered alloy, which is of such high density, can be obtained.

This fact is the same even when focusing attention not on the green density ratio but on the sintered density ratio. This is because, accompanied by the reduction of the varied C amount, the before/after-sintering weight change and dimensional change become small so that no substantial difference arises between the green density ratio and the sintered density ratio. Hence, it is possible to say that the sintered density ratio ($\rho'/\rho 0' \times 100\%$) of the iron-based sintered alloy of the present invention, too, can preferably be 92% or more, 94%, 96% or more, and further 98% or more.

Note that the above-described contents regarding the before/after-sintering varied C amount are applicable, regardless of the compositions of the iron-based sintered alloy or Fe-system powder. However, when the more it rather contains Cr than Mo, the smaller the varied C amount tends to become.

(6) Others

The iron-based sintered alloy, depending on its specifications, can be further subjected to heat treatment steps, such as annealing, normalizing, aging, refining (hardening, and tempering), carburizing and nitriding. Of course, the iron-based sintered alloy can preferably be such a composition (C, Mo, Cr, and the like) that depends on the type of heat treatments.

The form of and intended use for the iron-based sintered alloy of the present invention do not matter. When naming an example of iron-based sintered-alloy members in which the iron-based sintered alloy of the present invention is employable, in the automotive filed, there are various pulleys, synchronizer hubs for transmissions, connecting rods for engines, hub sleeves, sprockets, ring gears, parking gears, pinion gears, and the like. In addition to them, there are sun gears, driving gears, driven gears, reduction gears, and so forth.

Embodiment Mode of the Second Invention

While naming embodiment modes, the present invention will be explained in more detail. Note that it should be notified that, including the following embodiment modes, the contents explained in the present description can be applied appropriately not only to the iron-based sintered-alloy member according to the present invention but also to its production process. Moreover, it should be notified that whether which one of the embodiment forms is best or not depends on objects, required performance, and the like.

(1) Raw Material Powder

A raw material powder comprises an Fe-system powder, a C-system powder, and an Si-system powder.

The Fe-system powder can be either a pure iron powder or an iron alloy powder, or even a mixture powder of them. Alloying elements, which are included in the iron alloy powder, do not matter. As for these alloying elements, first of all, C, Mn, Si, P, S, and the like, are available. C is blended as the C-system alloy, and Si blended as the Si-system alloy, but they can be included in small amounts even in the Fe-system powder. However, when the contents of C, Si, and so forth, increase, the Fe-system powder becomes so hard that the compactibility degrades. Hence, when the Fe-system powder is an iron alloy powder, it is advisable so that C, 0.02% by mass or less, and Si: 0.1% by mass or less.

As for alloying elements other than those, Mo, Cr, Ni, V, and the like, are available. These alloying elements improve the thermal treatabilities of iron-based sintered-alloy members, and are effective elements for strengthening iron-based sintered-alloys members. These alloying elements, when the entire raw material powder is taken as 100% by mass, can suitably be included so that Mo: 0.3-2% by mass, and further 0.5-1.5% by mass, Cr: 0.3-5% by mass, and further 0.5-3.5% by mass, and Ni: 0.5-6% by mass, and further 1-4% by mass. Note that these alloying elements are not needed to be contained in the raw material powder as an iron alloy powder, but can be mixed in the raw material powder as powders, and so forth, of alloys or compounds other than Fe.

The C-system powder, in view of the compactibility and blending easiness, and the like, of the raw material powder, is such that it is advisable to employ a graphite (Gr) powder, and so forth. Its blended amount is as described above, and it is advisable that C amount in the iron-based sintered-alloy member can be adapted to 0.1-0.8% approximately.

As far as the Si-system alloy includes Si, it can be either a one-member powder or a two-or-more-member powder, and its existence form does not matter. Specifically, the Si-system powder is a powder of Si simple substance, alloy or compound. This Si-system powder can preferably be an Fe—Mn—Si powder (hereinafter this powder will be referred to as an "FMS powder" wherever appropriate), which is composed of Fe, the major component of the iron-based sintered-alloy member, and an alloy or intermetallic compound Mn and Si. This powder is such that it is possible to produce it inexpensively comparatively, or to procure it. The Fe—Mn—Si powder, when the entire Fe—Mn—Si powder is taken as 100% by mass, can preferably be such that Si is 15-75% by mass, Mn is 15-75% by mass, the sum of Si and Mn is 35-95% by mass, and the major balance is Fe. When Si and Mn are too less, it turns into an iron alloy with ductility, and it becomes difficult to pulverize it to a fine powder. Moreover, the addition amount of the FMS powder in the raw material powder becomes greater, and it has raised the costs of the iron-based sintered-alloy member. On the other hand, when Si and Mn are excessive, it is not preferable because the cost for the compositional adjustment rises. It is more preferable that Si can be 20-65% by mass, Mn can be 20-65% by mass, and the sum of Mn and Si can be 50-90% by mass.

The composition ratio of Mn to Si in the FMS powder does not matter, but it is preferable that the composition ratio (Mn/Si) can be 1/3-3, and further 1/2-2, especially, the compositional ratio can be around 1 (0.9-1.1), that is, Mn and Si in the FMS powder can be proportions of the same extent (about 1:1). In this case, blistering is likely to be suppressed. Moreover, the iron-based sintered-alloy member, which is well balanced in terms of the strength, ductility, dimensional stability, and the like, can be obtained.

The FMS powder can preferably be such that the contained O amount is 0.4% by mass or less, and further 0.3% by mass or less. It is because, when the O amount in the raw material powder becomes greater, the CO gases, and the like, which make the occurrence cause of blistering in the sintered body increases. Moreover, it is because it results in the increment of oxides in the sintered body, and it is because the mechanical characteristics of the iron-based sintered-alloy member become degradable.

The proportion of the Si-system powder, which is blended in the raw material powder, depends on the compositions of employing powders, the green density ratio, the sintering conditions, and the like. For example, when employing an FMS powder (Si is 15-75% by mass, Mn is 15-75% by mass, and the sum of Mn and Si is 35-95% by mass), it is advisable to blend it in an amount of 0.01-5% by mass, and further 0.05-3% by mass, and furthermore 0.1-2% by mass when the entire raw material powder is taken as 100% by mass.

The smaller the particle diameter of the Si-system powder is the more the green density ratio and sintered density ratio improve so that a homogenous iron-based sintered-alloy member, in which the compositional fluctuation or the segregation, and the like, are less, can be obtained. However, powders whose particle diameters are small excessively are procured with difficulty, and the costs are high. The agglomeration, and so forth, is likely to generate so that the handlability is bad. Hence, the Si-system powder is such that it is advisable to employ those whose particle diameter is 63 μm or less, and further 45 μm or less, and furthermore 25 μm or less and whose procurement is easy. For reference, it is sufficient that the particle diameter of the raw material powder (Fe-system powder of low-alloy steel powder) can be 200 μm or less, and further 180 μm or less approximately. Note that the particle diameter set forth in the present description is one which is identified by means of sieving.

(2) Compacting Step

The production process of the present invention for an iron-based sintered-alloy member mainly comprises a compacting step, and a sintering step. Here, first of all, the compacting step will be explained in detail.

The compacting step is a step in which the raw material powder, in which the above-described Fe-system powder, C-system powder and Si-system powder are mixed, are compacted to make a powder compact. In the present invention, the configuration of the powder compact, or the compacting pressure itself does not matter, but it is aimed at a high-density green compact whose green density ratio is 96% or more. It is because those whose green density ratio is small are such that blistering does not occur so much during its sintering.

The present inventors established a compacting method by which such a high-density green compact can be obtained (see Patent Literature No. 3). In accordance with this compacting method, it is possible to carry out ultra-high-pressure compaction, whose compacting pressure is at such industrial level as 1,000 MPa or more, 1,200 MPa or more, 1,500 MPa or more, and further about 2,000 MPa or more, compacting pressure which transcends beyond conventional level. The density of a powder compact, which can be obtained by means of this, can reach 96% or more, 97% or more, 98% or more, and further even up to 99%. Hereinafter, this good compacting method (hereinafter, this compacting method will be referred to as "die wall lubrication warm compaction method" wherever appropriate) will be explained.

The die wall lubrication warm compaction method (compacting step) comprises a filling step of filling said raw material powder in a die with a higher fatty acid-system lubricant applied on the inner surface, and a warm compacting step of generating a metallic soap film on the surface of the raw material powder, which contacts with the die inner surface, by warm pressurizing the raw material disposed within this die.

In accordance with this compacting method, even when making the compacting pressure lager considerably, such drawbacks that generate in general compacting methods do not generate. Specifically, the galling between the raw material powder and the inner surface of the die, the excessively enlarging ejection force, the degradation of the die longevity, and the like, can be restrained. Hereinafter, the filling step and warm compacting step of this compacting method will be explained in more detail.

(a) Filling Step

Before filling the raw material powder in a die (cavity), a higher fatty acid-system lubricant is applied on the inner surface of a die (applying step). The higher fatty acid-system lubricant employed herein, in addition to a higher fatty acid itself, can be the metallic salts of higher fatty acids as well. As the metallic salts of higher fatty acids, lithium salts, calcium salts, or zinc salts, and the like, are available. In particular, lithium stearate, calcium stearate, zinc stearate, and so forth, are preferable. In addition to these, it is possible to use barium stearate, lithium palmitate, lithium oleate, calcium palmitate, calcium oleate, and so on.

The applying step, for example, can be carried out by spraying a higher fatty acid-system lubricant, which is dispersed in water, an aqueous solution or an alcoholic solution, and the like, into a heated die. When a higher fatty acid-system lubricant is dispersed in water, and so forth, it is likely to spray the higher fatty acid-system lubricant onto the inner surface of a die uniformly. When it is sprayed into a heated die, the water content, and so on, evaporate quickly, and accordingly the higher fatty acid-system lubricant adheres onto the inner surface of the die uniformly. The heating temperature of a die is such that, although it is preferable to consider the temperature of the later-described warm compacting step, it is sufficient to heat it to 100° C. or more, for instance. However, in order to form a uniform film of a higher fatty acid-system lubricant, it is preferable to adapt the heating temperature to less than the melting point of the higher fatty acid-system lubricant. For example, when lithium stearate is used as a higher fatty acid-system lubricant, it is advisable to adapt the heating temperature to less than 220° C.

Note that, in dispersing a higher fatty acid-system lubricant in water, and the like, it is preferable that the higher fatty acid-system lubricant can be included in such a proportion as 0.1-5% by mass, and further 0.5-2% by mass, when the mass of its entire aqueous solution is taken as 100% by mass, because a uniform lubricant film is formed on the inner surface of a die.

Moreover, in dispersing a higher fatty acid-system lubricant in water, and the like, when a surfactant is added to the water, uniform dispersion of the higher fatty acid-system lubricant can be intended. As for such a surfactant, it is possible to use alkyl phenol-system surfactants, polyoxyethylene nonyl phenyl ether (EO) 6, polyoxyethylene nonyl phenol ether (EO) 10, anionic nonionic-type surfactants, boric acid ester-system emulbon T-80, and so forth, for instance. It is advisable as well to combine two or more members of these to employ. For example, when lithium stearate is used as a higher fatty acid-system lubricant, it is preferable to use three members of the surfactants, polyoxyethylene nonyl phenyl ether (EO) 6, polyoxyethylene nonyl phenol ether (EO) 10 and boric acid ester-system emulbon T-80, simultaneously. It is because, in this case, the dispersibility of lithium stearate in water, and so on, is activated all the more, compared with the case where only one member of them is added.

In order to obtain an aqueous solution of a higher fatty acid-system lubricant whose viscosity fits for spraying, it is preferable to adapt the proportion of a surfactant to 1.5-15% by volume when the volume of its entire aqueous solution is taken as 100% by volume.

In addition to this, it is advisable to add a small amount of an antifoaming agent (for example, a silicon-system antifoaming agent, and the like). It is because, if the bubbling of an aqueous solution is vigorous, a uniform film of a higher fatty acid-system lubricant is less likely to be formed on the inner surface of a die when spraying it. The addition proportion of an antifoaming agent can be 0.1-1% by volume approximately, for example, when the entire volume of its aqueous solution is taken as 100% by volume.

It is suitable that the particles of a higher fatty acid-system lubricant, which is dispersed in water, and the like, can be such that the maximum particle diameter is less than 30 μm. It is because, when the maximum particle diameter becomes 30 μm or more, the particles of a higher fatty acid-system lubricant are likely to precipitate in an aqueous solution so that it becomes difficult to apply the higher fatty acid-system lubricant onto the inner surface of a die uniformly.

For the application of an aqueous solution, in which a higher fatty acid-system lubricant is dispersed, it is possible to carry it out, using spraying guns, electrostatic guns, and the like, for coating, for instance. Note that, as a result that the present inventors examined the relationship between the applying amount of higher fatty acid-system lubricants and the ejection pressure for powder compacts, it is preferable to have a higher fatty acid-system lubricant film adhered on the inner surface of a die so that the film thickness becomes 0.5-1.5 μm approximately.

(b) Warm Compacting Step

It is believed that, when a raw material powder, which is filled in a die in which a higher fatty acid-system lubricant is applied on the inner surface, is warm compacted, a metallic soap film is formed on the surface of the raw material powder (or powder compact), which contacts with the die inner surface, so that ultra-high-pressure compacting at industrial level has become possible by the presence of this metallic soap film. This metallic soap film bonds firmly to the surface of the powder compact, and demonstrates far better lubricating performance than the higher fatty acid-system lubricant, which has been adhered on the inner surface of the die. As a result, it sharply reduces the frictional force between the contact surface of the inner surface of the die and the contact surface of the outer surface of the powder compact, and does not cause galling, and the like, despite high-pressure compacting. Moreover, it is possible to take a powder compact out of the die with a very low ejection force, and accordingly the die longevity's excessive shortening has disappeared as well.

The metallic soap film, for example, is an iron salt film of a higher fatty acid, which is formed by a mechanochemical reaction taken place between a higher fatty acid-system lubricant and Fe in a raw material powder under warm high pressure. A representative example of this is an iron stearate film, which is generated when lithium stearate or zinc stearate, a higher fatty acid-system lubricant, reacts with Fe.

"Warm," which is referred to in the present step, can be such an extent of heating state that the reaction between a raw material powder and a higher fatty acid-system lubricant is facilitated. Roughly speaking, it is advisable to adapt the compacting temperature to 100° C. or more. However, from the viewpoint of preventing the degenerative change of a higher fatty acid-system lubricant, it is advisable to adapt the compacting temperature to 200° C. or less. It is more suitable to adapt the compacting temperature to 120-180° C.

"Pressurizing," which is referred to in the present step, can be determined appropriately within a range where a metallic soap film is formed while considering the specifications of the iron-based sintered-alloy member. Considering the die longevity and the productivity, it is preferable to adapt the upper limit of the compacting pressure to 2,000 MPa. When the compacting pressure becomes 1,500 MPa approximately, the density of the obtained powder compact, too, approaches the true density (becomes 98-99% by green density ratio), and no further high-densification can be desired even when pressurizing it to 2,000 MPa or more.

Note that, when using this die wall lubrication warm compaction method, it is not necessary to employ an internal lubricant, and a powder compact with much higher density can be obtained. Moreover, when the powder compact is sintered, there is no such case that the inside of a furnace is polluted accompanied by the decomposition, emission, and the like, of an internal lubricant. However, it should be notified that, in the present invention, the employment of an internal lubricant is not excluded.

(3) Sintering Step

The sintering step is a step in which a powder compact obtained in the compacting step is sintered by heating it in an oxidation preventive atmosphere.

The sintering temperature and sintering time are selected appropriately, considering the desired characteristics, productivity, and the like, of the iron-based sintered-alloy member. The higher the sintering temperature is in a shorter period of time the high-strength iron-based sintered-alloy member can be obtained. However, when the sintering temperature is too high, liquid phases arise, or dimensional contraction becomes large so that it is not preferable. When the sintering temperature is too low, the diffusion of alloying elements is insufficient so that it is not preferable. Moreover, the sintering time becomes long, and accordingly the productivity of the iron-based sintered-alloy member degrades. The sintering temperature can be 900-1,400° C., and further 1,100-1,350° C. In particular, when obtaining the high-strength iron-based sintered-alloy member, the sintering temperature can be adapted to 1,200° C. or more. Moreover, the sintering time can be adapted to 0.1-3 hours, and further 0.1-1 hour, while considering the sintering temperature, the specifications, productivity and costs of the iron-based sintered-alloy member, and so forth.

Here, on Si and Mn, which are effective elements for the sintering atmosphere and the blistering restraint of high-strength sintered bodies, explanations are made. First of all, Si, in addition to C, Mn, phosphorus (P) and sulfur (S), is referred to as the five elements of steels, and are general strengthening elements in melt produced iron/steel materials. However, Si in the Si-system powder is such that the affinity to oxygen is high extremely so that it is an element, which is very likely to be oxidized. When employing an FMS powder as the Si-system powder, an Fe—Mn—Si alloy (compound) is such that the oxide-formation free energy is lower than that of Si simple substance so that there is a fear that it reacts even with scant O within a heating furnace to form the oxides of Si inside the sintered body. The intervention of such oxides is not preferable, because it deteriorates the mechanical properties of the iron-based sintered-alloy member. Hence, an iron-based sintered alloy, which contains Si, has been hardly available so far.

In the production process of the present invention, it is adapted so that, in order to restrain the deterioration of the iron-based sintered-alloy member which results from the Si containment, the sintering step is carried out in an oxidation preventive atmosphere. Specifically, a vacuum atmosphere, an inert gas atmosphere, a nitrogen atmosphere, and the like, are available. Even if it is such an atmosphere, when residual oxygen (oxygen partial pressure) therein matters, it is advisable to employ a reducing atmosphere in which a hydrogen gas (purified high-purity hydrogen gas whose dew point is low) is mixed with a nitrogen gas in an amount of a few %. However, since the employment of a hydrogen gas is not preferable so much industrially, it is more preferable to carry out the sintering step of the present invention within an ultra-low-oxygen-partial-pressure inert gas atmosphere whose oxygen partial pressure is equivalent to $10^{-19}$ Pa or less (100 ppm or less by CO concentration). A continuous sintering furnace, which realizes such an ultra-low-oxygen-partial-pressure inert gas ($N_2$ gas) atmosphere, is commercially available (OXYNON furnace produced by KANTO YAKIN KOGYO Co., LTD.).

In such an ultra-low-oxygen-partial-pressure inert gas atmosphere, even when an Si-system powder reacts with O, which has adhered, and the like, on a raw material powder so that composite oxides, and so forth, are formed, they are decomposed further; and accordingly the iron-based sintered-alloy member with a healthy structure, which is free from intervening substances, such as oxides, can be obtained, and its deterioration can be suppressed.

(4) Others

The iron-based sintered-alloy member, depending on its specifications, can be further subjected to heat treatment steps, such as annealing, normalizing, aging, refining (hardening, and tempering), carburizing and nitriding. Of course, the iron-based sintered-alloy member can preferably be such a composition (C, Mo, Cr, and the like) that depends on the type of heat treatments.

The form of and intended use for the iron-based sintered-alloy member of the present invention do not matter. When naming an example of the intended uses for the iron-based sintered-alloy member, in the automotive filed, there are various pulleys, synchronizer hubs for transmissions, connecting rods for engines, sprockets, ring gears, pinion gears, and the like. In addition to them, there are a variety of gear component parts, such as sun gears, driving gears and driven gears, and so forth.

II. Examples

Examples of the First Invention

The present invention will be explained more specifically while naming examples.

A: First Example-Fifth Example

Production of Samples (1) As an Fe-system alloy, a pure iron powder (ASC100.29 produced by HEGANESE Co., Ltd., and Particle Diameters: 20-180 μm) was prepared, and, as a strengthening powder, an Fe—Mn—Si powders (FMS powders) were prepared.

The FMS powders were those which were made by pulverizing cast bulks (ingots) with various compositions set forth in Table 6, which were melt produced in an Ar gas atmosphere, and sieving them to a powder, whose particle diameters were 25 μm or less (500 mesh). Hereinafter, the compositions of the FMS powders will be identified by specifying the numbers (I-IX) in Table 6. Moreover, as strengthening powders, an Fe-75.6% Mn powder (produced by FUKUDA KINZOKU HAKUFUN Co., Ltd.), an Mn-system powder, and an Fe-76.4% Si powder (produced by FUKUDA KINZOKU HAKUFUN Co., Ltd.), an Si-system powder, were prepared as well. The particle size of these powders was such that both of them were −250 mesh (63 μm or less). The units of the compositions are % by mass (being the same hereinafter unless otherwise specified) particularly.

A graphite (Gr) powder (JCPB produced by NIHON KOKUEN Co., Ltd.), a C-system powder, was prepared as well. The particle diameters of this powder were 45 μm or less. Further, in order to produce a comparative material, Fe-10% Cu partially-diffused alloy powder (DistaloyACu produced by HEGANESE Co., Ltd., and Particle Diameters: 20-180 μm) was prepared.

These various powders were blended so as to make a desired composition, and a raw material powder, which was composed of a uniform mixture powder for each of samples, was prepared by carrying out ball mill-type rotary admixing sufficiently.

(2) Powder compacts were carried out by means of the die wall lubrication warm compaction method mainly. Specifically, they are as hereinafter described. Two types of dies made of cemented carbide, which had a ϕ23 mm cylinder-shaped cavity and a 10×55 mm transverse test piece-shaped cavity, were prepared. To the inner peripheral surface of the respective dies, a TiN-coat treatment was performed in advance so that its surface roughness was adapted to 0.4Z. The respective dies were heated to 150° C. with a band heater in advance. Onto the inner peripheral surface of the heated dies, an aqueous solution, in which lithium stearate (LiSt), a higher fatty acid-system lubricant, was dispersed, was sprayed uniformly by a spraying gun in a proportion of 1 $cm^3$/second approximately (applying step). Thus, on the inner peripheral surface of the respective dies, an LiSt film was formed to such an extent as about 1 μm.

The aqueous solution used herein is one in which LiSt was dispersed in one in which a surfactant and an antifoaming agent were added to water. For the surfactant, polyoxyethylene nonyl phenyl ether (EO) 6, polyoxyethylene nonyl phenyl ether (EO) 10, and boric acid ester emulbon T-80 were used, each of them was added in an amount of 1% by volume, respectively, with respect to the entire aqueous solution (100% by volume). For the antifoaming agent, FS antifoam 80 was used, and was added in an amount of 0.2% by volume with respect to the entire aqueous solution (100% by volume). For LiSt, one whose melting point was about 225° C. and average particle diameter was 20 μm was used. Its dispersion amount was adapted to 25 g with respect to the aforementioned 100 $cm^3$ aqueous solution. The aqueous solution, in which LiSt was dispersed, was further subjected to a micro-fining treatment (Teflon-coated steel balls: 100 hours) with a ball mill-type pulverizing apparatus. The thus obtained stock solution was diluted by 20 times, and an aqueous solution, whose final concentration was 1%, was used for the aforementioned applying step.

Into the cavities of the respective dies, in which the uniform film of LiSt was formed on the inner surface, the above-described various raw material powders were filled naturally (filling step). The raw material powders were heated to 150° C., the same temperature as that of the dies, with a drier in advance.

The respective raw material powders, which were filled in the dies, were formed with various forming pressures, thereby obtaining powder compacts (warm compacting step). Even in any case of all the compacting pressures, it was possible to take the powder compacts out of the dies with low ejection forces, without causing any galling, and the like, on the inner surface of the dies.

Note that part of the samples employed mixture powders, which were made by adding LiSt, an internal lubricant, in an amount of 0.8%, and admixing it, as the raw material powders. To these, ordinary room-temperature forming was performed, thereby obtaining powder compacts (see Table 5). The admixing of the pure iron powder, and the like, with LiSt (powdery) was carried out with a V-shaped mixer or a rotary ball mill. Moreover, when adopting a forming method other than the die lubrication warm press forming method, the compacting pressure was adapted to 4 stages, 392 MPa, 490 MPa, 588 MPa and 686 MPa, in order to prevent the dies' damages.

(3) The obtained respective powder compacts were sintered in a 1,150° C. or 1,250° C. nitrogen gas atmosphere, respectively, (sintering step), using a continuous sintering furnace (OXYNON furnace produced by KANTO YAKIN KOGYO Co., Ltd.). The soaking holding time was adapted to 30 minutes, and the after-sintering cooling rate was 40° C./min. (0.67° C./sec.). Note that the inside of the sintering furnace was adapted to an ultra-low-oxygen-partial-pressure atmosphere of 50-100 ppm by CO concentration (equivalent to $10^{-19}$-$10^{-21}$ Pa by conversion into oxygen partial pressure). Thus, ϕ23 mm cylinder-shaped samples and 10×55 mm transverse test piece-shaped samples, which were composed of a variety of iron-based sintered alloys, were obtained.

Measurements of Examples (1) Using the aforementioned cylinder-shaped samples, the green densities, sintered densities and dimensional changes (outside-diameter changes) were found by calculation from their before/after weights and dimension.

(2) Using the aforementioned transverse test piece-shaped samples, a transverse test was carried out by means of three-point bending with 40 mm-distance between fulcrums. Thus, the strength (transverse rupture strength) and deflection up to rupture of the respective samples were found. Moreover, the hardness of the transverse test piece-shaped samples' side surface was measured at 30 kg load by means of a Vickers hardness meter.

Details and Evaluations of Examples (1) First Example

Sample Nos. E1-E14, and Sample Nos. E00-E03

Using the raw material powders with a variety of compositions in which the above-described pure iron powder and strengthening powders, composed of the Fe-76.5% Mn powder and Fe-76.4% Si powder, were mixed with the graphite powder, powder compacts were compacted by means of the die wall lubrication warm compaction method, and the powder compacts were sintered, thereby obtaining Sample Nos. E1-14. The respective characteristics of the obtained powder compacts and sintered bodies (Fe—Mn—Si—C-system iron-based sintered alloys) are set forth in Table 1A and Table 1B along with the respective blended compositions. The characteristics (densities) of the powder compacts in the tables are such that those of the powder compacts sintered at 1,150° C. are set forth representatively (being the same hereinafter). The characteristics of the powder compacts sintered at 1,250° C. agree with those of the powder compacts sintered at 1,150° C. substantially, and accordingly there was no practical difference between both of them, thus the characteristics of the powder compacts were stabilized very well.

Note that Sample No. E00 is the case of an Fe—C-system sintered alloy without the strengthening powder; and Sample Nos. E01-03 are the case of Fe—Cu—C-system iron-based sintered alloys employing the above-described Fe-10% Cu powder instead of the strengthening powder.

Sample Nos. E1-E5, while keeping the Mn+Si amount constant at 2%, are those in which the proportion (compositional ratio) was changed variously. Sample Nos. E2-4 in which the Mn/Si falls in 3-1/3 were confirmed that, in all of them, strengths equal to or more than can be obtained, with respect to Sample No. E02 (the C amount is 0.6% as much as that of Sample No. E2, and the like, identically; and the Cu amount is 2% as much as the Mn+Si amount of them identically).

On the other hand, when containing only one of Mn and Si like Sample No. E1 and Sample No. E5, their strengths stayed within the same extent as that of Sample No. E02. When being Mn alone like Sample No. E0, the dimensional variation increased toward the positive side. On the other hand, when including Si like Sample Nos. E2-E5, their dimensional changes were small, and accordingly it was understood that they were good in terms of the dimensional stability as well. In particular, when the Si amount is 1% approximately like Sample No. E3, its dimensional change was zero substantially.

Sample Nos. E6-E14 are those in which the Mn/Si was constant at Mn/Si=1; and the Mn+Si amount and C amount were changed. Let us fix the C amount to observe them, it is understood that, when the Mn+Si amount is 2% like Sample Nos. E9-E11, the strength of the sintered bodies becomes the highest in all of them. Moreover, when comparing Sample Nos. E9-11 with Sample Nos. E01-03, it was understood as well that, as far as the C amount is the same, a much-higher-strength sintered body can be obtained when including Mn and Si than including Cu.

Further, the sintered bodies, which were strengthened by Mn and Si, were such that the deflection amount is improved more drastically than that of the sintered body, which was strengthened by Cu, and accordingly it was understood that they exhibit very good ductility. Moreover, as it is understood by comparing Sample Nos. E6-8 with Sample Nos. E01-03, it became apparent that, when the C amount is the same, a sintered body, which is of much higher strength and high ductility, can be obtained by the employment of less Mn+Sn than Cu. Note that all of the above-described tendencies were identical even when the sintering temperature was either 1,150° C. or 1,250° C.

(2) Second Example

Sample Nos. E17-E27

Using the raw material powders with a variety of compositions in which the above-described pure iron powder and FMS powders (#I, #II, #III) were mixed with the graphite powder, powder compacts were compacted by means of the die wall lubrication warm compaction method, and the powder compacts were sintered, thereby obtaining Sample Nos. E17-E27. The respective characteristics of the obtained powder compacts and sintered bodies (Fe—Mn—Si—C-system iron-based sintered alloys) are set forth in Table 2A and Table 2B along with the respective blended compositions. Note that the FMS powders used herein were those in which the Mn+Si amount was kept constant at 66% (entire powder: 100%) and the Mn/Si was changed in a range of 2-1/2.

When comparing Sample Nos. E18-E20, in which the blended amount of the FMS powders was constant at 2% and the C amount differed respectively, with Sample Nos. E6-E8 or Sample Nos. E9-E11, in which the Mn+Si amount fell in ranges equal to theirs, Sample Nos. E18-E20 were better in terms of both of the strength and ductility. That is, it was understood that a sintered body, which is better in terms of the mechanical characteristics, can be obtained, by blending the strengthening powder as an Fe—Mn—Si powder rather than by blending it as an Fe—Mn powder or an Fe—Si-system powder. This tendency was identical even when the sintering temperature was either 1,150° C. or 1,250° C.

Let us compare Sample Nos. E17, E19 and E17 with Sample Nos. E21-E26, samples whose C amount was identical, in the case of employing the #1 FMS powder, the strength increased along with the increment of the FMS powder amount, regardless of the sintering temperatures. In the case of employing the #II FMS powder, upon the sintering temperature being 1,150° C., the strength of the sintered body became the greatest when the FMS powder was 2%; and, upon the sintering temperature being 1,250° C., the strength became the greatest when the FMS powder was 3%. In the case of employing the #III FMS powder, the strength of the sintered body became the greatest when the FMS powder was 2%, regardless of the sintering temperatures.

Sample Nos. E17-E27 were such that, in all of them, the dimensions were stabilized. In particular, as it is understood by comparing them with Sample Nos. E01-E03, the Fe—Cu—C-system sintered bodies, and with Sample No. E1, the Fe—Mn—C-system sintered body, the dimensional changes with respect to the change of the C amount and the change of the compacting pressure were very small, and accordingly they showed good dimensional stability. Although the dimensions of the sintered bodies tend to increase (that is, expand) as the increment of the FMS powder amount, it is understood from Sample Nos. E21-23 that, when employing the #II FMS powder, the dimensional change was hardly influenced by the FMS powder amount and was stabilized very well. Therefore, when employing an FMS powder in which Mn/Si=1/2 approximately (Mn/Si=0.3-0.7) in an appropriate amount, it seems especially preferable from the viewpoint of dimensional stability. Note that all of the above-described tendencies were identical even when the sintering temperature was either 1,150° C. or 1,250° C.

(3) Third Example

Sample Nos. E46-E60

Using the raw material powders with a variety of compositions in which the above-described pure iron powder and FMS powders (#V, #VI, #VII) were mixed with the graphite powder, powder compacts were compacted by means of the die wall lubrication warm compaction method, and the powder compacts were sintered, thereby obtaining Sample Nos. E46-E60. The respective characteristics of the obtained powder compacts and sintered bodies (Fe—Mn—Si—C-system iron-based sintered alloys) are set forth in Table 3A and Table 3B along with the respective blended compositions. Note that the FMS powders, in which the Mn+Si amount was kept constant at 80% (entire powder: 100%) and the Mn/Si was 3-1, were employed, and the C amount was kept constant at 0.6%. The Si amount of the #VI FMS powder became 33%, because the composition simply deviated more or less out of the targeted 30%, and the fact itself does not involve any special intention at all.

As can be understood from Sample Nos. E46-E50, in the case of employing the #V FMS powder, the strength became the greatest when the FMS powder was 2% (Sample No. E48). As can be understood from Sample Nos. E51-E55, in the case of employing the #VI FMS powder, the strength became the greatest when the FMS powder was 2.5% (Sample No. E54). As can be understood from Sample Nos. E56-E60, in the case of employing the #VII FMS powder, the strength became the greatest when the FMS powder was 3% (Sample No. E60).

Even when employing any one of the FMS powders, the more its amount increased, the harder the hardness of the sintered bodies became. On the contrary, even when employing any one of the FMS powders, the more its amount increased, the more the deflection (ductility) degraded. Moreover, even when employing any one of the FMS powders, the more its amount increased, the more the dimensional variation increased. Note that, although all of the above-described tendencies were identical even when the sintering temperature was either 1,150° C. or 1,250° C., all of the characteristics, the strength, ductility and dimensional stability, were better when the sintering temperature was the higher temperature (1,250° C.) than the other.

Figure 2:
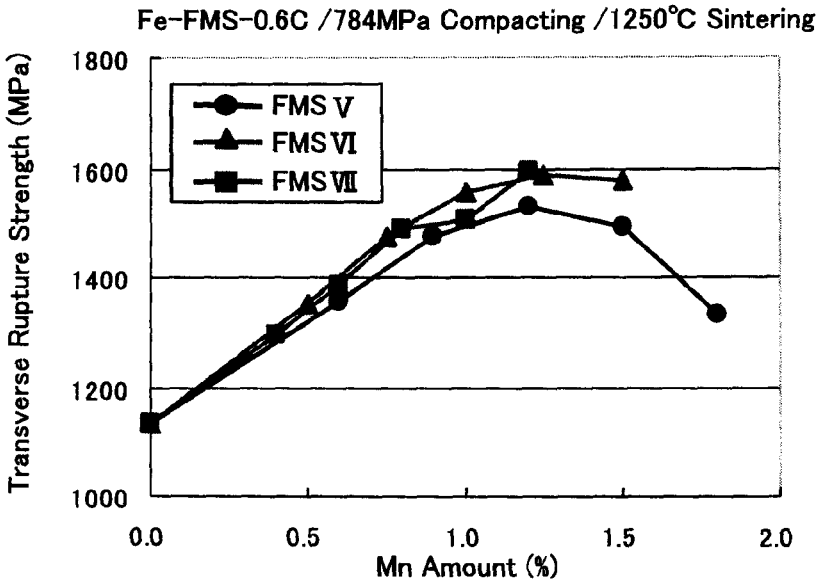
FIG. 2 is a graph for illustrating the relationships between the Mn amount and transverse rupture strength of a 1,250° C.-sintered body.
Figure 3:
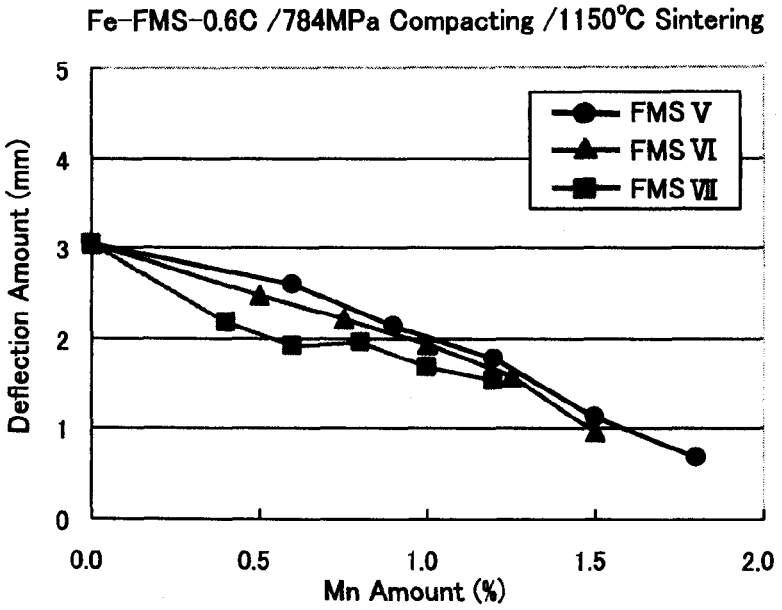
FIG. 3 is a graph for illustrating the relationships between the Mn amount and deflection magnitude of a 1,150° C.-sintered body.
Figure 4:
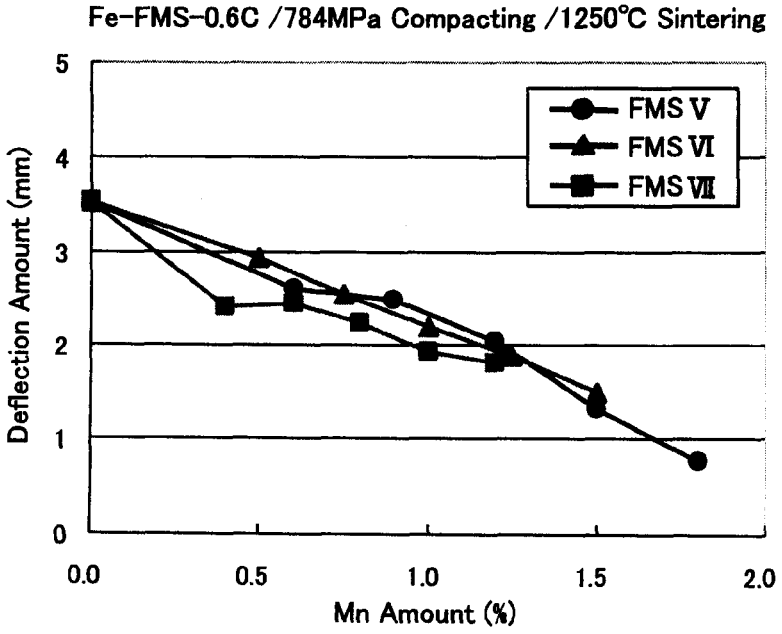
FIG. 4 is a graph for illustrating the relationships between the Mn amount and deflection magnitude of a 1,250° C.-sintered body.
Figure 5:
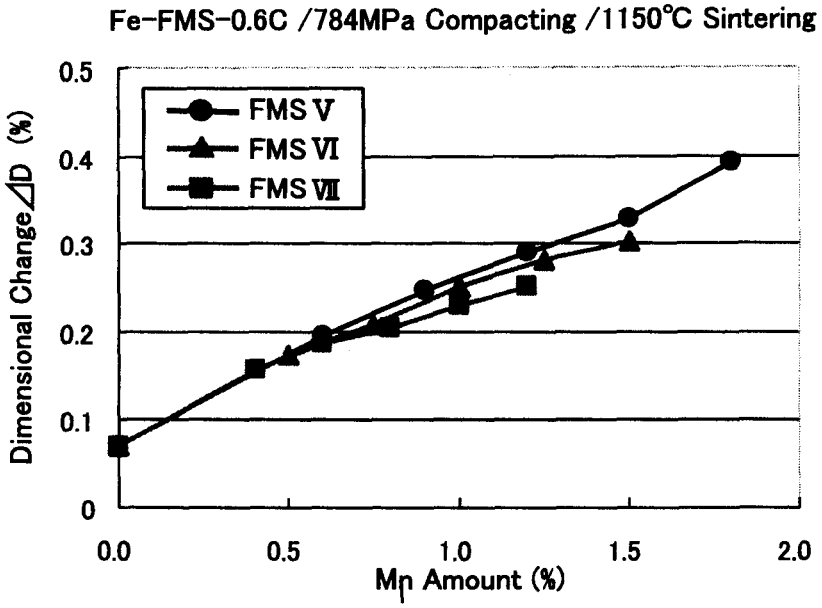
FIG. 5 is a graph for illustrating the relationships between the Mn amount and dimensional change of a 1,150° C.-sintered body.
Figure 6:
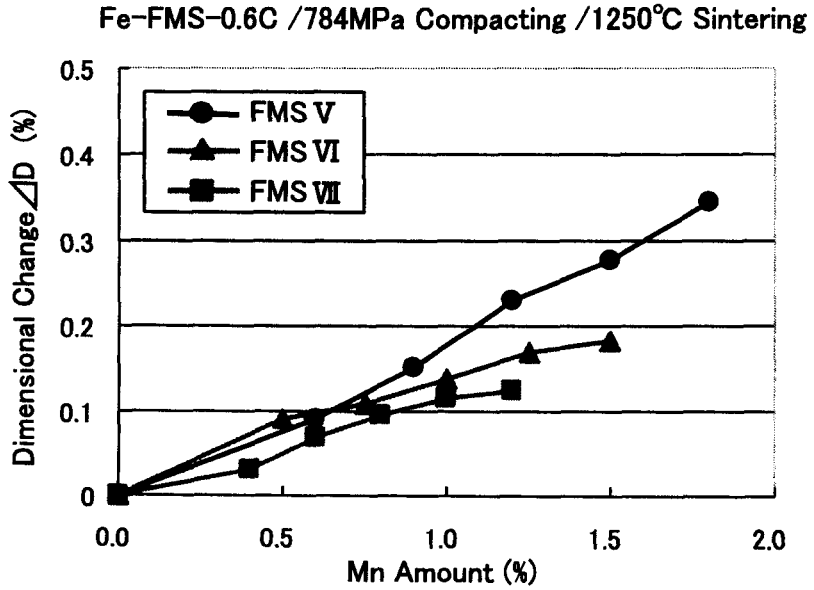
FIG. 6 is a graph for illustrating the relationships between the Mn amount and dimensional change of a 1,250° C.-sintered body.

Those, in which the above results are reorganized regarding the Mn amount for every sintering temperature, are illustrated in FIG. 1-FIG. 6. FIG. 1 and FIG. 2 illustrate the relationships between the Mn amount and the transverse rupture strength, FIG. 3 and FIG. 4 illustrate the relationships between the Mn amount and the deflection amount, and FIG. 5 and FIG. 6 illustrate the relationships between the Mn content and the before/after-sintering dimensional change.

When observing them in view of the blended amount of the FMS powders, although a plurality of the blended amounts, at which the transverse rupture strength became maximum, existed, the tendency that the transverse rupture strength showed the maximum value when the Mn amount was at around 1.2% became apparent in all of them, as can be seen from FIG. 1 and FIG. 2. On the other hand, the deflection amount and dimensional change decreased substantially monotonously, accompanied by the increment of the FMS powder amount. From these results, when the entire sintered body (iron-based sintered alloy) is taken as 100%, it is preferable to adapt the upper limit of the Mn amount to 1.5% or less, 1.4%, 1.3%, and further 1.2%. On the other hand, it is advisable to adapt the upper limit of the Si amount to 2.0%, and further 1.5%.

(4) Fourth Example

Sample Nos. E31, E44, and E45

The influences, which the FMS powder's particle diameter and sintering temperature exerted to the sintered body's characteristics, were investigated in the following manner.

First of all, those, which were made by mechanically pulverizing the #VI FMS powder to −250 mesh (particle diameter: 63 μm or less), −350 mesh (particle diameter: 45 μm or less) and −500 mesh (particle diameter: 25 μm or less), respectively, were prepared. The sorting was carried out by means of sieving.

For reference, since Fe—Mn—Si-system cast bulks (FMS cast bulks) are brittle, it is possible to obtain FMS powders easily by mechanically pulverizing them. However, an FMS cast bulk with the #IV composition (one in which the Mn and Si amounts are less and whose ductility is high comparatively) was such that it was not easy to adapt it to a fine powder of −250 mesh (−63 μm or less) by mechanical pulverizing alone.

Next, the respective FMS powders having the aforementioned three types of particle diameters were mixed with the above-described pure iron powder and graphite powder, thereby preparing raw material powders with Fe-2FMSVI-0.6C composition. The respective raw material powders were compacted into powder compacts by means of the die lubrication warm compaction method, and Sample Nos. E31, E44 and E45 were obtained by sintering the powder compacts. The respective characteristics of the obtained powder compacts and sintered bodies (Fe—Mn—Si—C-system iron-based sintered alloy) are set forth in Table 4.

Although the more the FMS powder with a smaller particle diameter was used the more the strength of the sintered bodies improved, the influence, which the particle size of the FMS powder gave to the hardness, deflection amount and dimensional change of the sintered bodies, was small.

On the other hand, even when employing the FMS powder with any one of the particle sizes, the higher the sintering temperature became, the more the strength, hardness and ductility (deflection) improved all together. It was understood as well that, when being a sintered body using an FMS powder whose particle size is −250 mesh approximately, it surpasses the strength of the Fe—Cu—C-system sintered body (Sample No. E02), a comparative material, sufficiently. Of course, when employing a much finer FMS powder, a sintered body, which was of higher strength than conventional sintered alloys were, could be obtained.

(5) Fifth Example

Powder compacts were compacted by means of a compacting method (general compacting method), which differed from the die wall lubrication warm compaction method which made high-density forming possible, and the powder compacts were sintered. The respective characteristics of the thus obtained powder compacts and sintered bodies of Sample Nos. E41, E42 and E04 are set forth in Table 5 along with the respective blended compositions.

Sample Nos. E41 and E42 are those which were made by adding 0.1% and 0.8% internal lubricants (LiSt), respectively, to a raw material powder with Fe-2FMSVI-0.8C composition, which employed the #VI FMS powder (−250 mesh powder), and compacting and sintering them. Although Sample No. E41 included the 0.1% internal lubricant, it is one which was formed under the same forming conditions as the above-described die wall lubrication warm compaction method; and Sample No. E42 is one which was compacted by means of a room-temperature compaction method without die wall lubrication.

Sample No. E04 is one which was made by adding the 0.8% internal lubricant (LiSt) to a raw material powder with Fe-2Cu-0.8C composition, room-temperature compacting them (same as Sample No. E42), and sintering them. The sintering step, in conjunction with the general sintering conditions for Fe—Cu—C-system sintered bodies, was carried out in an $N_2$-5% $H_2$ atmosphere for 1,140° C.×20 minutes in all of them. The cooling rate for the after-sintering samples was about 40° C./min.

Even when compacting them by means of the general compacting method other than the die wall lubrication warm compaction method; and, moreover, even when sintering them in the $N_2$-5% $H_2$ atmosphere which is no ultra-low-oxygen-partial-pressure nitrogen gas atmosphere, it became apparent that the Fe—Mn—Si-system sintered bodies (Sample Nos. E41 and E42) using the FMS powder show strength and ductility equal to or more than those of the conventional Fe—Cu—C-system sintered bodies (Sample No. E04).

Figure 7:
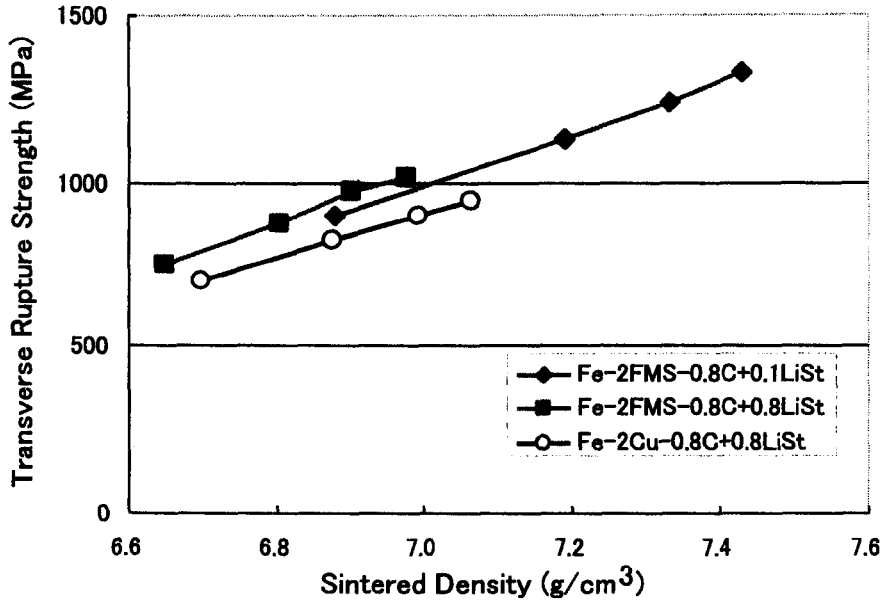
FIG. 7 is a graph for illustrating the relationships between sintered density and transverse rupture strength.
Figure 8:
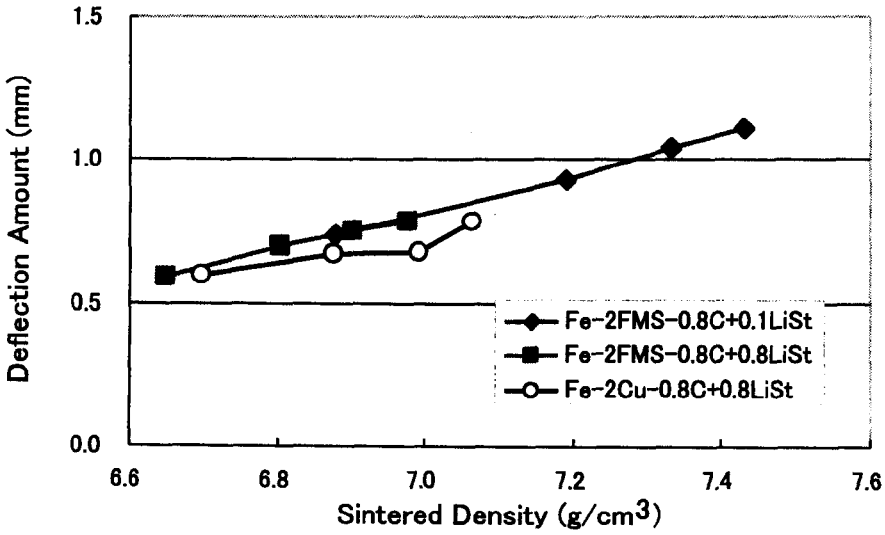
FIG. 8 is a graph for illustrating the relationships between sintered density and deflection magnitude.
Figure 9:
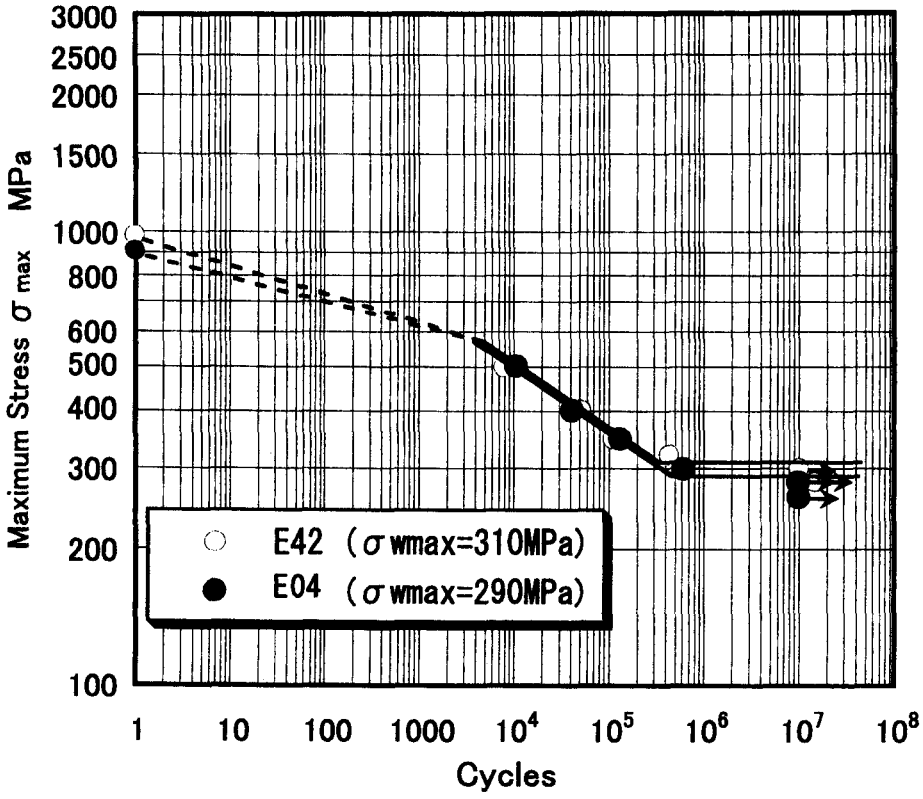
FIG. 9 is a graph for illustrating the results of a three-point bending fatigue test.

The results of reorganizing these results regarding the sintered density are illustrated in FIG. 7 and FIG. 8. FIG. 7 illustrates the relationships between the sintered density and the transverse rupture strength, and FIG. 8 illustrates the relationships between the sintered density and the deflection amount. It was confirmed that both of the transverse rupture strength and deflection magnitude increase substantially monotonously, accompanied by the increment of the FMS powder amount, (are in proportion thereto). Further, the results of carrying out a three-point bending fatigue test with regard to the sintered bodies of Sample No. E42 and Sample No. E04 are shown in FIG. 9. Thus, it was confirmed that the sintered body according to the present invention has fatigue resistance equal to or more than that of the conventional sintered body.

B: Sixth Example-Eighth Example

Production of Samples (1) Iron alloy powders (AstaloyCrM, produced by HEGANESE Co., Ltd., Particle Diameters: 20-180 μm, and AstaloyMo, produced by HEGANESE Co., Ltd., Particle Diameters: 20-180 μm), Fe-system powders, the above-described pure iron powder (ASC100.29 produced by HEGANESE Co., Ltd.), the above-described FMS powders, strengthening powders, and the above-described Gr powder, a C-system powder, were prepared. The composition of AstaloyCrM, an iron alloy powder, is Fe-3Cr-0.5Mo (% by mass), and the composition of AstaloyMo is Fe-1.5Mo (% by mass). The FMS powders employed the above-described #VI, #VII and #VIII powders in Table 6. The production method, classification, particle diameters, and the like, of the FMS powders are the same as described above.

These various powders were blended so as to make a desired composition, and a raw material powder, which was composed of a uniform mixture powder for each of samples, was prepared by carrying out ball mill-type rotary admixing sufficiently.

Figure 10:
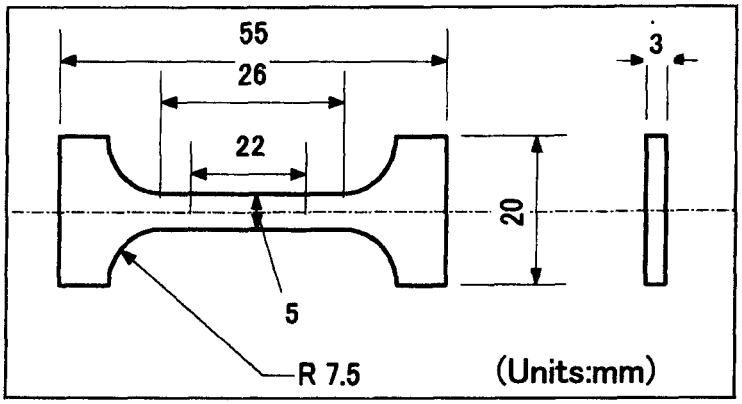
FIG. 10 is a diagram for illustrating the configuration of a tensile test piece.

(2) Powder compacts were produced by means of the above-described die wall lubrication warm compaction method. Various conditions, and the like, were identical basically. However, the configuration of the powder compacts was adapted to a ϕ23 mm-cylinder shape and a tensile-test-piece-shaped configuration illustrated in FIG. 10. Two types of dies, which had cavities corresponding to these configurations, were prepared, and the die wall lubrication warm compaction method was carried out.

(3) The obtained respective powder compacts were sintered in a 1,150° C., 1,250° C. or 1,350° C. nitrogen gas atmosphere, respectively, (sintering step), using a continuous sintering furnace (OXYNON furnace produced by KANTO YAKIN KOGYO Co., Ltd.). The soaking holding time (a time for the heating step), after-sintering cooling rate (a rate of the cooling step), and the atmosphere within the sintering furnace were adapted to being identical with the above-described case.

However, the obtained samples, as described above, are the ϕ23 mm cylinder-shaped samples, and the tensile-test-piece-shaped samples. And, regarding the tensile-test-piece-shaped samples, 200° C.×60 minutes heating was carried out within an atmosphere in air (tempering step).

Measurements of Examples (1) Using the aforementioned cylinder-shaped samples, the green densities, sintered densities and dimensional changes were found by calculation from their before/after weights and dimension.

(2) Using the aforementioned tensile-test-piece-shaped samples, a tensile test was carried out while adapting the distance between gages to 22 mm and adapting the tensile speed by means of an Instron testing machine to 0.5 m/min. The hardness was such that the chucking portion of the tensile-test-piece-shaped samples was measured at 30 kg load by means of a Vickers hardness meter.

Details and Evaluations of Examples (1) Sixth Example

Sample Nos. E137-E144

Using the raw material powders, in which the Gr powder was blended in and mixed with above-described AstaloyCrM in a proportion of 0.5% by mass and the respective FMS powders were blended therein and mixed therewith in a proportion of 1% by mass, a variety of powder compacts were compacted. These powder compacts were sintered at 1,250° C. to make sintered bodies (Fe—Cr—Mo—Mn—Si—C-system iron-based sintered alloys), thereby obtaining Sample Nos. E137-E144. The respective characteristics of the obtained powder compacts and sintered bodies are set forth in Table 7 along with the respective blended compositions. For reference, #VI, #VII and #VIII of the FMS powders were those in which the Mn/Si ratio was changed to 1.5, 1, and 0.6, respectively.

Figure 11:
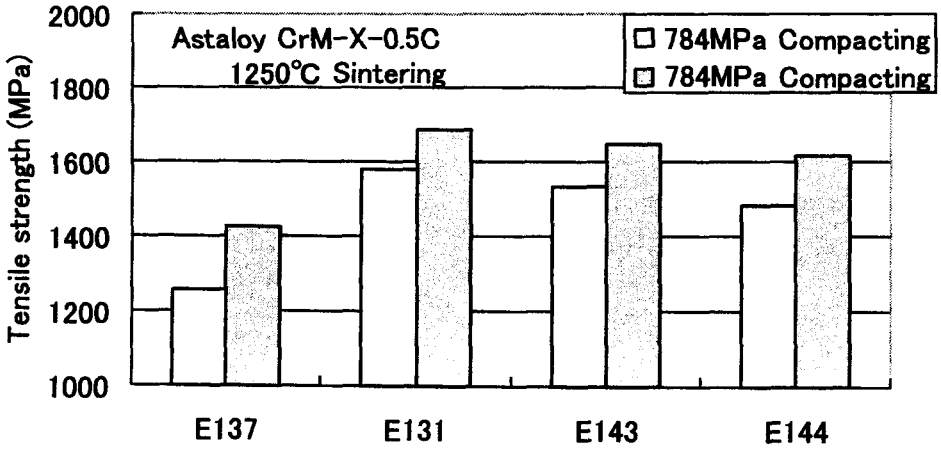
FIG. 11 is a diagram for illustrating the relationships between tensile strength and FMS-powder composition.
Figure 12:
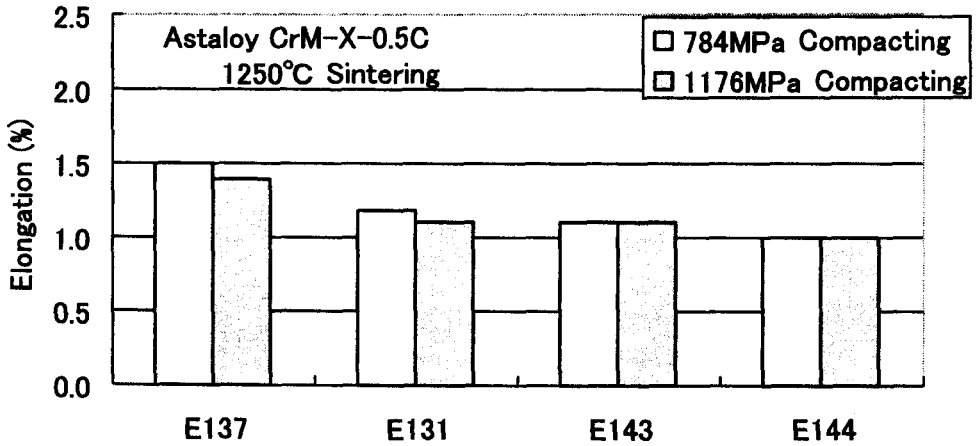
FIG. 12 is a diagram for illustrating the relationships between elongation and FMS-powder composition.

Based on the data set forth in Table 7, the influences to the tensile strength (MPa) and elongation (%), influences which resulted from the compositional differences in the FMS powders, are illustrated in FIG. 11 and FIG. 12. Following are understood from FIG. 11 and FIG. 12.

The samples (E131, E143 and E144) employing the FMS powders were such that the tensile strength improved more by 200-300 Mpa approximately than that of the sample (E137) without employing any FMS powder. In particular, even when the compacting pressure was 784 MPa, the samples employing the FMS powders showed a tensile strength of 1,500 MPa or more roughly. Of course, the samples which were made by adapting the compacting pressure to 1,176 MPa showed much higher tensile strength that was well over 1,600 Mpa. Therefore, it was understood as well that the high-strengthening of iron-based sintered alloys by means of the FMS powders is such that the types of the FMS powders and the magnitude of their compacting pressures do not matter. In addition thereto, in the case of the present example, the ultra-high-strength iron-based sintered alloys could be obtained at an ordinary cooling rate without ever carrying out forcible cooling in the cooling step of the sintering step. Moreover, the dimensional changes of the present example's sintered bodies were equal to or less than those of Sample No. E137 making their base. Therefore, the respective iron-based sintered alloys according to the present examples using the FMS powders were such that all of them were of ultra-high strength and additionally the dimensional changes were small, and were those which allowed to intend the reduction of production costs.

(2) Seventh Example

Using the above-described pure iron powder or iron alloy powder, 0.5%-by-mass Gr powder and 1%-by-mass FMS powder (#VI), a variety of samples set forth in Table 8 were produced. The compacting pressure for powder compacts was adapted to 784 MPa or 1,176 MPa; and the sintering temperature for powder compacts was adapted to 1,250° C. Using the thus obtained respective samples, the changes of the C amount before and after sintering were measured between the samples, in which the FMS powder was mixed in the raw material powder, and the samples, which were otherwise. The characteristics of the respective samples are set forth in Table 8 along with their compositions and compacting pressures. Note that the C amount was found by means of a combustion-infrared absorption method.

From Table 8, in the samples without employing the FMS powder, it was understood that, regardless of their compositions, 6-14% of the blended C amount (Gr amount) decreased. In particular, the decrement magnitude of the C amount was greater when the compacting pressure was 784 MPa than when the compacting pressure was 1,176 MPa. On the other hand, in the samples employing the FMS powder, the decrement magnitude of the C amount was as slight as 2-6%. In particular, when compacting them by such a high pressure as 1,176 MPa, the decrement magnitude of the C amount was as small as 2-4%.

By thus employing the FMS powder, it was understood that the C amount, which decreases by means of sintering, becomes extremely less so that most of the blended C amount resides in iron-based sintered alloys. In addition thereto, it became apparent as well that the more a sample is composed of a powder compact compacted by a higher compacting pressure the less the reducing C amount is so that the residual C amount becomes greater. Therefore, by employing an FMS powder, it is unnecessary to blend a Gr powder excessively in advance while taking a reducing proportion of the C amount into account, or it is possible to intend the reduction of such an excessive proportion. Therefore, the yield ratio of an employing Gr powder improves so that the reduction of iron-based sintered alloys' raw material costs can be intended. Further, it becomes easy to obtain the iron-based sintered alloys with desired compositions; even when mass producing them, high-quality iron-based sintered alloys whose strength or dimensions, and the like, are stabilized can be obtained, and accordingly their quality control becomes easy.

Figure 13:
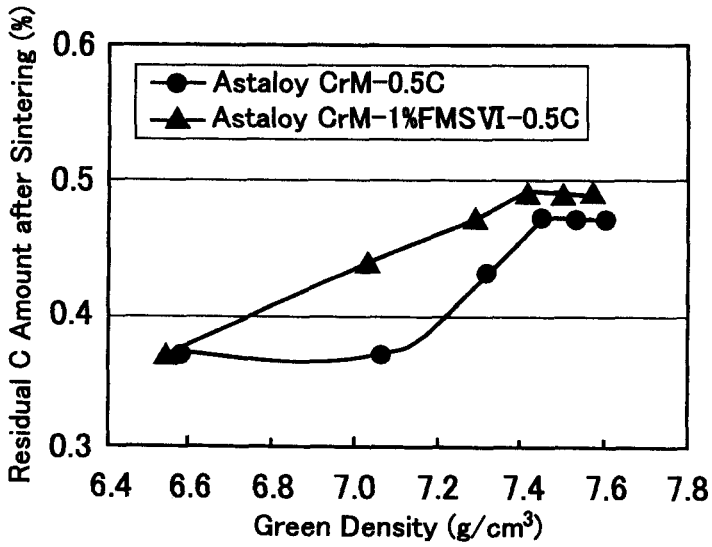
FIG. 13 is a diagram for illustrating the relationships between green density and after-sintering residual carbon (C) amount.

Based on the characteristics of the various samples which used the AstaloyCrM powder and 0.5%-by-mass Gr powder, the relationships between the powder compact's green density and the sintered carbon amount are illustrate in FIG. 13. From this diagram, the case of including the FMS powder (AstaloyCrM-1% FMSVI-0.5C) is such that it was understood that the after-sintering C amount increases (that is, the before/after-sintering varied C amount becomes small) accompanied by the rise of the powder compact's green density; and that, when the green density becomes 7.4 g/cm$^3$ (density ratio: 94%) or more, the C amount hardly decreases (the reduction magnitude becomes 2% or less approximately). With respect to this, the case of not including the FMS powder (AstaloyCrM-0.5C) is such that it was understood that, when the powder compact's green density decreases, the after-sintering C amount, too, decreases sharply (that is, the before/after-sintering varied C amount enlarges sharply). Further, in this case, it was understood as well that, even when the green density becomes 7.4 g/cm$^3$ or more, the reduction magnitude of the C amount does not become 6% or less. Therefore, by having an FMS powder contained in a raw material powder, it is possible to enhance the yield ratio of the C amount in the green compact's extensive area.

(3) Eighth Example

Figure 14:
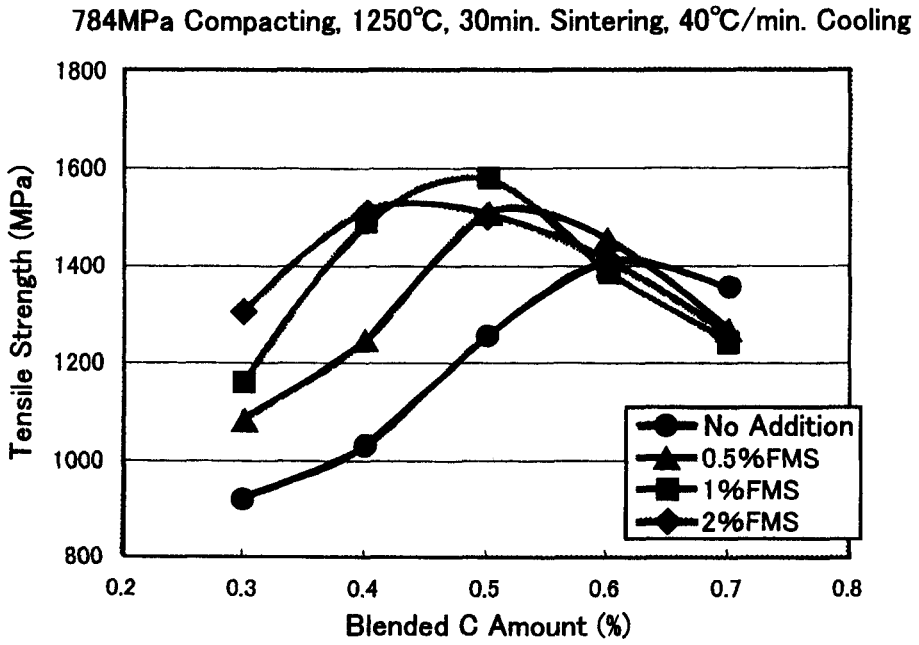
FIG. 14 is a diagram for illustrating the relationships between blended carbon (C) amount and tensile strength.

Using the above-described iron alloy powder (AstaloyCrM), Gr powder and FMS powder (#VI), a variety of samples whose blended amounts of the respective powder, compacting pressures and sintering temperatures were different from each other were produced. The various characteristics of the respective samples are set forth in Table 9-Table 11 along with their compositions and compacting pressures. Table 9, Table 10 and Table 11 are the cases where the sintering temperature was adapted to 1,150° C., 1,250° C. and 1,350° C., respectively. Moreover, based on the data on the samples set forth in Table 10 (compacting pressure: 784 MPa), the relationships between the blended amount of the Gr powder (blended C amount) and the tensile strength or elongation are illustrated in FIG. 14 and FIG. 15, respectively.

First of all, from FIG. 4, when containing the FMS powder in the raw material powder, it is understood that the tensile strength shows the maximum value when the Gr powder is 0.4-0.6% by mass. Moreover, the more the blended amount of the FMS powder the composition has, the higher the maximum value of the tensile strength becomes. This tendency comes into effect substantially even when the blended amounts of the FMS powder, the compacting pressures and the sintering temperatures differ. Next, it became apparent that the more the blended amount of the FMS powder increases the more likely it is that the tensile strength shows the maximum value in the region where the blended C amount is much less. This tendency, too, comes into effect substantially even when the compacting pressures and the sintering temperatures differ. Moreover, as it can be seen by comparing the cases of containing the FMS powder and the case of not containing it, it became apparent as well that the tensile strength of the iron-based sintered alloy increases sharply by having the FMS powder blended even in a slight amount. In particular, the effect is remarkable in the compositional area where the blended C amount is less.

Figure 15:
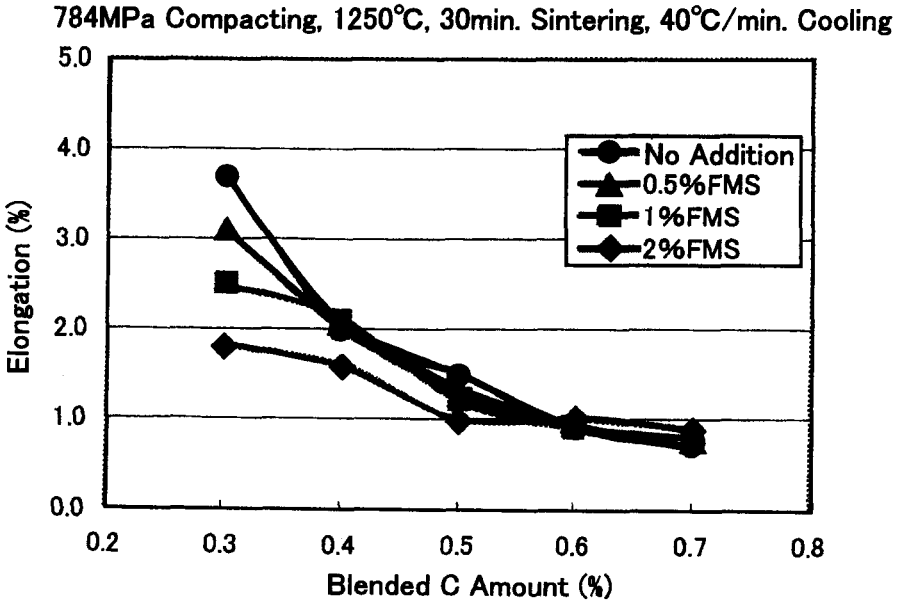
FIG. 15 is a diagram for illustrating the relationships between blended carbon (C) amounts and elongation.

Next, from FIG. 15, it is understood that the elongation decreases as the increment of the blended C amount. Moreover, there is little influence, which results from containing the FMS powder, to the elongation; rather, there is not much difference between the elongation of the samples, which include the FMS powder, and the elongation of the samples, which do not include the FMS powder.

Therefore, by having the FMS powder blended, it is possible to obtain the iron-based sintered alloy whose tensile strength is enlarged while avoiding the decrement of the elongation. That is, even while securing the toughness, the high-strength iron-based sintered alloy can be obtained.

As set forth in Table 9-Table 11, the more the sintering temperature rises, the more likely it is that the iron-based sintered alloy, which is of much higher strength, can be obtained. At 1,150° C., a general sintering temperature, without ever performing any special heat treatment, 1,100-MPa-or-more, 1,200-MPa-or-more, and further 1,300-MPa-or-more iron-based sintered alloys have been obtained. When the sintering temperature is 1,250° C., 1,400-MPa-or-more, 1,500-MPa-or-more, and further 1,600-MPa-or-more iron-based sintered alloys can be obtained. Moreover, when sintering the ultra-high-density powder compacts whose green density is 96% or more at 1,350° C., 1,600-MPa-or-more, 1,700-MPa-or-more, and further 1,800-MPa-or-more iron-based sintered alloys can be obtained.

TABLE 1

| Raw Material Powder: Pure Iron Powder + Graphite Powder + (Fe—Mn powder + Fe—Si Powder) | | | | | | | |
|---|---|---|---|---|---|---|---|
| | Blended Composition (% by mass) | | | | Sintered Body 1,150° C., 30 min., and Sintering in Nitrogen | | |
| | Entire Raw | | Powder Compact | | | Dimensional | Transverse Rupture |
| Sample No. | Material Powder | Mn + Si | Pressure (MPa) | Density (g/cm3) | Density (g/cm3) | Change (%) | Strength (MPa) |
| E1 | Fe—2Mn—0.6C | 2 | 588 | 7.26 | 7.16 | 0.44 | |
| | | | 784 | 7.44 | 7.34 | 0.45 | |
| | | | 1176 | 7.59 | 7.49 | 0.44 | 1262 |
| E2 | Fe—1.5Mn—0.5Si—0.6C | | 588 | 7.11 | 7.05 | 0.30 | |
| | | | 784 | 7.30 | 7.23 | 0.33 | |
| | | | 1176 | 7.45 | 7.38 | 0.36 | 1309 |
| E3 | Fe—1Mn—1Si—0.6C | | 588 | 6.98 | 6.99 | 0.01 | |
| | | | 784 | 7.16 | 7.18 | 0.04 | |
| | | | 1176 | 7.32 | 7.30 | 0.10 | 1339 |
| E4 | Fe—0.5Mn—1.5Si—0.6C | | 588 | 6.85 | 6.91 | −0.22 | |
| | | | 784 | 7.03 | 7.07 | −0.14 | |
| | | | 1176 | 7.18 | 7.20 | −0.06 | 1177 |
| E5 | Fe—2Si—0.6C | | 588 | 6.73 | 6.80 | −0.34 | |
| | | | 784 | 6.91 | 6.99 | −0.34 | |
| | | | 1176 | 7.07 | 7.14 | −0.28 | 956 |
| E6 | Fe—0.5Mn—0.5Si—0.4C | 1 | 588 | 7.21 | 7.19 | 0.13 | 980 |
| | | | 784 | 7.41 | 7.37 | 0.13 | 1100 |
| | | | 1176 | 7.57 | 7.53 | 0.15 | 1233 |
| E7 | Fe—0.5Mn—0.5Si—0.6C | | 588 | 7.21 | 7.19 | 0.16 | 1008 |
| | | | 784 | 7.39 | 7.35 | 0.17 | 1174 |
| | | | 1176 | 7.54 | 7.50 | 0.19 | 1270 |
| E8 | Fe—0.5Mn—0.5Si—0.8C | | 588 | 7.20 | 7.17 | 0.17 | 1080 |
| | | | 784 | 7.36 | 7.33 | 0.20 | 1257 |
| | | | 1176 | 7.49 | 7.45 | 0.22 | 1330 |
| E9 | Fe—1Mn—1Si—0.4C | 2 | 588 | 7.07 | 7.07 | 0.11 | 964 |
| | | | 784 | 7.27 | 7.24 | 0.13 | 1150 |
| | | | 1176 | 7.44 | 7.40 | 0.19 | 1300 |
| E10 | Fe—1Mn—1Si—0.6C | | 588 | 7.04 | 7.05 | 0.12 | 1041 |
| | | | 784 | 7.22 | 7.21 | 0.13 | 1211 |
| | | | 1176 | 7.38 | 7.34 | 0.19 | 1336 |
| E11 | Fe—1Mn—1Si—0.8C | | 588 | 7.03 | 7.03 | 0.03 | 1073 |
| | | | 784 | 7.20 | 7.18 | 0.16 | 1243 |
| | | | 1176 | 7.35 | 7.31 | 0.21 | 1349 |

TABLE 1-continued

| Raw Material Powder: Pure Iron Powder + Graphite Powder + (Fe—Mn powder + Fe—Si Powder) | | | | | | | |
|---|---|---|---|---|---|---|---|
| E12 | Fe—1.5Mn—1.5Si—0.4C | 3 | 588 | 6.89 | 6.90 | 0.07 | 914 |
| | | | 784 | 7.09 | 7.08 | 0.11 | 1080 |
| | | | 1176 | 7.25 | 7.23 | 0.17 | 1202 |
| E13 | Fe—1.5Mn—1.5Si—0.6C | | 588 | 6.86 | 6.86 | 0.04 | 983 |
| | | | 784 | 7.04 | 7.01 | 0.11 | 1148 |
| | | | 1176 | 7.20 | 7.17 | 0.16 | 1236 |
| E14 | Fe—1.5Mn—1.5Si—0.8C | | 588 | 6.85 | 6.85 | 0.10 | 946 |
| | | | 784 | 7.01 | 7.01 | 0.16 | 1114 |
| | | | 1176 | 7.17 | 7.13 | 0.22 | 1249 |
| E00 | Fe—0.6C | None | 588 | 7.30 | 7.28 | 0.07 | 913 |
| | | | 784 | 7.48 | 7.47 | 0.07 | 1035 |
| | | | 1176 | 7.64 | 7.61 | 0.08 | 1129 |
| E01 | Fe—2Cu—0.4C | | 588 | 7.32 | 7.23 | 0.43 | 842 |
| | | | 784 | 7.52 | 7.43 | 0.45 | 1031 |
| | | | 1176 | 7.67 | 7.57 | 0.47 | 1125 |
| E02 | Fe—2Cu—0.6C | | 588 | 7.32 | 7.27 | 0.33 | 996 |
| | | | 784 | 7.50 | 7.43 | 0.34 | 1193 |
| | | | 1176 | 7.63 | 7.56 | 0.38 | 1285 |
| E03 | Fe—2Cu—0.8C | | 588 | 7.31 | 7.26 | 0.21 | 1170 |
| | | | 784 | 7.48 | 7.43 | 0.23 | 1339 |
| | | | 1176 | 7.60 | 7.54 | 0.26 | 1415 |

| | Sintered Body | | | | | | |
|---|---|---|---|---|---|---|---|
| | | | 1,250° C., 30 min., and Sintering in Nitrogen | | | | |
| | 1,150° C., 30 min., and Sintering in Nitrogen | | | Dimensional | Transverse Rupture | | |
| Sample No. | Deflection (mm) | Hardness (Hv 30 kg) | Density (g/cm3) | Change (%) | Strength (MPa) | Deflection (mm) | Hardness (Hv 30 kg) |
| E1 | | | 7.15 | 0.38 | | | |
| | | | 7.34 | 0.41 | | | |
| | 1.08 | 212 | 7.49 | 0.45 | 1258 | 1.8 | 221 |
| E2 | | | 7.07 | 0.20 | | | |
| | | | 7.25 | 0.27 | | | |
| | 1.21 | 208 | 7.38 | 0.34 | 1376 | 1.12 | 226 |
| E3 | | | 7.00 | −0.05 | | | |
| | | | 7.16 | 0.02 | | | |
| | 1.66 | 184 | 7.31 | 0.08 | 1503 | 1.78 | 209 |
| E4 | | | 6.93 | −0.36 | | | |
| | | | 7.10 | −0.27 | | | |
| | 1.54 | 182 | 7.24 | −0.20 | 1430 | 2.05 | 205 |
| E5 | | | 6.84 | −0.49 | | | |
| | | | 6.99 | −0.41 | | | |
| | 1.41 | 157 | 7.15 | −0.34 | 1320 | 2.08 | 186 |
| E6 | 2.45 | 106 | 7.20 | −0.03 | 1016 | 2.66 | 125 |
| | 2.86 | 138 | 7.40 | 0.01 | 1219 | 3.49 | 130 |
| | 3.82 | 146 | 7.56 | 0.07 | 1340 | 4.27 | 148 |
| E7 | 1.58 | 154 | 7.20 | −0.01 | 1118 | 1.87 | 153 |
| | 1.99 | 152 | 7.37 | 0.04 | 1346 | 2.43 | 165 |
| | 2.37 | 157 | 7.51 | 0.12 | 1489 | 2.75 | 178 |
| E8 | 1.27 | 162 | 7.17 | 0.01 | 1279 | 1.60 | 181 |
| | 1.52 | 179 | 7.35 | 0.06 | 1465 | 1.79 | 199 |
| | 1.62 | 196 | 7.46 | 0.13 | 1550 | 1.89 | 209 |
| E9 | 1.55 | 134 | 7.07 | −0.01 | 1079 | 1.89 | 146 |
| | 1.95 | 156 | 7.26 | 0.04 | 1279 | 2.23 | 155 |
| | 2.30 | 169 | 7.40 | 0.13 | 1462 | 2.65 | 171 |
| E10 | 1.26 | 153 | 7.04 | −0.02 | 1195 | 1.40 | 172 |
| | 1.43 | 172 | 7.22 | 0.06 | 1420 | 1.68 | 191 |
| | 1.60 | 187 | 7.35 | 0.13 | 1552 | 1.73 | 195 |
| E11 | 0.97 | 180 | 7.03 | 0.01 | 1340 | 1.24 | 199 |
| | 1.14 | 198 | 7.19 | 0.10 | 1544 | 1.42 | 207 |
| | 1.20 | 211 | 7.31 | 0.16 | 1703 | 1.58 | 230 |
| E12 | 0.91 | 139 | 6.92 | −0.06 | 992 | 0.93 | 151 |
| | 1.14 | 164 | 7.09 | 0.02 | 1205 | 1.09 | 171 |
| | 1.26 | 183 | 7.22 | 0.11 | 1233 | 0.93 | 183 |
| E13 | 0.85 | 168 | 6.88 | −0.06 | 1135 | 0.90 | 177 |
| | 0.98 | 185 | 7.04 | 0.03 | 1320 | 1.04 | 192 |
| | 0.99 | 210 | 7.19 | 0.13 | 1484 | 1.13 | 217 |
| E14 | 0.63 | 183 | 6.85 | −0.01 | 1252 | 0.90 | 200 |
| | 0.76 | 200 | 7.00 | 0.08 | 1355 | 0.94 | 219 |
| | 0.82 | 216 | 7.15 | 0.19 | 1522 | 1.06 | 234 |
| E00 | 2.59 | 113 | 7.31 | −0.03 | 935 | 2.67 | 118 |
| | 3.04 | 125 | 7.49 | 0.00 | 1136 | 3.50 | 134 |
| | 3.91 | 135 | 7.61 | 0.07 | 1213 | 4.85 | 140 |

TABLE 1-continued

| Raw Material Powder: Pure Iron Powder + Graphite Powder + (Fe—Mn powder + Fe—Si Powder) | | | | | | | |
|---|---|---|---|---|---|---|---|
| E01 | 1.30 | 118 | 7.26 | 0.29 | 896 | 1.51 | 142 |
| | 1.76 | 143 | 7.45 | 0.32 | 1071 | 2.10 | 163 |
| | 2.29 | 158 | 7.59 | 0.39 | 1188 | 2.56 | 183 |
| E02 | 1.15 | 148 | 7.29 | 0.14 | 1122 | 1.38 | 174 |
| | 1.48 | 172 | 7.46 | 0.20 | 1236 | 1.56 | 190 |
| | 1.73 | 187 | 7.56 | 0.27 | 1347 | 1.89 | 214 |
| E03 | 0.94 | 180 | 7.28 | 0.08 | 1239 | 1.04 | 193 |
| | 1.19 | 200 | 7.46 | 0.13 | 1411 | 1.27 | 212 |
| | 1.33 | 209 | 7.55 | 0.21 | 1425 | 1.21 | 217 |

TABLE 2

| Raw Material Powder: Pure Iron Powder + Graphite Powder + FMS powder | | | | | | | | |
|---|---|---|---|---|---|---|---|---|
| | Blended Composition (% by mass) | | | | Sintered Body 1,150° C., 30 min., and Sintering in Nitrogen | | | |
| | Entire Raw | | Powder Compact | | | Dimensional | Transverse Rupture | |
| Sample No. | Material Powder | Mn + Si | Pressure (MPa) | Density (g/cm3) | Density (g/cm3) | Change (%) | Strength (MPa) | Deflection (mm) |
| E17 | Fe-1FMSI-0.6C | 0.66 | 588 | 7.25 | 7.23 | 0.12 | 967 | 2.01 |
| | | | 784 | 7.45 | 7.41 | 0.14 | 1199 | 2.79 |
| | | | 1176 | 7.60 | 7.57 | 0.19 | 1321 | 3.11 |
| E18 | Fe-2FMSI-0.4C | 1.32 | 588 | 7.21 | 7.15 | 0.19 | 1048 | 2.54 |
| | | | 784 | 7.41 | 7.36 | 0.21 | 1263 | 3.74 |
| | | | 1176 | 7.58 | 7.54 | 0.24 | 1352 | 4.02 |
| E19 | Fe-2FMSI-0.6C | | 588 | 7.20 | 7.16 | 0.22 | 1109 | 1.82 |
| | | | 784 | 7.41 | 7.32 | 0.24 | 1252 | 2.12 |
| | | | 1176 | 7.56 | 7.49 | 0.28 | 1419 | 2.58 |
| E20 | Fe-2FMSI-0.8C | | 588 | 7.20 | 7.16 | 0.23 | 1146 | 1.31 |
| | | | 784 | 7.38 | 7.33 | 0.26 | 1320 | 1.40 |
| | | | 1176 | 7.52 | 7.46 | 0.29 | 1496 | 1.70 |
| E27 | Fe-3FMSI-0.6C | 1.98 | 588 | 7.16 | 7.12 | 0.24 | 1210 | 1.59 |
| | | | 784 | 7.36 | 7.30 | 0.25 | 1401 | 1.91 |
| | | | 1176 | 7.52 | 7.45 | 0.29 | 1542 | 2.07 |
| E21 | Fe-1FMSII-0.6C | 0.66 | 588 | 7.23 | 7.20 | 0.10 | 933 | 1.91 |
| | | | 784 | 7.42 | 7.40 | 0.10 | 1137 | 2.36 |
| | | | 1176 | 7.57 | 7.55 | 0.12 | 1168 | 2.52 |
| E22 | Fe-2FMSII-0.6C | 1.32 | 588 | 7.15 | 7.14 | 0.13 | 989 | 1.65 |
| | | | 784 | 7.35 | 7.32 | 0.12 | 1179 | 1.96 |
| | | | 1176 | 7.51 | 7.48 | 0.13 | 1421 | 2.58 |
| E23 | Fe-3FMSII-0.6C | 1.98 | 588 | 7.09 | 7.07 | 0.12 | 1033 | 1.48 |
| | | | 784 | 7.28 | 7.25 | 0.13 | 1257 | 1.82 |
| | | | 1176 | 7.45 | 7.41 | 0.15 | 1389 | 2.11 |
| E24 | Fe-1FMSIII-0.6C | 0.66 | 588 | 7.26 | 7.24 | 0.12 | 1078 | 2.18 |
| | | | 784 | 7.46 | 7.44 | 0.13 | 1226 | 2.79 |
| | | | 1176 | 7.61 | 7.58 | 0.14 | 1327 | 3.28 |
| E25 | Fe-2FMSIII-0.6C | 1.32 | 588 | 7.22 | 7.18 | 0.18 | 1261 | 1.90 |
| | | | 784 | 7.41 | 7.37 | 0.19 | 1379 | 2.04 |
| | | | 1176 | 7.58 | 7.53 | 0.21 | 1502 | 2.21 |
| E26 | Fe-3FMSIII-0.6C | 1.98 | 588 | 7.18 | 7.13 | 0.23 | 1091 | 0.98 |
| | | | 784 | 7.37 | 7.31 | 0.26 | 1243 | 1.11 |
| | | | 1176 | 7.54 | 7.47 | 0.32 | 1341 | 1.29 |

| | Sintered Body | | | | | |
|---|---|---|---|---|---|---|
| | | 1,250° C., 30 min., and Sintering in Nitrogen | | | | |
| Sample No. | 1,150° C., 30 min., and Sintering in Nitrogen Hardness (Hv 30 kg) | Density (g/cm3) | Dimensional Change (%) | Transverse Rupture Strength (MPa) | Deflection (mm) | Hardness (Hv 30 kg) |
| E17 | 123 | 7.25 | −0.01 | 1061 | 2.27 | 135 |
| | 144 | 7.43 | 0.05 | 1252 | 2.66 | 158 |
| | 155 | 7.58 | 0.11 | 1410 | 3.32 | 164 |
| E18 | 127 | 7.19 | 0.05 | 1094 | 3.13 | 133 |
| | 135 | 7.37 | 0.12 | 1265 | 3.62 | 138 |
| | 150 | 7.56 | 0.16 | 1478 | 4.66 | 151 |

TABLE 2-continued

| Raw Material Powder: Pure Iron Powder + Graphite Powder + FMS powder | | | | | | |
|---|---|---|---|---|---|---|
| E19 | 145 | 7.20 | 0.05 | 1197 | 2.06 | 149 |
| | 161 | 7.37 | 0.13 | 1417 | 2.52 | 177 |
| | 190 | 7.52 | 0.19 | 1600 | 2.86 | 180 |
| E20 | 174 | 7.18 | 0.06 | 1349 | 1.60 | 187 |
| | 196 | 7.35 | 0.14 | 1584 | 1.87 | 210 |
| | 212 | 7.47 | 0.20 | 1706 | 2.16 | 215 |
| E27 | 157 | 7.14 | 0.09 | 1299 | 1.83 | 172 |
| | 184 | 7.33 | 0.15 | 1545 | 2.18 | 188 |
| | 192 | 7.47 | 0.22 | 1735 | 2.41 | 215 |
| E21 | 128 | 7.23 | −0.02 | 1101 | 2.41 | 134 |
| | 143 | 7.42 | −0.01 | 1276 | 2.96 | 152 |
| | 154 | 7.57 | 0.03 | 1392 | 3.36 | 153 |
| E22 | 141 | 7.16 | −0.01 | 1139 | 2.00 | 146 |
| | 151 | 7.35 | −0.01 | 1356 | 2.43 | 160 |
| | 171 | 7.50 | 0.03 | 1533 | 2.90 | 178 |
| E23 | 152 | 7.10 | −0.03 | 1202 | 1.74 | 158 |
| | 163 | 7.29 | 0.00 | 1424 | 2.12 | 180 |
| | 175 | 7.44 | 0.06 | 1604 | 2.51 | 189 |
| E24 | 131 | 7.25 | 0.01 | 1112 | 2.35 | 138 |
| | 143 | 7.44 | 0.07 | 1354 | 2.99 | 150 |
| | 160 | 7.59 | 0.10 | 1488 | 3.56 | 168 |
| E25 | 152 | 7.19 | 0.08 | 1287 | 1.91 | 151 |
| | 163 | 7.39 | 0.13 | 1509 | 2.44 | 169 |
| | 167 | 7.53 | 0.17 | 1622 | 2.65 | 179 |
| E26 | 165 | 7.13 | 0.14 | 1213 | 1.14 | 167 |
| | 187 | 7.33 | 0.19 | 1376 | 1.14 | 203 |
| | 205 | 7.48 | 0.27 | 1440 | 1.20 | 213 |

TABLE 3

| Raw Material Powder: Pure Iron Powder + Graphite Powder + FMS powder | | | | | | | | | |
|---|---|---|---|---|---|---|---|---|---|
| | Blended Composition (% by mass) | | | | Sintered Body Sintering in Nitrogen | | | | |
| | Entire Raw | | Power Compact | | | Dimensional | Transverse Rupture | | |
| Sample No. | Material Power | Mn + Si | Pressure (MPa) | Density (g/cm3) | Density (g/cm3) | Change (%) | Strength (MPa) | Deflection (mm) | Hardness (Hv 30 kg) |
| E46 | Fe-1FMSV-0.6C | 0.80 | 588 | 7.27 | 7.23 | 0.17 | | | |
| | | | 784 | 7.46 | 7.42 | 0.20 | 1302 | 2.60 | 173 |
| | | | 1176 | 7.61 | 7.56 | 0.23 | | | |
| E47 | Fe-1.5-FMSV-0.6C | 1.20 | 588 | 7.25 | 7.21 | 0.21 | | | |
| | | | 784 | 7.43 | 7.38 | 0.25 | 1386 | 2.14 | 184 |
| | | | 1176 | 7.59 | 7.54 | 0.28 | | | |
| E48 | Fe-2FMSV-0.6C | 1.60 | 588 | 7.24 | 7.18 | 0.28 | | | |
| | | | 784 | 7.41 | 7.36 | 0.29 | 1417 | 1.78 | 200 |
| | | | 1176 | 7.56 | 7.50 | 0.33 | | | |
| E49 | Fe-2.5FMSV-0.6C | 2.00 | 588 | 7.21 | 7.16 | 0.31 | | | |
| | | | 784 | 7.39 | 7.33 | 0.33 | 1364 | 1.11 | 219 |
| | | | 1176 | 7.55 | 7.47 | 0.37 | | | |
| E50 | Fe-3FMSV-0.6C | 2.40 | 588 | 7.19 | 7.13 | 0.35 | | | |
| | | | 784 | 7.38 | 7.30 | 0.39 | 1186 | 0.67 | 257 |
| | | | 1176 | 7.53 | 7.45 | 0.43 | | | |
| E51 | Fe-1FMSVI-0.6C | 0.83 | 588 | 7.26 | 7.22 | 0.16 | | | |
| | | | 784 | 7.45 | 7.41 | 0.17 | 1253 | 2.49 | 163 |
| | | | 1176 | 7.60 | 7.56 | 0.21 | | | |
| E52 | Fe-1.5FMSVI-0.6C | 1.25 | 588 | 7.24 | 7.20 | 0.20 | | | |
| | | | 784 | 7.43 | 7.38 | 0.21 | 1353 | 2.22 | 177 |
| | | | 1176 | 7.57 | 7.52 | 0.24 | | | |
| E53 | Fe-2FMSVI-0.6C | 1.66 | 588 | 7.22 | 7.17 | 0.23 | | | |
| | | | 784 | 7.41 | 7.36 | 0.25 | 1435 | 1.94 | 189 |
| | | | 1176 | 7.56 | 7.50 | 0.28 | | | |
| E54 | Fe-2.5FMSVI-0.6C | 2.08 | 588 | 7.20 | 7.14 | 0.26 | | | 207 |
| | | | 784 | 7.37 | 7.32 | 0.28 | 1444 | 1.56 | |
| | | | 1176 | 7.53 | 7.46 | 0.32 | | | |
| E55 | Fe-3FMSVI-0.6C | 2.49 | 588 | 7.17 | 7.11 | 0.29 | | | |
| | | | 784 | 7.36 | 7.29 | 0.30 | 1335 | 0.96 | 232 |
| | | | 1176 | 7.50 | 7.44 | 0.34 | | | |
| E56 | Fe-1FMSVII-0.6C | 0.80 | 588 | 7.26 | 7.22 | 0.15 | | | |
| | | | 784 | 7.44 | 7.41 | 0.16 | 1192 | 2.17 | 168 |
| | | | 1176 | 7.60 | 7.56 | 0.18 | | | |

TABLE 3-continued

| Raw Material Powder: Pure Iron Powder + Graphite Powder + FMS powder | | | | | | | | | |
|---|---|---|---|---|---|---|---|---|---|
| E57 | Fe-1.5FMSVII-0.6C | 1.20 | 588 | 7.23 | 7.20 | 0.16 | | | |
| | | | 784 | 7.41 | 7.38 | 0.19 | 1247 | 1.91 | 179 |
| | | | 1176 | 7.56 | 7.52 | 0.21 | | | |
| E58 | Fe-2FMSVII-0.6C | 1.60 | 588 | 7.20 | 7.17 | 0.18 | | | |
| | | | 784 | 7.38 | 7.34 | 0.20 | 1359 | 1.95 | 185 |
| | | | 1176 | 7.53 | 7.49 | 0.24 | | | |
| E59 | Fe-2.5FMSVII-0.6C | 2.00 | 588 | 7.18 | 7.14 | 0.20 | | | |
| | | | 784 | 7.36 | 7.31 | 0.23 | 1385 | 1.66 | 191 |
| | | | 1176 | 7.50 | 7.44 | 0.26 | | | |
| E60 | Fe-3FMSVII-0.6C | 2.40 | 588 | 7.16 | 7.11 | 0.21 | | 1.53 | |
| | | | 784 | 7.33 | 7.29 | 0.25 | 1463 | | 199 |
| | | | 1176 | 7.48 | 7.43 | 0.26 | | | |

| | | Sintered Body 1,250° C., 30 min., and Sintering in Nitrogen | | | | |
|---|---|---|---|---|---|---|
| Sample No. | Density (g/cm3) | Dimensional Change (%) | Transverse Rupture Strength (MPa) | Deflection (mm) | Hardness (Hv 30 kg) |
| E46 | 7.25 | 0.06 | | | |
| | 7.44 | 0.09 | 1357 | 2.62 | 171 |
| | 7.58 | 0.15 | | | |
| E47 | 7.22 | 0.10 | | | |
| | 7.41 | 0.15 | 1478 | 2.49 | 189 |
| | 7.54 | 0.22 | | | |
| E48 | 7.18 | 0.17 | | | |
| | 7.37 | 0.23 | 1531 | 2.04 | 205 |
| | 7.51 | 0.29 | | | |
| E49 | 7.16 | 0.20 | | | |
| | 7.34 | 0.28 | 1494 | 1.32 | 219 |
| | 7.48 | 0.34 | | | |
| E50 | 7.14 | 0.29 | | | |
| | 7.31 | 0.34 | 1333 | 0.76 | 234 |
| | 7.45 | 0.42 | | | |
| E51 | 7.25 | 0.02 | | | |
| | 7.44 | 0.09 | 1353 | 2.95 | 175 |
| | 7.58 | 0.14 | | | |
| E52 | 7.22 | 0.05 | | | |
| | 7.40 | 0.11 | 1479 | 2.55 | 184 |
| | 7.55 | 0.17 | | | |
| E53 | 7.19 | 0.10 | | | |
| | 7.38 | 0.14 | 1558 | 2.21 | 200 |
| | 7.52 | 0.20 | | | |
| E54 | 7.17 | 0.12 | | | |
| | 7.34 | 0.17 | 1588 | 1.88 | 218 |
| | 7.49 | 0.22 | | | |
| E55 | 7.14 | 0.12 | | | |
| | 7.32 | 0.18 | 1578 | 1.49 | 221 |
| | 7.46 | 0.24 | | | |
| E56 | 7.25 | −0.02 | | | |
| | 7.44 | 0.03 | 1297 | 2.42 | 174 |
| | 7.58 | 0.10 | | | |
| E57 | 7.22 | 0.03 | | | |
| | 7.41 | 0.07 | 1387 | 2.45 | 179 |
| | 7.54 | 0.13 | | | |
| E58 | 7.20 | 0.04 | | | |
| | 7.36 | 0.10 | 1492 | 2.23 | 188 |
| | 7.51 | 0.15 | | | |
| E59 | 7.17 | 0.06 | | | |
| | 7.33 | 0.12 | 1506 | 1.93 | 206 |
| | 7.47 | 0.18 | | | |
| E60 | 7.13 | 0.07 | | | |
| | 7.31 | 0.13 | 1595 | 1.81 | 207 |
| | 7.45 | 0.18 | | | |

TABLE 4

Relationships between the Characteristics of Powder Compacts as well as Sintered Bodies with Fe-2FMSVI-0.6C Composition and the Particle Sizes of FMS powder as well as the Sintering Temperatures

| | Particle | | Powder Compact | | Sintered Body | | | | |
|---|---|---|---|---|---|---|---|---|---|
| | | | | | | | Transverse | | |
| Sample No. | Size of FMS powder | Sintering Temp. (° C.) | Compacting Pressure (MPa) | Density (g/cm3) | Density (g/cm3) | Dimensional Change (%) | Rupture Strength (MPa) | Deflection (mm) | Hardness (Hv 30 kg) |
| E31 | −250 mesh (μm or less) | 1050 | 588 | 7.22 | 7.17 | 0.26 | | | |
| | | | 784 | 7.42 | 7.36 | 0.26 | 993 | 1.66 | 161 |
| | | | 1176 | 7.57 | 7.50 | 0.31 | | | |
| | | 1100 | 588 | 7.22 | 7.17 | 0.25 | | | |
| | | | 784 | 7.42 | 7.35 | 0.27 | 1113 | 1.55 | 164 |
| | | | 1176 | 7.56 | 7.49 | 0.30 | | | |
| | | 1150 | 588 | 7.22 | 7.17 | 0.20 | 1149 | 1.52 | 168 |
| | | | 784 | 7.41 | 7.35 | 0.23 | 1238 | 1.58 | 181 |
| | | | 1176 | 7.57 | 7.50 | 0.26 | 1375 | 1.83 | 182 |
| | | 1200 | 588 | 7.22 | 7.18 | 0.16 | 1306 | | |
| | | | 784 | 7.41 | 7.37 | 0.19 | | 1.56 | 197 |
| | | | 1176 | 7.56 | 7.51 | 0.24 | | | |
| | | 1250 | 588 | 7.21 | 7.19 | 0.07 | 1224 | 1.44 | 185 |
| | | | 784 | 7.41 | 7.38 | 0.14 | 1373 | 1.65 | 204 |
| | | | 1176 | 7.57 | 7.52 | 0.19 | 1532 | 1.91 | 208 |
| E44 | −350 mesh (μm or less) | 1050 | 588 | 7.24 | 7.19 | 0.27 | | | |
| | | | 784 | 7.42 | 7.35 | 0.29 | 1065 | 1.72 | 156 |
| | | | 1176 | 7.58 | 7.51 | 0.32 | | | |
| | | 1100 | 588 | 7.23 | 7.17 | 0.26 | | | |
| | | | 784 | 7.43 | 7.37 | 0.28 | 1222 | 1.67 | 177 |
| | | | 1176 | 7.57 | 7.49 | 0.30 | | | |
| | | 1150 | 588 | 7.22 | 7.18 | 0.23 | 1222 | 1.45 | 174 |
| | | | 784 | 7.41 | 7.35 | 0.25 | 1295 | 1.51 | 185 |
| | | | 1176 | 7.57 | 7.51 | 0.27 | 1413 | 1.90 | 193 |
| | | 1200 | 588 | 7.23 | 7.19 | 0.17 | | | |
| | | | 784 | 7.42 | 7.38 | 0.21 | 1411 | 1.55 | 191 |
| | | | 1176 | 7.56 | 7.52 | 0.25 | | | |
| | | 1250 | 588 | 7.24 | 7.21 | 0.10 | 1313 | 1.65 | 172 |
| | | | 784 | 7.42 | 7.38 | 0.16 | 1425 | 1.73 | 182 |
| | | | 1176 | 7.56 | 7.53 | 0.22 | 1550 | 1.88 | 211 |
| E45 | −500 mesh (μm or less) | 1050 | 588 | 7.24 | 7.17 | 0.28 | | | |
| | | | 784 | 7.42 | 7.35 | 0.30 | 1152 | 1.66 | 167 |
| | | | 1176 | 7.56 | 7.49 | 0.33 | | | |
| | | 1100 | 588 | 7.23 | 7.17 | 0.28 | | | |
| | | | 784 | 7.42 | 7.35 | 0.29 | 1280 | 1.70 | 172 |
| | | | 1176 | 7.58 | 7.49 | 0.32 | | | |
| | | 1150 | 588 | 7.22 | 7.18 | 0.23 | 1243 | 1.66 | 173 |
| | | | 784 | 7.41 | 7.36 | 0.26 | 1409 | 1.76 | 182 |
| | | | 1176 | 7.56 | 7.49 | 0.29 | 1508 | 1.90 | 194 |
| | | 1200 | 588 | 7.23 | 7.19 | 0.17 | | | |
| | | | 784 | 7.41 | 7.37 | 0.21 | 1499 | 1.99 | 195 |
| | | | 1176 | 7.56 | 7.51 | 0.25 | | | |
| | | 1250 | 588 | 7.22 | 7.20 | 0.10 | 1375 | 1.88 | 176 |
| | | | 784 | 7.41 | 7.38 | 0.16 | 1529 | 2.23 | 187 |
| | | | 1176 | 7.56 | 7.52 | 0.22 | 1712 | 2.30 | 216 |

TABLE 5

Raw Material Powder: Pure Iron Powder + Graphite Powder + FMS powder + Internal Lubricant

| | Blended Composition (% by mass) Entire Raw | | Powder Compact | | Sintered Body 1,140° C., 20 min., and Sintering in Nitrogen | | | | |
|---|---|---|---|---|---|---|---|---|---|
| | | | | | | Dimensional | Transverse Rupture | | |
| Sample No. | Material Powder | Mn + Si | Pressure (MPa) | Density (g/cm3) | Density (g/cm3) | Change (%) | Strength (MPa) | Deflection (mm) | Hardness (Hv 30 kg) |
| E41 | Fe-2FMSVI-0.8C + 0.1LiSt | 1.66 | 392 | 6.93 | 6.88 | 0.30 | 902 | 0.74 | 175 |
| | | | 588 | 7.24 | 7.19 | 0.30 | 1130 | 0.93 | 195 |
| | | | 784 | 7.38 | 7.33 | 0.30 | 1240 | 1.04 | 216 |
| | | | 1176 | 7.47 | 7.43 | 0.29 | 1331 | 1.11 | 217 |

TABLE 5-continued

| Raw Material Powder: Pure Iron Powder + Graphite Powder + FMS powder + Internal Lubricant | | | | | | | | | |
|---|---|---|---|---|---|---|---|---|---|
| | Blended Composition (% by mass) | | | | Sintered Body 1,140° C., 20 min., and Sintering in Nitrogen | | | | |
| | Entire Raw | | Powder Compact | | | Dimensional | Transverse Rupture | | |
| Sample No. | Material Powder | Mn + Si | Pressure (MPa) | Density (g/cm3) | Density (g/cm3) | Change (%) | Strength (MPa) | Deflection (mm) | Hardness (Hv 30 kg) |
| E42 | Fe-2FMSVI-0.8C + 0.8LiSt | 1.66 | 392 | 6.73 | 6.65 | 0.25 | 751 | 0.59 | 146 |
| | | | 490 | 6.89 | 6.80 | 0.24 | 880 | 0.70 | 177 |
| | | | 588 | 6.98 | 6.90 | 0.25 | 978 | 0.75 | 175 |
| | | | 686 | 7.04 | 6.98 | 0.24 | 1016 | 0.78 | 184 |
| E04 | Fe—2Cu—0.8C + 0.8LiSt | None | 392 | 6.77 | 6.70 | 0.06 | 704 | 0.60 | 138 |
| | | | 490 | 6.95 | 6.88 | 0.09 | 827 | 0.67 | 151 |
| | | | 588 | 7.05 | 6.99 | 0.09 | 902 | 0.68 | 169 |
| | | | 686 | 7.11 | 7.06 | 0.11 | 948 | 0.78 | 167 |

TABLE 6

| Blended Compositions of Respective FMS Powders and Mn Amount as well as Si Amount in Raw Material Powders | | | | | | | | | | | | | | | | |
|---|---|---|---|---|---|---|---|---|---|---|---|---|---|---|---|---|
| | Blended | Mn Amount, Si Amount and Mn + Si amount in Raw Material Powder with FMS Powder Blended (%) by mass | | | | | | | | | | | | | | |
| | | 1FMS | | | 1.5FMS | | | 2FMS | | | 2.5FMS | | | 3FMS | | |
| # | Composition (% by mass) | Mn | Si | Mn + Si | Mn | Si | Mn + Si | Mn | Si | Mn + Si | Mn | Si | Mn + Si | Mn | Si | Mn + Si |
| I | Fe—33Mn—33Si | 0.33 | 0.33 | 0.66 | 0.50 | 0.50 | 0.99 | 0.66 | 0.66 | 1.32 | 0.83 | 0.83 | 1.65 | 0.99 | 0.99 | 1.98 |
| II | Fe—22Mn—44Si | 0.22 | 0.44 | 0.66 | 0.33 | 0.66 | 0.99 | 0.44 | 0.88 | 1.32 | 0.55 | 1.10 | 1.65 | 0.66 | 1.32 | 1.98 |
| III | Fe—44Mn—22Si | 0.44 | 0.22 | 0.66 | 0.66 | 0.33 | 0.99 | 0.88 | 0.44 | 1.32 | 1.10 | 0.55 | 1.65 | 1.32 | 0.66 | 1.98 |
| VI | Fe—17Mn—17Si | 0.17 | 0.17 | 0.34 | 0.26 | 0.26 | 0.51 | 0.34 | 0.34 | 0.68 | 0.43 | 0.43 | 0.85 | 0.51 | 0.51 | 1.02 |
| V | Fe—60Mn—20Si | 0.60 | 0.20 | 0.80 | 0.90 | 0.30 | 1.20 | 1.20 | 0.40 | 1.60 | 1.50 | 0.50 | 2.00 | 1.80 | 0.60 | 2.40 |
| VI | Fe—50Mn—33Si | 0.50 | 0.33 | 0.83 | 0.75 | 0.50 | 1.25 | 1.00 | 0.66 | 1.66 | 1.25 | 0.83 | 2.08 | 1.50 | 0.99 | 2.49 |
| VII | Fe—40Mn—40Si | 0.40 | 0.40 | 0.80 | 0.60 | 0.60 | 1.20 | 0.80 | 0.80 | 1.60 | 1.00 | 1.00 | 2.00 | 1.20 | 1.20 | 2.40 |
| VIII | Fe—30Mn—50Si | 0.30 | 0.50 | 0.80 | 0.45 | 0.75 | 1.20 | 0.60 | 1.00 | 1.60 | 0.75 | 1.25 | 2.00 | 0.90 | 1.50 | 2.40 |
| IX | Fe—20Mn—60Si | 0.20 | 0.60 | 0.80 | 0.30 | 0.90 | 1.20 | 0.40 | 1.20 | 1.60 | 0.50 | 1.50 | 2.00 | 0.60 | 1.80 | 2.40 |

TABLE 7

| Raw Material Powder: Astaloy CrM + Graphite Powder + FMS powder | | | | | | | | | |
|---|---|---|---|---|---|---|---|---|---|
| | Blended Composition (% by mass) | | | | Sintered Body 1,250° C., 30 min., and Sintering in Nitrogen | | | | |
| | Entire Raw | | Powder Compact | | | Dimensional | Tensile | | |
| Sample No. | Material Powder | Mn + Si | Pressure (MPa) | Density (g/cm3) | Density (g/cm3) | Change (%) | Strength (MPa) | Elongation (%) | Hardness (Hv 30 kg) |
| E137 | Astaloy CrM-0.5C | None | 784 | 7.29 | 7.35 | −0.27 | 1256 | 1.5 | 341 |
| | | | 1176 | 7.51 | 7.54 | −0.03 | 1428 | 1.4 | 476 |
| E131 | Astaloy CrM-1% FMSVI-0.5C | 1.66 | 784 | 7.26 | 7.30 | −0.20 | 1579 | 1.2 | 442 |
| | | | 1176 | 7.47 | 7.49 | −0.05 | 1688 | 1.1 | 544 |
| E143 | Astaloy CrM-1% FMSVII-0.5C | 1.60 | 784 | 7.26 | 7.29 | −0.16 | 1534 | 1.1 | 480 |
| | | | 1176 | 7.48 | 7.49 | −0.03 | 1647 | 1.1 | 560 |
| E144 | Astaloy CrM-1% FMSVIII-0.5C | 1.60 | 784 | 7.23 | 7.28 | −0.22 | 1480 | 1.0 | 480 |
| | | | 1176 | 7.45 | 7.47 | −0.03 | 1617 | 1.0 | 564 |

TABLE 8

| Raw Material Powder: Fe-system Powder + Graphite Powder + FMS powder VI | | | | | | |
|---|---|---|---|---|---|---|
| | Blended Composition (% by mass) | | | | Sintered Body 1,250° C., 30 min., and Sintering in Nitrogen | |
| | Entire Raw | | Powder Compact | | Before/After-sintering | After-sintering Residual C |
| Sample No. | Material Powder | Mn + Si | Pressure (MPa) | Density (g/cm3) | Weight Change (%) | Mount (% by mass) |
| F01 | Fe—0.5C | None | 784 | 7.52 | −0.14 | 0.43 |
| | | | 1176 | 7.67 | −0.12 | 0.44 |
| F02 | Fe-1% | 1.66 | 784 | 7.47 | −0.04 | 0.48 |
| | FMSVI-0.5C | | 1176 | 7.63 | −0.01 | 0.49 |
| F03 | Astaloy | None | 784 | 7.44 | −0.18 | 0.43 |
| | Mo—0.5C | | 1176 | 7.61 | −0.18 | 0.45 |
| F04 | Astaloy Mo-1% | 1.66 | 784 | 7.39 | −0.12 | 0.48 |
| | FMSVI-0.5C | | 1176 | 7.57 | −0.06 | 0.48 |
| F05 | Astaloy | None | 784 | 7.32 | −0.18 | 0.43 |
| | CrM-0.5C | | 1176 | 7.53 | −0.04 | 0.47 |
| F06 | Astaloy CrM-1% | 1.66 | 784 | 7.26 | −0.04 | 0.47 |
| | FMSVI-0.5C | | 1176 | 7.47 | 0.00 | 0.49 |

TABLE 9

| Raw Material Powder: Astaloy CrM (Fe—3Cr—0.5Mo) + FMS VI Powder (Fe—50Mn—33Si) + Gr Powder Sintering Temperature: 1,150° C. | | | | | | | | | |
|---|---|---|---|---|---|---|---|---|---|
| | Blended Composition Astaloy CrM + x % · FMS + y % · Gr (% by mass) | | | | Sintered Body 1,150° C., 30 min., and Sintering in Nitrogen | | | | |
| | FMS Powder | | Powder Compact | | | Dimensional | Tensile | | |
| Sample No. | Amount (Mn + Si Amount) | Gr Powder Amount | Pressure (MPa) | Density (g/cm3) | Density (g/cm3) | Change (%) | Strength (MPa) | Elongation (%) | Hardness (Hv 30 kg) |
| E136 | 0 | 0.3 | 588 | 7.04 | 7.07 | −0.18 | 747 | 1.8 | 206 |
| | (0) | | 784 | 7.31 | 7.33 | −0.12 | 929 | 3.2 | 244 |
| | | | 1176 | 7.54 | 7.55 | 0.01 | 1005 | 2.8 | 308 |
| | | | 1568 | 7.64 | 7.63 | 0.02 | 1051 | 2.9 | 332 |
| E108 | | 0.4 | 588 | 7.04 | 7.06 | −0.15 | 841 | 1.3 | 235 |
| | | | 784 | 7.31 | 7.31 | −0.04 | 1035 | 1.7 | 281 |
| | | | 1176 | 7.53 | 7.52 | 0.06 | 1128 | 1.9 | 344 |
| | | | 1568 | 7.62 | 7.60 | 0.06 | 1154 | 2.2 | 381 |
| E137 | | 0.5 | 588 | 7.03 | 7.06 | −0.09 | 938 | 0.9 | 274 |
| | | | 784 | 7.31 | 7.29 | −0.01 | 1093 | 0.9 | 374 |
| | | | 1176 | 7.52 | 7.50 | 0.09 | 1251 | 0.9 | 412 |
| | | | 1568 | 7.60 | 7.57 | 0.10 | 1308 | 1.0 | 439 |
| E109 | | 0.6 | 588 | 7.05 | 7.05 | −0.04 | 924 | 0.6 | 336 |
| | | | 784 | 7.29 | 7.29 | −0.01 | 1120 | 0.6 | 436 |
| | | | 1176 | 7.49 | 7.47 | 0.13 | 1236 | 0.7 | 539 |
| | | | 1568 | 7.56 | 7.55 | 0.15 | 1265 | 0.7 | 535 |
| E138 | | 0.7 | 588 | 7.03 | 7.02 | 0.01 | 801 | 0.5 | 421 |
| | | | 784 | 7.30 | 7.27 | 0.06 | 1067 | 0.6 | 490 |
| | | | 1176 | 7.50 | 7.44 | 0.18 | 1179 | 0.7 | 565 |
| | | | 1568 | 7.55 | 7.51 | 0.19 | 1203 | 0.7 | 606 |
| E126 | 0.5 | 0.3 | 588 | 7.05 | 7.08 | −0.14 | 817 | 1.7 | 229 |
| | (0.45) | | 784 | 7.30 | 7.32 | −0.09 | 967 | 1.7 | 300 |
| | | | 1176 | 7.52 | 7.53 | −0.02 | 1086 | 1.7 | 322 |
| | | | 1568 | 7.61 | 7.60 | 0.06 | 1119 | 2.5 | 353 |
| E127 | | 0.4 | 588 | 7.06 | 7.07 | −0.02 | 921 | 1.0 | 278 |
| | | | 784 | 7.29 | 7.30 | −0.01 | 1085 | 0.9 | 317 |
| | | | 1176 | 7.51 | 7.50 | 0.07 | 1232 | 1.2 | 357 |
| | | | 1568 | 7.59 | 7.58 | 0.09 | 1266 | 1.7 | 405 |
| E128 | | 0.5 | 588 | 7.04 | 7.04 | −0.01 | 971 | 0.7 | 322 |
| | | | 784 | 7.28 | 7.28 | 0.03 | 1197 | 0.7 | 382 |
| | | | 1176 | 7.49 | 7.48 | 0.12 | 1457 | 1.0 | 496 |
| | | | 1568 | 7.57 | 7.55 | 0.14 | 1410 | 1.0 | 536 |
| E145 | | 0.6 | 588 | 7.03 | 7.02 | 0.03 | 972 | 0.6 | 385 |
| | | | 784 | 7.28 | 7.26 | 0.10 | 1176 | 0.7 | 465 |
| | | | 1176 | 7.48 | 7.45 | 0.17 | 1312 | 0.7 | 554 |
| | | | 1568 | 7.55 | 7.52 | 0.19 | 1240 | 0.6 | 581 |

TABLE 9-continued

Raw Material Powder: Astaloy CrM (Fe—3Cr—0.5Mo) + FMS VI Powder (Fe—50Mn—33Si) + Gr Powder Sintering Temperature: 1,150° C.

| | Blended Composition Astaloy CrM + x % · FMS + y % · Gr (% by mass) | | | | Sintered Body 1,150° C., 30 min., and Sintering in Nitrogen | | | | |
|---|---|---|---|---|---|---|---|---|---|
| | FMS Powder | | Powder Compact | | | Dimensional | Tensile | | |
| Sample No. | Amount (Mn + Si Amount) | Gr Powder Amount | Pressure (MPa) | Density (g/cm3) | Density (g/cm3) | Change (%) | Strength (MPa) | Elongation (%) | Hardness (Hv 30 kg) |
| E146 | | 0.7 | 588 | 7.03 | 7.02 | 0.02 | 919 | 0.6 | 441 |
| | | | 784 | 7.28 | 7.26 | 0.08 | 1060 | 0.6 | 497 |
| | | | 1176 | 7.47 | 7.44 | 0.16 | 1158 | 0.6 | 579 |
| | | | 1568 | 7.53 | 7.49 | 0.21 | 1184 | 0.6 | 600 |
| E129 | 1 | 0.3 | 588 | 7.04 | 7.06 | −0.07 | 897 | 1.1 | 294 |
| | (0.83) | | 784 | 7.28 | 7.30 | −0.06 | 1073 | 1.1 | 326 |
| | | | 1176 | 7.51 | 7.51 | 0.02 | 1250 | 1.5 | 348 |
| | | | 1568 | 7.59 | 7.59 | 0.03 | 1257 | 2.1 | 414 |
| E130 | | 0.4 | 588 | 7.01 | 7.03 | −0.07 | 932 | 0.8 | 329 |
| | | | 784 | 7.27 | 7.28 | −0.01 | 1090 | 0.9 | 343 |
| | | | 1176 | 7.50 | 7.48 | 0.09 | 1461 | 1.1 | 452 |
| | | | 1568 | 7.56 | 7.55 | 0.11 | 1438 | 1.1 | 482 |
| E131 | | 0.5 | 588 | 7.02 | 7.02 | 0.01 | 990 | 0.6 | 406 |
| | | | 784 | 7.26 | 7.26 | 0.04 | 1199 | 0.6 | 431 |
| | | | 1176 | 7.47 | 7.45 | 0.11 | 1316 | 0.6 | 522 |
| | | | 1568 | 7.55 | 7.52 | 0.16 | 1367 | 0.9 | 545 |
| E147 | | 0.6 | 588 | 7.01 | 7.01 | 0.02 | 978 | 0.6 | 429 |
| | | | 784 | 7.24 | 7.24 | 0.06 | 1068 | 0.6 | 466 |
| | | | 1176 | 7.46 | 7.44 | 0.14 | 1238 | 0.7 | 587 |
| | | | 1568 | 7.53 | 7.50 | 0.19 | 1280 | 0.7 | 608 |
| E148 | | 0.7 | 588 | 7.01 | 7.01 | 0.01 | 950 | 0.6 | 414 |
| | | | 784 | 7.25 | 7.23 | 0.07 | 1071 | 0.7 | 491 |
| | | | 1176 | 7.44 | 7.41 | 0.16 | 1170 | 0.7 | 557 |
| | | | 1568 | 7.52 | 7.48 | 0.19 | 1164 | 0.7 | 595 |
| E132 | 2 | 0.3 | 588 | 7.00 | 7.02 | −0.02 | 918 | 0.9 | 330 |
| | (1.66) | | 784 | 7.25 | 7.25 | 0.01 | 1216 | 1.0 | 350 |
| | | | 1176 | 7.45 | 7.44 | 0.03 | 1451 | 1.6 | 403 |
| | | | 1568 | 7.56 | 7.54 | 0.10 | 1406 | 1.5 | 447 |
| E133 | | 0.4 | 588 | 6.97 | 6.99 | −0.04 | 950 | 0.7 | 362 |
| | | | 784 | 7.23 | 7.22 | 0.02 | 1279 | 0.8 | 406 |
| | | | 1176 | 7.46 | 7.44 | 0.12 | 1425 | 0.9 | 496 |
| | | | 1568 | 7.54 | 7.50 | 0.17 | 1480 | 1.1 | 528 |
| E134 | | 0.5 | 588 | 6.98 | 6.98 | 0.00 | 990 | 0.7 | 392 |
| | | | 784 | 7.21 | 7.21 | 0.04 | 1250 | 0.6 | 437 |
| | | | 1176 | 7.44 | 7.42 | 0.13 | 1303 | 0.9 | 525 |
| | | | 1568 | 7.52 | 7.48 | 0.20 | 1348 | 0.8 | 560 |
| E149 | | 0.6 | 588 | 6.96 | 6.96 | 0.02 | 1012 | 0.6 | 390 |
| | | | 784 | 7.20 | 7.19 | 0.07 | 1203 | 0.7 | 465 |
| | | | 1176 | 7.41 | 7.39 | 0.16 | 1238 | 0.8 | 539 |
| | | | 1568 | 7.49 | 7.46 | 0.20 | 1283 | 0.9 | 579 |
| E150 | | 0.7 | 588 | 6.98 | 6.98 | 0.01 | 835 | 0.7 | 403 |
| | | | 784 | 7.20 | 7.19 | 0.07 | 1104 | 0.8 | 478 |
| | | | 1176 | 7.40 | 7.38 | 0.15 | 1154 | 0.8 | 539 |
| | | | 1568 | 7.46 | 7.43 | 0.20 | 1130 | 0.8 | 572 |

TABLE 10

Raw Material Powder: Astaloy CrM (Fe—3Cr—0.5Mo) + FMS VI Powder (Fe—50Mn—33Si) + Gr Powder Sintering Temperature: 1,250° C.

| | Blended Composition Astaloy CrM + x % · FMS + y % · Gr (% by mass) | | | | Sintered Body 1,250° C., 30 min., and Sintering in Nitrogen | | | | |
|---|---|---|---|---|---|---|---|---|---|
| | FMS Powder | | Powder Compact | | | Dimensional | Tensile | | |
| Sample No. | Amount (Mn + Si Amount) | Gr Powder Amount | Pressure (MPa) | Density (g/cm3) | Density (g/cm3) | Change (%) | Strength (MPa) | Elongation (%) | Hardness (Hv 30 kg) |
| E136 | 0 | 0.3 | 588 | 7.04 | 7.14 | −0.53 | 762 | 2.8 | 217 |
| | (0) | | 784 | 7.32 | 7.37 | −0.31 | 921 | 3.7 | 262 |

TABLE 10-continued

Raw Material Powder: Astaloy CrM (Fe—3Cr—0.5Mo) + FMS VI Powder (Fe—50Mn—33Si) + Gr Powder
Sintering Temperature: 1,250° C.

| | Blended Composition Astaloy CrM + x % · FMS + y % · Gr (% by mass) | | | | Sintered Body 1,250° C., 30 min., and Sintering in Nitrogen | | | | |
|---|---|---|---|---|---|---|---|---|---|
| | FMS Powder | | Powder Compact | | | Dimensional | Tensile | | |
| Sample No. | Amount (Mn + Si Amount) | Gr Powder Amount | Pressure (MPa) | Density (g/cm3) | Density (g/cm3) | Change (%) | Strength (MPa) | Elongation (%) | Hardness (Hv 30 kg) |
| | | | 1176 | 7.55 | 7.58 | −0.12 | 1051 | 3.5 | 316 |
| | | | 1568 | 7.63 | 7.65 | −0.13 | 1083 | 3.2 | 234 |
| E108 | | 0.4 | 588 | 7.04 | 7.14 | −0.51 | 873 | 1.9 | 234 |
| | | | 784 | 7.32 | 7.36 | −0.29 | 1029 | 2.0 | 279 |
| | | | 1176 | 7.53 | 7.56 | −0.07 | 1161 | 2.9 | 371 |
| | | | 1568 | 7.63 | 7.61 | −0.03 | 1247 | 2.7 | 384 |
| E137 | | 0.5 | 588 | 7.04 | 7.12 | −0.39 | 1071 | 1.2 | 290 |
| | | | 784 | 7.29 | 7.35 | −0.27 | 1256 | 1.5 | 341 |
| | | | 1176 | 7.51 | 7.54 | −0.03 | 1428 | 1.4 | 476 |
| | | | 1568 | 7.59 | 7.60 | 0.01 | 1509 | 1.1 | 500 |
| E109 | | 0.6 | 588 | 7.04 | 7.11 | −0.38 | 1198 | 0.8 | 366 |
| | | | 784 | 7.30 | 7.34 | −0.25 | 1411 | 0.9 | 423 |
| | | | 1176 | 7.50 | 7.52 | −0.01 | 1492 | 0.7 | 570 |
| | | | 1568 | 7.55 | 7.57 | 0.04 | 1461 | 0.8 | 600 |
| E138 | | 0.7 | 588 | 7.04 | 7.09 | −0.33 | 1057 | 0.6 | 446 |
| | | | 784 | 7.29 | 7.31 | −0.22 | 1357 | 0.7 | 511 |
| | | | 1176 | 7.50 | 7.48 | −0.01 | 1422 | 0.9 | 568 |
| | | | 1568 | 7.55 | 7.55 | 0.06 | 1417 | 0.8 | 625 |
| E126 | 0.5 | 0.3 | 588 | 7.04 | 7.13 | −0.46 | 871 | 2.7 | 237 |
| | (0.415) | | 784 | 7.29 | 7.36 | −0.35 | 1084 | 3.1 | 299 |
| | | | 1176 | 7.51 | 7.56 | −0.17 | 1222 | 3.8 | 335 |
| | | | 1568 | 7.61 | 7.64 | −0.07 | 1199 | 4.0 | 389 |
| E127 | | 0.4 | 588 | 7.05 | 7.11 | −0.34 | 1031 | 1.8 | 272 |
| | | | 784 | 7.29 | 7.34 | −0.25 | 1245 | 2.0 | 380 |
| | | | 1176 | 7.50 | 7.53 | −0.10 | 1404 | 3.0 | 429 |
| | | | 1568 | 7.59 | 7.61 | −0.04 | 1441 | 2.6 | 470 |
| E128 | | 0.5 | 588 | 7.03 | 7.09 | −0.36 | 1275 | 1.5 | 370 |
| | | | 784 | 7.28 | 7.33 | −0.22 | 1512 | 1.3 | 384 |
| | | | 1176 | 7.49 | 7.50 | −0.04 | 1669 | 1.5 | 483 |
| | | | 1568 | 7.56 | 7.57 | 0.00 | 1565 | 1.0 | 556 |
| E145 | | 0.6 | 588 | 7.05 | 7.09 | −0.27 | 1314 | 1.0 | 403 |
| | | | 784 | 7.28 | 7.32 | −0.16 | 1456 | 0.9 | 496 |
| | | | 1176 | 7.49 | 7.50 | −0.01 | 1494 | 0.9 | 587 |
| | | | 1568 | 7.55 | 7.56 | 0.03 | 1478 | 0.9 | 622 |
| E146 | | 0.7 | 588 | 7.03 | 7.08 | −0.32 | 1168 | 0.7 | 424 |
| | | | 784 | 7.27 | 7.31 | −0.17 | 1272 | 0.8 | 528 |
| | | | 1176 | 7.47 | 7.49 | −0.04 | 1321 | 0.8 | 610 |
| | | | 1568 | 7.53 | 7.54 | 0.04 | 1326 | 0.8 | 631 |
| E129 | 1 | 0.3 | 588 | 7.03 | 7.10 | −0.34 | 927 | 1.8 | 299 |
| | (0.83) | | 784 | 7.28 | 7.34 | −0.26 | 1161 | 2.5 | 345 |
| | | | 1176 | 7.49 | 7.53 | −0.15 | 1331 | 3.0 | 364 |
| | | | 1568 | 7.59 | 7.61 | −0.08 | 1369 | 3.1 | 422 |
| E130 | | 0.4 | 588 | 7.01 | 7.07 | −0.34 | 1116 | 1.5 | 322 |
| | | | 784 | 7.26 | 7.31 | −0.25 | 1490 | 2.1 | 376 |
| | | | 1176 | 7.49 | 7.51 | −0.08 | 1638 | 2.1 | 456 |
| | | | 1568 | 7.56 | 7.57 | −0.01 | 1620 | 1.9 | 514 |
| E131 | | 0.5 | 588 | 7.01 | 7.06 | −0.29 | 1236 | 1.0 | 412 |
| | | | 784 | 7.26 | 7.30 | −0.20 | 1579 | 1.2 | 442 |
| | | | 1176 | 7.47 | 7.49 | −0.05 | 1638 | 1.1 | 544 |
| | | | 1568 | 7.55 | 7.54 | 0.04 | 1658 | 1.1 | 598 |
| E147 | | 0.6 | 588 | 7.00 | 7.05 | −0.30 | 1291 | 1.0 | 425 |
| | | | 784 | 7.26 | 7.29 | −0.13 | 1388 | 0.9 | 495 |
| | | | 1176 | 7.46 | 7.47 | −0.01 | 1460 | 0.9 | 577 |
| | | | 1568 | 7.54 | 7.53 | 0.06 | 1518 | 1.0 | 617 |
| E148 | | 0.7 | 588 | 7.00 | 7.05 | −0.31 | 1191 | 0.8 | 438 |
| | | | 784 | 7.24 | 7.27 | −0.14 | 1246 | 0.8 | 504 |
| | | | 1176 | 7.45 | 7.45 | −0.01 | 1238 | 0.9 | 583 |
| | | | 1568 | 7.51 | 7.52 | 0.05 | 1290 | 0.8 | 612 |
| E132 | 2 | 0.3 | 588 | 6.99 | 7.04 | −0.29 | 1075 | 1.4 | 319 |
| | (1.66) | | 784 | 7.25 | 7.29 | −0.21 | 1310 | 1.8 | 344 |
| | | | 1176 | 7.44 | 7.47 | −0.11 | 1585 | 2.8 | 433 |
| | | | 1568 | 7.56 | 7.55 | 0.00 | 1545 | 2.7 | 483 |
| E133 | | 0.4 | 588 | 6.97 | 7.02 | −0.30 | 1159 | 1.1 | 348 |
| | | | 784 | 7.23 | 7.26 | −0.17 | 1517 | 1.6 | 397 |
| | | | 1176 | 7.44 | 7.45 | −0.03 | 1644 | 1.4 | 510 |
| | | | 1568 | 7.53 | 7.52 | 0.09 | 1641 | 1.3 | 550 |

TABLE 10-continued

Raw Material Powder: Astaloy CrM (Fe—3Cr—0.5Mo) + FMS VI Powder (Fe—50Mn—33Si) + Gr Powder
Sintering Temperature: 1,250° C.

| | Blended Composition Astaloy CrM + x % · FMS + y % · Gr (% by mass) | | | | Sintered Body 1,250° C., 30 min., and Sintering in Nitrogen | | | | |
|---|---|---|---|---|---|---|---|---|---|
| | FMS Powder | | Powder Compact | | | Dimensional | Tensile | | |
| Sample No. | Amount (Mn + Si Amount) | Gr Powder Amount | Pressure (MPa) | Density (g/cm3) | Density (g/cm3) | Change (%) | Strength (MPa) | Elongation (%) | Hardness (Hv 30 kg) |
| E134 | | 0.5 | 588 | 6.96 | 7.01 | −0.30 | 1230 | 0.7 | 412 |
| | | | 784 | 7.20 | 7.25 | −0.21 | 1505 | 1.0 | 433 |
| | | | 1176 | 7.42 | 7.43 | −0.01 | 1566 | 1.0 | 566 |
| | | | 1568 | 7.51 | 7.50 | 0.09 | 1538 | 1.0 | 567 |
| E149 | | 0.6 | 588 | 6.96 | 7.01 | −0.27 | 1200 | 0.8 | 394 |
| | | | 784 | 7.21 | 7.25 | −0.14 | 1410 | 1.0 | 505 |
| | | | 1176 | 7.41 | 7.42 | 0.01 | 1387 | 0.9 | 566 |
| | | | 1568 | 7.49 | 7.48 | 0.09 | 1392 | 0.9 | 596 |
| E150 | | 0.7 | 588 | 6.96 | 7.01 | −0.29 | 1091 | 0.8 | 432 |
| | | | 784 | 7.20 | 7.24 | −0.14 | 1259 | 0.9 | 493 |
| | | | 1176 | 7.40 | 7.41 | 0.00 | 1265 | 0.9 | 577 |
| | | | 1568 | 7.47 | 7.47 | 0.07 | 1171 | 0.8 | 614 |

TABLE 11

Raw Material Powder: Astaloy CrM (Fe—3Cr—0.5Mo) + FMS VI Powder (Fe—50Mn—33Si) + Gr Powder
Sintering Temperature: 1,350° C.

| | Blended Composition Astaloy CrM + x % · FMS + y % · Gr (% by mass) | | | | Sintered Body 1,350° C., 30 min., and Sintering in Nitrogen | | | | |
|---|---|---|---|---|---|---|---|---|---|
| | FMS Powder | | Powder Compact | | | Dimensional | Tensile | | |
| Sample No. | Amount (Mn + Si Amount) | Gr Powder Amount | Pressure (MPa) | Density (g/cm3) | Density (g/cm3) | Change (%) | Strength (MPa) | Elongation (%) | Hardness (Hv 30 kg) |
| E136 | 0 | 0.3 | 588 | 7.03 | 7.20 | −0.85 | 809 | 4.3 | 234 |
| | (0) | | 784 | 7.32 | 7.41 | −0.51 | 925 | 4.0 | 251 |
| | | | 1176 | 7.54 | 7.62 | −0.25 | 1049 | 5.9 | 318 |
| | | | 1568 | 7.63 | 7.69 | −0.20 | 1091 | 6.4 | 342 |
| E108 | | 0.4 | 588 | 7.03 | 7.19 | −0.87 | 898 | 3.3 | 253 |
| | | | 784 | 7.31 | 7.42 | −0.56 | 1015 | 3.5 | 278 |
| | | | 1176 | 7.54 | 7.60 | −0.25 | 1144 | 4.7 | 349 |
| | | | 1568 | 7.61 | 7.67 | −0.18 | 1207 | 5.1 | 373 |
| E137 | | 0.5 | 588 | 7.04 | 7.18 | −0.77 | 1122 | 2.7 | 295 |
| | | | 784 | 7.30 | 7.39 | −0.51 | 1162 | 2.7 | 317 |
| | | | 1176 | 7.53 | 7.57 | −0.21 | 1360 | 2.8 | 428 |
| | | | 1568 | 7.58 | 7.63 | −0.15 | 1429 | 1.8 | 486 |
| E109 | | 0.6 | 588 | 7.03 | 7.17 | −0.76 | 1340 | 1.4 | 363 |
| | | | 784 | 7.28 | 7.38 | −0.51 | 1445 | 2.2 | 380 |
| | | | 1176 | 7.49 | 7.54 | −0.19 | 1598 | 2.5 | 478 |
| | | | 1568 | 7.56 | 7.59 | −0.11 | 1438 | 0.9 | 572 |
| E138 | | 0.7 | 588 | 7.04 | 7.16 | −0.66 | 1002 | 0.5 | 483 |
| | | | 784 | 7.29 | 7.36 | −0.45 | 1470 | 1.0 | 508 |
| | | | 1176 | 7.49 | 7.51 | −0.09 | 1464 | 0.9 | 612 |
| | | | 1568 | 7.55 | 7.55 | 0.01 | 1072 | 0.5 | 641 |
| E126 | 0.5 | 0.3 | 588 | 7.05 | 7.20 | −0.79 | 873 | 4.2 | 240 |
| | (0.415) | | 784 | 7.28 | 7.41 | −0.56 | 1054 | 4.3 | 296 |
| | | | 1176 | 7.52 | 7.60 | −0.35 | 1152 | 5.8 | 342 |
| | | | 1568 | 7.61 | 7.67 | −0.23 | 1158 | 6.1 | 348 |
| E127 | | 0.4 | 588 | 7.05 | 7.18 | −0.70 | 1007 | 4.0 | 290 |
| | | | 784 | 7.29 | 7.39 | −0.49 | 1147 | 3.0 | 365 |
| | | | 1176 | 7.51 | 7.57 | −0.28 | 1275 | 3.8 | 365 |
| | | | 1568 | 7.58 | 7.64 | −0.20 | 1294 | 3.8 | 385 |
| E128 | | 0.5 | 588 | 7.03 | 7.17 | −0.77 | 1206 | 2.3 | 328 |
| | | | 784 | 7.28 | 7.38 | −0.47 | 1510 | 2.5 | 354 |
| | | | 1176 | 7.48 | 7.55 | −0.23 | 1670 | 3.1 | 465 |
| | | | 1568 | 7.57 | 7.62 | −0.16 | 1550 | 1.5 | 520 |
| E145 | | 0.6 | 588 | 7.04 | 7.13 | −0.54 | 1482 | 2.2 | 380 |
| | | | 784 | 7.27 | 7.35 | −0.36 | 1704 | 1.4 | 499 |

TABLE 11-continued

Raw Material Powder: Astaloy CrM (Fe—3Cr—0.5Mo) + FMS VI Powder (Fe—50Mn—33Si) + Gr Powder
Sintering Temperature: 1,350° C.

| | Blended Composition Astaloy CrM + x % · FMS + y % · Gr (% by mass) | | | | Sintered Body 1,350° C., 30 min., and Sintering in Nitrogen | | | | |
|---|---|---|---|---|---|---|---|---|---|
| | FMS Powder | | Powder Compact | | | Dimensional | Tensile | | |
| Sample No. | Amount (Mn + Si Amount) | Gr Powder Amount | Pressure (MPa) | Density (g/cm3) | Density (g/cm3) | Change (%) | Strength (MPa) | Elongation (%) | Hardness (Hv 30 kg) |
| | | | 1176 | 7.48 | 7.53 | −0.13 | 1752 | 1.2 | 594 |
| | | | 1568 | 7.55 | 7.57 | −0.03 | 1573 | 0.9 | 638 |
| E146 | | 0.7 | 588 | 7.03 | 7.13 | −0.57 | 1321 | 0.8 | 464 |
| | | | 784 | 7.27 | 7.34 | −0.35 | 1369 | 0.9 | 540 |
| | | | 1176 | 7.47 | 7.50 | −0.07 | 1378 | 0.8 | 604 |
| | | | 1568 | 7.53 | 7.54 | 0.03 | 1264 | 0.8 | 633 |
| E129 | 1 | 0.3 | 588 | 7.03 | 7.15 | −0.73 | 904 | 3.5 | 283 |
| | (0.83) | | 784 | 7.28 | 7.39 | −0.53 | 1166 | 3.3 | 318 |
| | | | 1176 | 7.50 | 7.58 | −0.35 | 1237 | 4.7 | 358 |
| | | | 1568 | 7.59 | 7.64 | −0.25 | 1264 | 5.2 | 393 |
| E130 | | 0.4 | 588 | 7.02 | 7.14 | −0.75 | 1117 | 2.9 | 333 |
| | | | 784 | 7.26 | 7.37 | −0.54 | 1303 | 2.3 | 382 |
| | | | 1176 | 7.49 | 7.55 | −0.25 | 1598 | 2.4 | 482 |
| | | | 1568 | 7.56 | 7.61 | −0.18 | 1600 | 2.2 | 499 |
| E131 | | 0.5 | 588 | 7.02 | 7.13 | −0.64 | 1381 | 1.9 | 379 |
| | | | 784 | 7.26 | 7.34 | −0.37 | 1644 | 1.6 | 418 |
| | | | 1176 | 7.48 | 7.52 | −0.20 | 1790 | 1.7 | 556 |
| | | | 1568 | 7.56 | 7.57 | −0.05 | 1813 | 2.1 | 588 |
| E147 | | 0.6 | 588 | 6.99 | 7.10 | −0.61 | 1470 | 1.2 | 431 |
| | | | 784 | 7.25 | 7.33 | −0.37 | 1459 | 1.0 | 523 |
| | | | 1176 | 7.47 | 7.49 | −0.07 | 1538 | 1.0 | 572 |
| | | | 1568 | 7.54 | 7.54 | 0.04 | 1624 | 1.0 | 610 |
| E148 | | 0.7 | 588 | 7.00 | 7.11 | −0.59 | 1411 | 1.0 | 439 |
| | | | 784 | 7.23 | 7.32 | −0.35 | 1244 | 0.8 | 532 |
| | | | 1176 | 7.44 | 7.47 | −0.05 | 1256 | 0.8 | 606 |
| | | | 1568 | 7.52 | 7.52 | 0.06 | 1169 | 0.8 | 629 |
| E132 | 2 | 0.3 | 588 | 6.97 | 7.09 | −0.72 | 1006 | 2.7 | 289 |
| | (1.66) | | 784 | 7.24 | 7.35 | −0.47 | 1293 | 2.4 | 346 |
| | | | 1176 | 7.45 | 7.51 | −0.30 | 1491 | 3.8 | 405 |
| | | | 1568 | 7.54 | 7.57 | −0.13 | 1467 | 3.6 | 425 |
| E133 | | 0.4 | 588 | 6.95 | 7.08 | −0.72 | 1219 | 2.8 | 353 |
| | | | 784 | 7.23 | 7.32 | −0.42 | 1608 | 2.2 | 390 |
| | | | 1176 | 7.44 | 7.48 | −0.16 | 1788 | 2.3 | 520 |
| | | | 1568 | 7.53 | 7.53 | 0.02 | 1692 | 1.3 | 544 |
| E134 | | 0.5 | 588 | 6.96 | 7.09 | −0.69 | 1392 | 1.0 | 395 |
| | | | 784 | 7.20 | 7.30 | −0.49 | 1550 | 1.0 | 488 |
| | | | 1176 | 7.42 | 7.46 | −0.09 | 1660 | 1.0 | 559 |
| | | | 1568 | 7.51 | 7.51 | 0.07 | 1592 | 1.0 | 583 |
| E149 | | 0.6 | 588 | 6.97 | 7.09 | −0.63 | 1494 | 1.7 | 417 |
| | | | 784 | 7.20 | 7.27 | −0.39 | 1469 | 1.0 | 497 |
| | | | 1176 | 7.41 | 7.43 | −0.03 | 1431 | 1.0 | 565 |
| | | | 1568 | 7.49 | 7.48 | 0.09 | 1428 | 1.0 | 592 |
| E150 | | 0.7 | 588 | 6.97 | 7.09 | −0.62 | 1136 | 0.8 | 442 |
| | | | 784 | 7.20 | 7.28 | −0.36 | 1144 | 0.8 | 530 |
| | | | 1176 | 7.40 | 7.41 | −0.02 | 1112 | 0.8 | 570 |
| | | | 1568 | 7.47 | 7.47 | 0.08 | 1060 | 0.8 | 589 |

Examples of the Second Invention

The present invention will be explained more specifically while naming examples.

(Production of Samples)

(1) As an Fe-system alloy, Astaloy Mo, produced by HEGANESE Co., Ltd., (Fe-1.5Mo, and Particle Diameters: 20-180 μm), Distaloy AE, produced by HEGANESE Co., Ltd., (Fe-4.0Ni-1.5Cu-0.5Mo, and Particle Diameters: 20-180 μm), KIP 30CRV, produced by JFE STEEL Co., Ltd., (Fe-3Cr-0.3Mo-0.3Mn-0.3V, and Particle Diameters: 20-180 μm), and KIP103V, produced by JFE STEEL Co., Ltd., (Fe-1Cr-0.3Mo-0.3V, and Particle Diameters: 20-180 μm) were prepared.

As an Si-system powder, Fe—Mn—Si powders (FMS powders) were prepared. These FMS powders were those which were made by pulverizing Fe—Mn—Si-system cast bulks (ingots) with various compositions set forth in Table 22, which were melt produced in an Ar gas atmosphere, and sieving them to a powder, whose particle diameters were 25 μm or less. Hereinafter, the compositions of the FMS powders will be identified by means of the numbers (I-III) in Table 22. For reference, since Fe—Mn—Si-system cast bulks (FMS cast bulks) are brittle, it is possible to obtain FMS powders easily by mechanically pulverizing them. However, since an FMS cast bulk whose Si+Mn amount is 35% or less is such that the ductility was high comparatively, it was difficult to adapt it to a fine powder by mechanical pulverizing alone.

In the present examples, from the viewpoint of the pulverizability of FMS cast bulk and making the blended amount of FMS powder less, they were adapted to employ FMS powders whose Si+Mn amount was great comparatively (for example, 80% by mass). The respective alloyed compositions of the FMS powders were such that, from the viewpoint of sintered body's dimensional accuracy, those whose liquid-phase temperatures, found by means of thermo calc, differed were selected.

Other than the FMS powders, a pure Si powder (produced by FUKUDA KINZOKU HAKUFUN Co., Ltd.), an Fe-76.4% Si powder (produced by FUKUDA KINZOKU HAKUFUN Co., Ltd.), an Si-system powder, and an Fe-75.6% Mn powder (produced by FUKUDA KINZOKU HAKUFUN Co., Ltd.), an Mn-system powder, were prepared as well. The units of the compositions are % by mass (being the same hereinafter unless otherwise specified particularly). All of these powders were such that those whose particle size −500 mesh (25 μm or less) were employed. A graphite (Gr) powder (JCPB produced by NIHON KOKUEN Co., Ltd.), a C-system powder, was prepared as well. The particle diameters of this powder were 45 μm or less.

These various powders were blended so as to make a desired composition, and a raw material powder, which was composed of a uniform mixture powder for each of samples, was prepared by carrying out ball mill-type rotary admixing sufficiently.

(2) Powder compacts were carried out by means of the die wall lubrication warm compaction method mainly. Specifically, they are as hereinafter described. Two types of dies made of cemented carbide, which had a ϕ23 mm cylinder-shaped cavity and a 10×55 mm transverse test piece-shaped cavity, were prepared. To the inner peripheral surface of the respective dies, a TiN-coat treatment was performed in advance so that its surface roughness was adapted to 0.4Z. The respective dies were heated to 150° C. with a band heater in advance. Onto the inner peripheral surface of the heated dies, an aqueous solution, in which lithium stearate (LiSt), a higher fatty acid-system lubricant, was dispersed, was sprayed uniformly by a spraying gun in a proportion of 1 $cm^3$/second approximately (applying step). Thus, on the inner peripheral surface of the respective dies, an LiSt film was formed to such an extent as about 1 μm.

The aqueous solution used herein is one in which LiSt was dispersed in one in which a surfactant and an antifoaming agent were added to water. For the surfactant, polyoxyethylene nonyl phenyl ether (EO) 6, polyoxyethylene nonyl phenyl ether (EO) 10, and boric acid ester emulbon T-80 were used, each of them was added in an amount of 1% by volume, respectively, with respect to the entire aqueous solution (100% by volume). For the antifoaming agent, FS antifoam 80 was used, and was added in an amount of 0.2% by volume with respect to the entire aqueous solution (100% by volume). For LiSt, one whose melting point was about 225° C. and average particle diameter was 20 μm was used. Its dispersion amount was adapted to 25 g with respect to the aforementioned 100 $cm^3$ aqueous solution. The aqueous solution, in which LiSt was dispersed, was further subjected to a microfining treatment (Teflon-coated steel balls: 100 hours) with a ball mill-type pulverizing apparatus. The thus obtained stock solution was diluted by 20 times, and an aqueous solution, whose final concentration was 1%, was used for the aforementioned applying step.

Into the cavities of the respective dies, in which the uniform film of LiSt was formed on the inner surface, the above-described various raw material powders were filled naturally (filling step). The raw material powders were heated to 150° C., the same temperature as that of the dies, with a drier in advance.

The respective raw material powders, which were filled in the dies, were compacted with various compacting pressures, thereby obtaining powder compacts (warm compacting step). Even in any case of all the compacting pressures, it was possible to take the powder compacts out of the dies with low ejection forces, without causing any galling, and the like, on the inner surface of the dies.

(3) The obtained respective powder compacts were sintered in a 1,350° C. nitrogen gas atmosphere (sintering step), using a continuous sintering furnace (OXYNON furnace produced by KANTO YAKIN KOGYO Co., Ltd.). The sintering time was adapted to 30 minutes, and the after-sintering cooling rate was 40° C./min. Note that the inside of the sintering furnace was adapted to an ultra-low-oxygen-partial-pressure atmosphere of 50-100 ppm by CO concentration (equivalent to $10^{-19}$-$10^{-21}$ Pa by conversion into oxygen partial pressure). Thus, ϕ23 mm cylinder-shaped samples and 10×55 mm transverse test piece-shaped samples, which were composed of a variety of iron-based sintered-alloy members, were obtained.

Note that the transverse test pieces carried out a hardening-tempering heat treatment. The hardening treatment was carried out by quenching them in a 60° C. oil after heating them 850° C.×1 hour in a nitrogen atmosphere. The tempering thereafter was carried out by heating them 200° C.×1 hour in air.

(Measurements)

(1) Using the aforementioned cylinder-shaped samples, the green densities (G. D.) and the density ratios, the sintered-body densities (S. D.) and the density ratios, and further the dimensional changes (height changes ΔT and outside-diameter changes ΔD) were found by calculation from their before/after-sintering weights and dimensions. Note that the sintered densities of the samples, in which blistering occurred, were reference values.

(2) Using the aforementioned transverse test piece-shaped samples, a transverse test was carried out by means of three-point bending with 40 mm-distance between fulcrums. Thus, the strength (transverse rupture strength) and until the respective samples ruptured were found. Moreover, the hardness of the transverse test piece-shaped samples' side surface was measured at 30 kg load by means of a Vickers hardness meter.

Comparative Example

Sample No. HS8

Raw material powders with various compositions were prepared, raw material powders in which the above-described Astaloy Mo powder and the graphite (Gr) powder were blended and admixed. These raw material powders are those which did not include any Si-system powder. These raw material powders were compacted with various compacting pressures by means of the die wall lubrication warm compaction method, and the obtained respective powder compacts were sintered, thereby obtaining respective sintered bodies (iron-based sintered-alloy members) of Sample No. HS8 set forth in Table 21. The characteristics of the respective powder compacts and respective sintered bodies are set forth in Table 21 along with the blended composition of each of the raw material powders.

Among Sample No. HS8, all of the sintered bodies whose blended amount of the Gr powder is 0 (Astaloy Mo only) are such that the dimensions contracted slightly so that they were densified. And, no blistering was generated. This fact can be confirmed as well from the fact that, when the compacting pressure was 1,960 MPa, the sintered density was such an ultra-high density as 7.86 g/cm$^3$ (99.7% sintered density ratio).

Among Sample No. HS8, the sintered bodies whose blended amount of the Gr powder was 0.3-0.6% were such that blistering was generated when the compacting pressure was 1,568 MPa or more, or 1,960 MPa or more. The occurrence of blistering can be not only confirmed by the fact that the dimensional changes (especially, the height dimensions) changed greatly toward positive side, but also by the fact that the sintered density ratios degraded sharply. For example, when a powder compact whose green density was 98% or more was sintered, it is possible to judge that blistering occurred from the fact that its sintered density degraded sharply beyond ±1% of the green density ratio to 90% or less.

Figure 16:
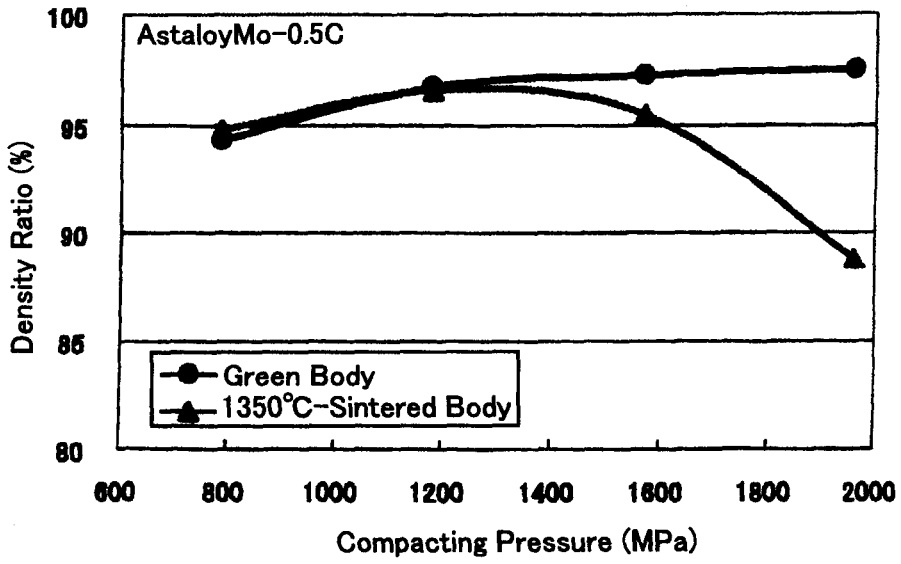
FIG. 16 is a graph for illustrating the relationships between compacting pressure and sintered density ratio.
Figure 17A:
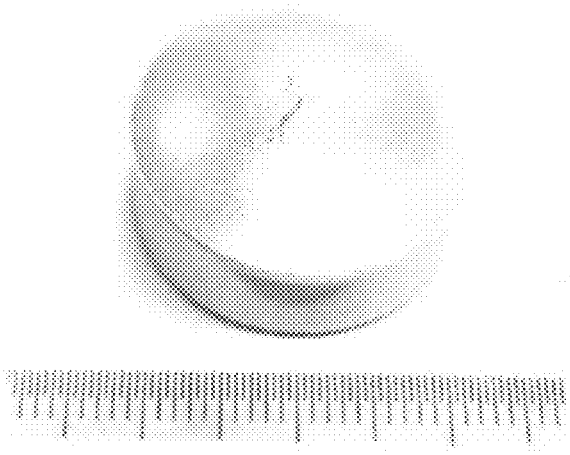
FIG. 17A is an appearance photograph of a sintered body in which blistering was generated.
Figure 17B:
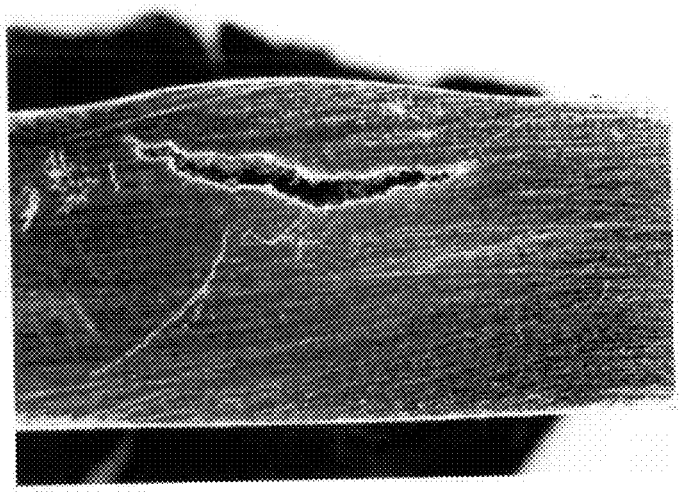
FIG. 17B is a cross-sectional photograph of a sintered body in which blistering was generated.

In FIG. 16, the relationships between the green density ratio as well as sintered-body density ratio and the compacting pressure when using the raw material powder whose blended amount of the Gr powder was 0.5%. In FIG. 17A, FIG. 17B, appearance photographs of the samples (blended amount of Gr powder: 0.5%, and compacting pressure: 1,960 MPa) in which blistering occurred, and their cross-sectional photographs are shown, respectively. As can be apparent from FIG. 17B, it was understood that the fact that large air holes were formed inside the sintered body is the cause of blistering.

Various Examples (1) First Example

Sample Nos. HS9-HS12

Raw material powders with various compositions were prepared by blending and admixing the above-described Astaloy Mo powder, the graphite (Gr) powder and the #I FMS powder. These raw material powders were compacted with various compacting pressures by means of the die wall lubrication warm compaction method, and the obtained respective powder compacts were sintered, thereby obtaining sintered bodies of Sample Nos. HS9-HS12 set forth in Table 12. The characteristics of the respective powder compacts and respective sintered bodies are set forth in Table 12 along with the blended composition of each of the raw material powders.

As can be understood from Sample No. HS9, when the blended amount of the FMS powder was such an extremely trace amount as 0.01%, blistering occurred in the samples whose compacting pressure was 1,568 MPa or more, regardless of the blended amounts of the Gr powder. As can be understood from Sample No. HS10, when the blended amount of the FMS powder was 0.05%, blistering occurred in the samples whose blended amount of the Gr powder was 0.5% and compacting pressure was 1,568 MPa or more. As can be understood from Sample No. HS11, when the blended amount of the FMS powder was 0.1%, blistering occurred only in the samples whose blended amount of the Gr powder was 0.5% and compacting pressure was 1,960 MPa or more.

Here, the height change (ΔT) in the table is the dimensional variation in the compression direction of the ϕ23 cylinder-shaped sample. This ΔT expresses the behavior of blistering most remarkably. The negative values of this ΔT mean that the sintered bodies contracted from the powder compacts. When being a sintered body in which the ΔT becomes negative, no blistering occurs, and accordingly there is not any problem as an iron-based sintered-alloy member practically. Even if the ΔT is positive values, however, when being a sintered body whose ΔT is 0.5% or less, its density hardly degrades, and accordingly there is not any problem practically. On the other hand, when this ΔT surpasses 1% adversely, blistering in a sample becomes so that it can be visually distinguished with ease. Not to mention the instance when the ΔT is negative, when the ΔT is +0.5% or less, or when the sintered-body density ratio is 96% or more, it is believed that such a sintered body does not have any problem practically.

From the respective samples of Table 12, in order to prevent blistering in an ultra-high-density sintered body (C, 0.3-0.6%), it is preferred that the blended amount of the FMS powder can be 0.1% or more, and further 0.2% or more. When converting this into an Si amount, it is possible to say that the Si amount can preferably be 0.02% or more, and further 0.04% or more.

(2) Second Example

Sample Nos. HS13-HS16

Raw material powders with various compositions were prepared by blending and admixing the above-described Astaloy Mo powder, the graphite (Gr) powder and the #II FMS powder. These raw material powders were compacted with various compacting pressures by means of the die wall lubrication warm compaction method, and the obtained respective powder compacts were sintered, thereby obtaining sintered bodies of Sample Nos. HS13-HS16 set forth in Table 13. The characteristics of the respective powder compacts and respective sintered bodies are set forth in Table 13 along with the blended composition of each of the raw material powders.

As can be understood from Sample No. HS13, when the blended amount of the FMS powder was such an extremely trace amount as 0.01%, blistering occurred in the samples whose compacting pressure was 1,568 MPa or more, regardless of the blended amounts of the Gr powder.

As can be understood from Sample No. HS14, in the case where the blended amount of the FMS powder was 0.05%, the ΔT became slightly large positive values when the blended amount of the Gr powder was 0.3% and the compacting pressure was 1,568 MPa or more, or when the blended amount of the Gr powder was 0.5% and the compacting pressure was 1,960 MPa or more. However, since all of these ΔTs were 0.5% or less, it is possible to say that no blistering occurred in them.

As can be understood from Sample Nos. HS15 and HS16, the sintered bodies whose blended amount of the FMS powder was 0.1% or more are such that, regardless of the blended amounts of the Gr powder and the compacting pressures, the ΔT was negative values in all of them; and no blistering occurred in those samples.

From the respective samples of Table 13, in order to prevent blistering in an ultra-high-density sintered body (C, 0.3-0.6%), it is preferred that the blended amount of the FMS powder can be 0.1% or more, and further 0.2% or more. When converting this into an Si amount, it is possible to say that the Si amount can preferably be 0.03% or more, and further 0.06% or more.

(3) Third Example

Sample Nos. HS17-HS20

Raw material powders with various compositions were prepared by blending and admixing the above-described Astaloy Mo powder, the graphite (Gr) powder and the #III FMS powder. These raw material powders were compacted with various compacting pressures by means of the die wall lubrication warm compaction method, and the obtained respective powder compacts were sintered, thereby obtaining sintered bodies of Sample Nos. HS17-HS20 set forth in Table 14. The characteristics of the respective powder compacts and respective sintered bodies are set forth in Table 14 along with the blended composition of each of the raw material powders.

As can be understood from Sample No. HS17, when the blended amount of the FMS powder was such an extremely trace amount as 0.01%, blistering occurred in the samples whose compacting pressure was 1,568 MPa or more, regardless of the blended amounts of the Gr powder.

As can be understood from Sample No. HS18, in the case where the blended amount of the FMS powder was 0.05%, the ΔT became positive values when the blended amount of the Gr powder was 0.3% and the compacting pressure was 1,568 MPa or more, or when the blended amount of the Gr powder was 0.5% and the compacting pressure was 1,960 MPa or more. However, all of these ΔTs were small sufficiently (0.15% or less) so that there was no occurrence of blistering in them.

As can be understood from Sample Nos. HS19 and HS20, the sintered bodies whose blended amount of the FMS powder was 0.1% or more are such that, regardless of the blended amounts of the Gr powder and the compacting pressures, the ΔT was negative values in all of them; and no blistering occurred in those samples.

From the respective samples of Table 14, in order to prevent blistering in an ultra-high-density sintered body (C, 0.3-0.6%), it is preferred that the blended amount of the FMS powder can be 0.05% or more, 0.1% or more, and further 0.2% or more. When converting this into an Si amount, it is possible to say that the it can preferably be 0.02% or more, 0.04% or more, and further 0.08% or more.

(4) Fourth Example

Sample Nos. HS11, HS15 and HS19

Transverse test piece-shaped sintered bodies were produced respectively, transverse test piece-shaped sintered bodies which were the same as the respective samples, among above-described Sample Nos. HS11, HS15 and HS19, in which the blended amount of the Gr powder was adapted to 0.5%, the blended amount of the FMS powder was adapted to 0.1% and the compacting pressure was adapted to 1,568 MPa. The above-described heat treatment were performed to these, thereby obtaining transverse test pieces (iron-based sintered-alloy members). To these test pieces, the transverse test was carried out, thereby examining the bending-strength characteristic of each of them. This result is set forth in Table 15.

When being a test piece using any one of the FMS powders, it demonstrated sufficient density and ductility so that there was no remarkable difference which resulted from the types of the FMS powders. Taking the dimensional changes (ΔT and ΔD), too, into consideration, it is possible to say that the #II FMS powder can be preferable, but even the other FMS powders do not have any problem practically.

(1) Fifth Example

Sample Nos. HS1-HS7, and Sample Nos. C1 and C2

Raw material powders with various compositions were prepared by blending and admixing the above-described various low alloy powders, the graphite (Gr) powder and the #II FMS powder. These raw material powders were compacted with various compacting pressures by means of the die wall lubrication warm compaction method, and the obtained respective powder compacts were sintered, thereby obtaining sintered bodies of Sample Nos. HS1-HS7 and Sample Nos. C1 and C2. The characteristics of the respective powder compacts and respective sintered bodies are set forth in Table 16 and Table 17 along with the blended composition of each of the raw material powders. Note that, for the blending of the raw materials, the #II FMS powder was employed while taking the result of the Fifth Example into account. In Sample Nos. HS1-HS4 employing Astaloy Mo, the blended amount of the FMS powder was varied in the range of 0.1-1% by mass. In the case of the other Fe-system alloy powders, the blended amount of the FMS powder was fixed constant at 0.5% by mass. However, Sample Nos. C1 and C2 were such that no FMS powder was blended. The blended amount of the Gr powder was fixed constant at 0.5% by mass in all of the samples.

From Table 16, the following are understood. All of the samples using the Fe-system powders other than Distaloy AE were such that the height change ΔT was negative values; and showed the contraction of the sintered bodies. On the other hand, when employing Distaloy AE containing Cu in an amount as much as 1.5%, it was understood that the sintered body's blistering is most likely to occur. However, although Distaloy AE is not inherently such a material that it is sintered at a high temperature like 1,350° C., the ΔT of the sintered bodies, which were composed of it, was suppressed to less than +0.3%, to the same extent as those of conventional ordinarily sintered bodies. From these facts, it was confirmed that, not depending on the types of Fe-system powders, the FMS powders demonstrate the blistering restraining effect or dimensional stability effect for sintered bodies.

Moreover, most of the samples using the Fe-system alloys other than Distaloy AE were such that the ΔD, the outside-diameter change, was negative values; and especially, the ΔD of the samples whose compacting pressure surpassed 1,000 MPa was very small to fall within ±1%. From this fact, in accordance with the present invention, the net shaping of the iron-based sintered-alloy member can be expected sufficiently.

From Table 17, the following are understood. All of the samples in which the FMS powder was blended into the raw material powders, not depending on the types of the Fe-system powders, were those which were not only of high strength but also were good in terms of the ductility (deformation magnitude). When comparing them with Sample Nos. C1 and C2, which did not include any FMS powder, it is apparent. It is apparent from Sample Nos. HS1-HS4 that, in the case of employing Astaloy Mo, the strength' peak appeared when the blended amount of the FMS powder was 0.1-0.2% (Mn, and Si: 0.03-0.1%).

The samples, which employed Astaloy Mo among the Fe-system powders, were of most high-strength. However, even the samples, which employed the Fe—Cr low alloy-system KIP 30CRV or KIP 103V, were such that, when comparing them with Sample Nos. C1 and C2, the strength and ductility improved clearly.

(6) Sixth Example

Sample Nos. HS29, and HS21-23

Employing an Fe-76.4% Si powder instead of the FMS powders, sintered bodies were produced. Namely, raw material powders with various compositions were prepared by blending and admixing the Astaloy Mo powder, the graphite (Gr) powder and an Fe-76.4% Si powder (−500 mesh). These raw material powders were compacted with various compacting pressures by means of the die wall lubrication warm compaction method, and the obtained respective powder compacts were sintered, thereby obtaining sintered bodies of Sample Nos. HS29 and HS21-HS23 set forth in Table 18. The characteristics of the respective powder compacts and respective sintered bodies are set forth in Table 18 along with the blended composition of each of the raw material powders.

Among Sample No. HS29, although only the sample, which was compacted with 1,960 MPa was such that the ΔT became positive slightly, it was 0.5% or less. Other than that, in all of the samples, blistering did not occur, and both of the height change ΔT and outside-diameter change ΔD were negative values; and accordingly they were good in terms of the dimensional stability. From the results of Table 18, for the blistering prevention and the dimensional-stability securement in the sintered bodies, it was confirmed that Si is a very effective element. Note that the amount, which is occupied by Si in the entire sintered body (or entire power compact) of this case, is 0.015-0.15%.

(7) Seventh Example

Sample No. HS24

Employing an Fe-75.6% Mn powder instead of the FMS powders, sintered bodies were produced. Namely, raw material powders with various compositions were prepared by blending and admixing the Astaloy Mo powder, the graphite (Gr) powder and an Fe-75.6% Mn powder (−500 mesh). These raw material powders were compacted with various compacting pressures by means of the die wall lubrication warm compaction method, and the obtained respective powder compacts were sintered, thereby obtaining sintered bodies of Sample No. HS24 set forth in Table 19. The characteristics of the respective powder compacts and respective sintered bodies are set forth in Table 19 along with the blended composition of each of the raw material powders.

In this case, blistering occurred entirely in the samples whose forming pressure was 1,568 MPa or more whether the blended amount of the Gr powder was either 0.3% or 0.5%, and the height and outside diameter of the sintered bodies broadened. From the results of Table 19, it was confirmed that Mn is less likely to be effective for the blistering prevention and the dimensional stabilization in the sintered bodies.

(8) Eighth Example

Sample Nos. HS25-28, and Sample No. HS30

Employing a pure Si powder instead of the FMS powders, sintered bodies were produced. Namely, raw material powders with various compositions were prepared by blending and admixing the Astaloy Mo powder, the graphite (Gr) powder and a pure Si powder (−500 mesh). These raw material powders were compacted with various compacting pressures by means of the die wall lubrication warm compaction method, and the obtained respective powder compacts were sintered, thereby obtaining sintered bodies of Sample Nos. HS25-28 set forth in Table 20. The characteristics of the respective powder compacts and respective sintered bodies are set forth in Table 20 along with the blended composition of each of the raw material powders.

As set forth in Sample Nos. HS25 and HS26, when the Si amount was 0.01% and 0.02%, blistering occurred in those which were compacted with a compacting pressure of 1,568 MPa or more. On the contrary, as set forth in Sample Nos. HS27, HS28 and HS30, when the Si amount was 0.03% or more, no blistering occurred even in those which were compacted with such an ultra-high pressure as 1,960 MPa.

TABLE 12

Characteristics of Green Compacts and Sintered Bodies of Samples with FMS I Added

| | Blended Composition | | Powder Compact | | | Sintered Body | | | | |
|---|---|---|---|---|---|---|---|---|---|---|
| | Gr | FMS | | | | | | | | |
| Sample No. | Amount (% by mass) | Powder (% by mass) | Compacting Pressure (MPa) | G.D. (g/cm3) | Density Ratio (%) | S.D. (g/cm3) | Density Ratio (%) | ΔT (%) | ΔD (%) | Blistering |
| HS9 | 0.3 | 0.01 | 784 | 7.44 | 94.5 | 7.50 | 95.2 | −0.44 | −0.23 | |
| | | | 1176 | 7.64 | 96.9 | 7.57 | 96.0 | 0.64 | 0.10 | |
| | | | 1568 | 7.71 | 97.8 | 4.82 | 61.1 | 55.42 | 1.40 | Occurred |
| | | | 1960 | 7.73 | 98.1 | 5.59 | 70.9 | 35.22 | 1.08 | Occurred |
| | 0.5 | | 784 | 7.43 | 94.2 | 7.47 | 94.8 | −0.38 | −0.20 | |
| | | | 1176 | 7.61 | 96.6 | 7.60 | 96.5 | −0.01 | −0.03 | |
| | | | 1568 | 7.66 | 97.3 | 5.72 | 72.6 | 31.87 | 0.69 | Occurred |
| | | | 1960 | 7.68 | 97.5 | 5.00 | 63.5 | 48.55 | 1.57 | Occurred |
| HS10 | 0.3 | 0.05 | 784 | 7.44 | 94.4 | 7.50 | 95.1 | −0.41 | −0.25 | |
| | | | 1176 | 7.64 | 97.0 | 7.62 | 96.7 | 0.07 | 0.03 | |
| | | | 1568 | 7.70 | 97.7 | 7.62 | 96.7 | 0.56 | 0.17 | |
| | | | 1960 | 7.74 | 98.2 | 7.64 | 97.0 | 0.84 | 0.16 | |
| | 0.5 | | 784 | 7.43 | 94.3 | 7.47 | 94.9 | −0.39 | −0.17 | |
| | | | 1176 | 7.61 | 96.6 | 7.61 | 96.5 | −0.01 | −0.02 | |
| | | | 1568 | 7.67 | 97.3 | 7.40 | 94.0 | 2.88 | 0.26 | Occurred |
| | | | 1960 | 7.68 | 97.5 | 4.45 | 56.5 | 67.35 | 1.45 | Occurred |
| HS11 | 0.3 | 0.1 | 784 | 7.44 | 94.4 | 7.49 | 95.0 | −0.38 | −0.20 | |
| | | | 1176 | 7.63 | 96.9 | 7.64 | 97.0 | −0.16 | −0.04 | |
| | | | 1568 | 7.70 | 97.8 | 7.70 | 97.7 | −0.06 | 0.02 | |
| | | | 1960 | 7.73 | 98.1 | 7.73 | 98.1 | −0.10 | 0.02 | |
| | 0.4 | | 784 | 7.43 | 94.3 | 7.48 | 94.9 | −0.38 | −0.20 | |
| | | | 1176 | 7.62 | 96.7 | 7.63 | 96.8 | −0.16 | −0.03 | |
| | | | 1568 | 7.68 | 97.5 | 7.66 | 97.2 | 0.12 | 0.05 | |
| | | | 1960 | 7.71 | 97.9 | 7.69 | 97.6 | 0.11 | 0.05 | |

TABLE 12-continued

Characteristics of Green Compacts and Sintered Bodies of Samples with FMS I Added

| | Blended Composition | | Powder Compact | | | Sintered Body | | | | |
|---|---|---|---|---|---|---|---|---|---|---|
| | Gr | FMS | | | | | | | | |
| Sample No. | Amount (% by mass) | Powder (% by mass) | Compacting Pressure (MPa) | G.D. (g/cm3) | Density Ratio (%) | S.D. (g/cm3) | Density Ratio (%) | ΔT (%) | ΔD (%) | Blistering |
| | 0.5 | | 784 | 7.43 | 94.3 | 7.47 | 94.8 | −0.29 | −0.20 | |
| | | | 1176 | 7.60 | 96.5 | 7.62 | 96.7 | −0.29 | −0.04 | |
| | | | 1568 | 7.67 | 97.3 | 7.63 | 96.9 | 0.16 | 0.12 | |
| | | | 1960 | 7.69 | 97.6 | 7.28 | 92.4 | 5.18 | 0.18 | Occurred |
| | 0.6 | | 784 | 7.42 | 94.1 | 7.45 | 94.6 | −0.38 | −0.16 | |
| | | | 1176 | 7.59 | 96.3 | 7.61 | 96.6 | −0.32 | −0.05 | |
| | | | 1568 | 7.64 | 97.0 | 7.63 | 96.8 | −0.10 | 0.08 | |
| | | | 1960 | 7.66 | 97.2 | 7.64 | 97.0 | −0.04 | 0.10 | |
| HS12 | 0.3 | 0.2 | 784 | 7.43 | 94.3 | 7.48 | 94.9 | −0.39 | −0.18 | |
| | | | 1176 | 7.63 | 96.8 | 7.66 | 97.2 | −0.26 | −0.10 | |
| | | | 1568 | 7.70 | 97.7 | 7.73 | 98.2 | −0.35 | −0.06 | |
| | | | 1960 | 7.73 | 98.1 | 7.75 | 98.4 | −0.29 | −0.06 | |
| | 0.5 | | 784 | 7.41 | 94.1 | 7.46 | 94.7 | −0.41 | −0.19 | |
| | | | 1176 | 7.61 | 96.6 | 7.64 | 97.0 | −0.34 | −0.07 | |
| | | | 1568 | 7.65 | 97.1 | 7.68 | 97.5 | −0.36 | −0.05 | |
| | | | 1960 | 7.67 | 97.3 | 7.69 | 97.6 | −0.34 | −0.02 | |

Base Powder: AstaloyMo 1,350° C., 30 min., and Sintering in Nitrogen

The green-compact density ratio was found by means of (Green-compact Density)/(Sintered-body Theoretical Density).

The sintered-body theoretical density in this instance was adapted to 7.88 g/cm3.

TABLE 13

Characteristics of Green Compacts and Sintered Bodies of Samples with FMS II Added

| | Blended Composition | | Powder Compact | | | Sintered Body | | | | |
|---|---|---|---|---|---|---|---|---|---|---|
| | Gr | FMS | | | | | | | | |
| Sample No. | Amount (% by mass) | Powder (% by mass) | Compacting Pressure (MPa) | G.D. (g/cm3) | Density Ratio (%) | S.D. (g/cm3) | Density Ratio (%) | ΔT (%) | ΔD (%) | Blistering |
| HS13 | 0.3 | 0.01 | 784 | 7.44 | 94.4 | 7.49 | 95.1 | −0.49 | −0.23 | |
| | | | 1176 | 7.64 | 97.0 | 7.58 | 96.2 | 0.43 | 0.10 | |
| | | | 1568 | 7.70 | 97.7 | 4.33 | 54.9 | 70.71 | 2.00 | Ocurred |
| | | | 1960 | 7.72 | 98.0 | 6.39 | 81.1 | 18.60 | 0.91 | Ocurred |
| | 0.5 | | 784 | 7.43 | 94.3 | 7.47 | 94.8 | −0.29 | −0.20 | |
| | | | 1176 | 7.60 | 96.4 | 7.60 | 96.4 | −0.01 | −0.03 | |
| | | | 1568 | 7.66 | 97.2 | 6.34 | 80.5 | 19.38 | 0.52 | Ocurred |
| | | | 1960 | 7.68 | 97.5 | 5.46 | 69.3 | 36.93 | 1.22 | Ocurred |
| HS14 | 0.3 | 0.05 | 784 | 7.44 | 94.4 | 7.49 | 95.1 | −0.40 | −0.22 | |
| | | | 1176 | 7.63 | 96.8 | 7.63 | 96.8 | −0.11 | 0.00 | |
| | | | 1568 | 7.70 | 97.7 | 7.66 | 97.2 | 0.34 | 0.10 | |
| | | | 1960 | 7.72 | 98.0 | 7.67 | 97.3 | 0.40 | 0.12 | |
| | 0.5 | | 784 | 7.43 | 94.3 | 7.47 | 94.8 | −0.28 | −0.17 | |
| | | | 1176 | 7.60 | 96.4 | 7.62 | 96.7 | −0.24 | −0.05 | |
| | | | 1568 | 7.66 | 97.2 | 7.64 | 97.0 | 0.04 | 0.05 | |
| | | | 1960 | 7.69 | 97.6 | 7.62 | 96.7 | 0.47 | 0.12 | |
| HS15 | 0.3 | 0.1 | 784 | 7.44 | 94.4 | 7.48 | 94.9 | −0.35 | −0.20 | |
| | | | 1176 | 7.63 | 96.8 | 7.66 | 97.2 | −0.32 | −0.09 | |
| | | | 1568 | 7.70 | 97.7 | 7.72 | 98.0 | −0.28 | −0.03 | |
| | | | 1960 | 7.73 | 98.1 | 7.75 | 98.4 | −0.30 | −0.03 | |
| | 0.4 | | 784 | 7.43 | 94.3 | 7.47 | 94.8 | −0.32 | −0.19 | |
| | | | 1176 | 7.61 | 96.6 | 7.64 | 97.0 | −0.32 | −0.08 | |
| | | | 1568 | 7.67 | 97.3 | 7.69 | 97.6 | −0.23 | −0.01 | |
| | | | 1960 | 7.71 | 97.8 | 7.72 | 98.0 | −0.17 | 0.00 | |
| | 0.5 | | 784 | 7.42 | 94.2 | 7.47 | 94.8 | −0.47 | −0.18 | |
| | | | 1176 | 7.60 | 96.4 | 7.63 | 96.8 | −0.42 | −0.08 | |
| | | | 1568 | 7.67 | 97.3 | 7.68 | 97.5 | −0.22 | −0.02 | |
| | | | 1960 | 7.68 | 97.5 | 7.69 | 97.6 | −0.22 | 0.01 | |
| | 0.6 | | 784 | 7.41 | 94.0 | 7.46 | 94.7 | −0.44 | −0.16 | |
| | | | 1176 | 7.58 | 96.2 | 7.61 | 96.6 | −0.43 | −0.07 | |
| | | | 1568 | 7.63 | 96.8 | 7.66 | 97.2 | −0.37 | −0.02 | |
| | | | 1960 | 7.66 | 97.2 | 7.68 | 97.5 | −0.31 | 0.01 | |

TABLE 13-continued

Characteristics of Green Compacts and Sintered Bodies of Samples with FMS II Added

| | Blended Composition | | | | | | | | | |
|---|---|---|---|---|---|---|---|---|---|---|
| | Gr | FMS | Powder Compact | | | Sintered Body | | | | |
| Sample No. | Amount (% by mass) | Powder (% by mass) | Compacting Pressure (MPa) | G.D. (g/cm3) | Density Ratio (%) | S.D. (g/cm3) | Density Ratio (%) | ΔT (%) | ΔD (%) | Blisering |
| HS16 | 0.3 | 0.2 | 784 | 7.43 | 94.3 | 7.47 | 94.8 | −0.28 | −0.19 | |
| | | | 1176 | 7.63 | 96.8 | 7.67 | 97.3 | −0.32 | −0.12 | |
| | | | 1568 | 7.70 | 97.7 | 7.73 | 98.1 | −0.27 | −0.07 | |
| | | | 1960 | 7.73 | 98.1 | 7.74 | 98.2 | −0.11 | −0.04 | |
| | 0.5 | | 784 | 7.42 | 94.2 | 7.45 | 94.5 | −0.33 | −0.12 | |
| | | | 1176 | 7.60 | 96.4 | 7.63 | 96.8 | −0.38 | −0.06 | |
| | | | 1568 | 7.66 | 97.2 | 7.69 | 97.6 | −0.36 | −0.04 | |
| | | | 1960 | 7.68 | 97.5 | 7.70 | 97.7 | −0.27 | −0.03 | |

Base Powder: AstaloyMo 1,350° C., 30 min., and Sintering in Nitrogen

The green-compact density ratio was found by means of (Green-compact Density)/(Sintered-body Theoretical Density).

The sintered-body theoretical density in this instance was adapted to 7.88 g/cm3.

TABLE 14

Characteristics of Green Compacts and Sintered Bodies of Samples with FMS III Added

| | Blended Composition | | | | | | | | | |
|---|---|---|---|---|---|---|---|---|---|---|
| | Gr | FMS | Powder Compact | | | Sintered Body | | | | |
| Sample No. | Amount (% by mass) | Powder (% by mass) | Commpacting Pressure (MPa) | G.D. (g/cm3) | Density Ratio (%) | S.D. (g/cm3) | Density Ratio (%) | ΔT (%) | ΔD (%) | Blistering |
| HS17 | 0.3 | 0.01 | 784 | 7.43 | 94.3 | 7.49 | 95.1 | −0.43 | −0.24 | |
| | | | 1176 | 7.64 | 97.0 | 7.59 | 96.3 | 0.35 | 0.06 | |
| | | | 1568 | 7.69 | 97.6 | 4.79 | 60.8 | 54.55 | 1.87 | Occurred |
| | | | 1960 | 7.71 | 97.8 | 5.10 | 64.7 | 46.84 | 1.47 | Occurred |
| | 0.5 | | 784 | 7.42 | 94.2 | 7.47 | 94.8 | −0.42 | −0.22 | |
| | | | 1176 | 7.61 | 96.6 | 7.61 | 96.6 | −0.10 | −0.02 | |
| | | | 1568 | 7.66 | 97.2 | 5.79 | 73.5 | 30.38 | 0.70 | Occurred |
| | | | 1960 | 7.69 | 97.6 | 5.37 | 68.1 | 39.50 | 1.20 | Occurred |
| HS18 | 0.3 | 0.05 | 784 | 7.44 | 94.4 | 7.49 | 95.1 | −0.42 | −0.22 | |
| | | | 1176 | 7.63 | 96.8 | 7.65 | 97.1 | −0.19 | −0.05 | |
| | | | 1568 | 7.70 | 97.7 | 7.68 | 97.5 | 0.11 | 0.05 | |
| | | | 1960 | 7.73 | 98.1 | 7.70 | 97.7 | 0.13 | 0.07 | |
| | 0.5 | | 784 | 7.42 | 94.2 | 7.47 | 94.8 | −0.42 | −0.21 | |
| | | | 1176 | 7.61 | 96.6 | 7.64 | 97.0 | −0.27 | −0.07 | |
| | | | 1568 | 7.66 | 97.2 | 7.65 | 97.1 | −0.06 | 0.07 | |
| | | | 1960 | 7.68 | 97.5 | 7.65 | 97.1 | 0.10 | 0.10 | |
| HS19 | 0.3 | 0.1 | 784 | 7.44 | 94.4 | 7.48 | 94.9 | −0.31 | −0.21 | |
| | | | 1176 | 7.63 | 96.8 | 7.66 | 97.2 | −0.28 | −0.11 | |
| | | | 1568 | 7.70 | 97.7 | 7.72 | 98.0 | −0.26 | −0.05 | |
| | | | 1960 | 7.72 | 98.0 | 7.74 | 98.2 | −0.27 | −0.03 | |
| | 0.4 | | 784 | 7.43 | 94.3 | 7.48 | 94.9 | −0.37 | −0.23 | |
| | | | 1176 | 7.62 | 96.7 | 7.65 | 97.1 | −0.29 | −0.10 | |
| | | | 1568 | 7.68 | 97.5 | 7.70 | 97.7 | −0.23 | −0.03 | |
| | | | 1960 | 7.71 | 97.8 | 7.73 | 98.1 | −0.27 | −0.02 | |
| | 0.5 | | 784 | 7.43 | 94.3 | 7.47 | 94.8 | −0.29 | −0.19 | |
| | | | 1176 | 7.61 | 96.6 | 7.64 | 97.0 | −0.30 | −0.09 | |
| | | | 1568 | 7.66 | 97.2 | 7.69 | 97.6 | −0.33 | −0.03 | |
| | | | 1960 | 7.69 | 97.6 | 7.70 | 97.7 | −0.20 | 0.00 | |
| | 0.6 | | 784 | 7.41 | 94.0 | 7.45 | 94.5 | −0.46 | −0.15 | |
| | | | 1176 | 7.59 | 96.3 | 7.62 | 96.7 | −0.36 | −0.07 | |
| | | | 1568 | 7.64 | 97.0 | 7.66 | 97.2 | −0.37 | −0.02 | |
| | | | 1960 | 7.66 | 97.2 | 7.68 | 97.5 | −0.37 | 0.00 | |
| HS20 | 0.3 | 0.2 | 784 | 7.43 | 94.3 | 7.49 | 95.1 | −0.45 | −0.20 | |
| | | | 1176 | 7.63 | 96.8 | 7.68 | 97.5 | −0.41 | −0.13 | |
| | | | 1568 | 7.70 | 97.7 | 7.73 | 98.1 | −0.24 | −0.09 | |
| | | | 1960 | 7.71 | 97.8 | 7.74 | 98.2 | −0.29 | −0.06 | |

TABLE 14-continued

Characteristics of Green Compacts and Sintered Bodies of Samples with FMS III Added

| | Blended Composition | | Powder Compact | | | Sintered Body | | | | |
|---|---|---|---|---|---|---|---|---|---|---|
| | Gr | FMS | | | | | | | | |
| Sample No. | Amount (% by mass) | Powder (% by mass) | Commpacting Pressure (MPa) | G.D. (g/cm3) | Density Ratio (%) | S.D. (g/cm3) | Density Ratio (%) | ΔT (%) | ΔD (%) | Blistering |
| | 0.5 | | 784 | 7.42 | 94.2 | 7.45 | 94.5 | −0.35 | −0.15 | |
| | | | 1176 | 7.59 | 96.3 | 7.63 | 96.8 | −0.39 | −0.09 | |
| | | | 1568 | 7.64 | 97.0 | 7.68 | 97.5 | −0.49 | −0.05 | |
| | | | 1960 | 7.67 | 97.3 | 7.71 | 97.8 | −0.46 | −0.04 | |

Base Powder: AstaloyMo 1,350° C., 30 min., and Sintering in Nitrogen

The green-compact density ratio was found by means of (Green-compact Density)/(Sintered-body Theoretical Density).

The sintered-body theoretical density in this instance was adapted to 7.88 g/cm3.

TABLE 15

Influence of FMS Powder Exerted to Density and Strength Characteristics

| | | | Powder Compact | | | Sintered Body | | | | |
|---|---|---|---|---|---|---|---|---|---|---|
| TP. No. | FMS Powder | Composition | Compacting Pressure (MPa) | G.D. (g/cm3) | Density Ratio (%) | S.D. (g/cm3) | Density Ratio (%) | Hardness Hv (30 kgf) | TRS (MPa) | Deflection (mm) |
| HS11 | I | AstaloyMo-0.1FMS-0.5Gr | 1568 | 7.67 | 97.3 | 17.63 | 96.8 | 554 | 3259 | 1.13 |
| HS15 | II | | | 7.67 | 97.3 | 7.68 | 97.5 | 549 | 3353 | 1.20 |
| HS19 | III | | | 7.66 | 97.2 | 17.69 | 97.6 | 542 | 3245 | 1.11 |

Sintering: 1,350° C., 30 min., and Nitrogen Atmosphere

Heat Treatment: 850° C. Oil Quenching, and 200° C. Tempering

TABLE 16

Characteristics of Green Compacts and Sintered Bodies of Samples with FMS II Added to Various Low Alloy Steels

| | | Blended Composition | | Powder Compact | | | Sintered Alloy | | | | |
|---|---|---|---|---|---|---|---|---|---|---|---|
| | | Gr | FMS | | | | | | | | |
| Sample No. | Fe-system Powder | Powder (% by mass) | Powder (% by mass) | Compacting Pressure (MPa) | G.D. (g/cm3) | Density Rate (%) | S.D. (g/cm3) | Density Rate (%) | ΔT (%) | ΔD (%) | Blistering |
| HS1 | AstaloyMo | 0.5 | 0.1 | 784 | 7.45 | 94.5 | 7.49 | 95.1 | −0.44 | −0.15 | |
| | | | | 980 | 7.55 | 95.8 | 7.59 | 96.3 | −0.35 | −0.12 | |
| | | | | 1176 | 7.62 | 96.7 | 7.65 | 97.1 | −0.36 | −0.09 | |
| | | | | 1372 | 7.65 | 97.1 | 7.67 | 97.3 | −0.27 | −0.04 | |
| | | | | 1568 | 7.67 | 97.3 | 7.68 | 97.5 | −0.21 | −0.01 | |
| | | | | 1960 | 7.69 | 97.6 | 7.70 | 97.7 | −0.27 | −0.01 | |
| HS2 | AstaloyMo | | 0.25 | 784 | 7.43 | 94.3 | 7.47 | 94.8 | −0.36 | −0.16 | |
| | | | | 980 | 7.55 | 95.8 | 7.58 | 96.2 | −0.34 | −0.11 | |
| | | | | 1176 | 7.61 | 96.6 | 7.64 | 97.0 | −0.38 | −0.10 | |
| | | | | 1372 | 7.65 | 97.1 | 7.68 | 97.5 | −0.32 | −0.06 | |
| | | | | 1568 | 7.66 | 97.2 | 7.69 | 97.6 | −0.34 | −0.04 | |
| | | | | 1960 | 7.69 | 97.6 | 7.71 | 97.8 | −0.28 | −0.02 | |
| HS3 | AstaloyMo | | 0.5 | 784 | 7.42 | 94.2 | 7.46 | 94.7 | −0.34 | −0.11 | |
| | | | | 980 | 7.54 | 95.7 | 7.57 | 96.1 | −0.29 | −0.07 | |
| | | | | 1176 | 7.60 | 96.4 | 7.63 | 96.8 | −0.26 | −0.05 | |
| | | | | 1372 | 7.64 | 97.0 | 7.66 | 97.2 | −0.25 | −0.03 | |
| | | | | 1568 | 7.66 | 97.2 | 7.68 | 97.5 | −0.27 | −0.03 | |
| | | | | 1960 | 7.68 | 97.5 | 7.70 | 97.7 | −0.26 | 0 | |
| HS4 | AstaloyMo | | 1 | 784 | 7.40 | 93.9 | 7.43 | 94.3 | −0.23 | −0.13 | |
| | | | | 980 | 7.52 | 95.4 | 7.54 | 95.7 | −0.24 | −0.07 | |
| | | | | 1176 | 7.57 | 96.1 | 7.59 | 96.3 | −0.25 | −0.04 | |
| | | | | 1372 | 7.62 | 96.7 | 7.64 | 97.0 | −0.22 | −0.03 | |
| | | | | 1568 | 7.64 | 97.0 | 7.66 | 97.2 | −0.28 | 0 | |
| | | | | 1960 | 7.67 | 97.3 | 7.68 | 97.5 | −0.23 | 0.02 | |

TABLE 16-continued

Characteristics of Green Compacts and Sintered Bodies of Samples with FMS II Added to Various Low Alloy Steels

| | Blended Composition | | | Powder Compact | | | Sintered Alloy | | | | |
|---|---|---|---|---|---|---|---|---|---|---|---|
| | | Gr | FMS | | | | | | | | |
| Sample No. | Fe-system Powder | Powder (% by mass) | Powder (% by mass) | Compacting Pressure (MPa) | G.D. (g/cm3) | Density Rate (%) | S.D. (g/cm3) | Density Rate (%) | ΔT (%) | ΔD (%) | Blistering |
| HS5 | KIP30CRV | 0.5 | 0.5 | 784 | 7.24 | 91.9 | 7.31 | 92.8 | −0.34 | −0.34 | |
| | | | | 980 | 7.40 | 93.9 | 7.43 | 94.3 | −0.18 | −0.16 | |
| | | | | 1176 | 7.49 | 95.1 | 7.52 | 95.4 | −0.14 | −0.14 | |
| | | | | 1372 | 7.54 | 95.7 | 7.56 | 95.9 | −0.13 | −0.08 | |
| | | | | 1568 | 7.58 | 96.2 | 7.59 | 96.3 | −0.04 | −0.06 | |
| | | | | 1960 | 7.62 | 96.7 | 7.63 | 96.8 | 0.01 | −0.02 | |
| HS6 | KIP103CRV | | 0.5 | 784 | 7.37 | 93.5 | 7.38 | 93.7 | −0.17 | −0.04 | |
| | | | | 980 | 7.48 | 94.9 | 7.49 | 95.1 | −0.19 | −0.02 | |
| | | | | 1176 | 7.55 | 95.8 | 7.56 | 95.9 | −0.17 | 0.02 | |
| | | | | 1372 | 7.60 | 96.4 | 7.60 | 96.4 | −0.14 | 0.05 | |
| | | | | 1568 | 7.62 | 96.7 | 7.62 | 96.7 | −0.20 | 0.06 | |
| | | | | 1960 | 7.65 | 97.1 | 7.66 | 97.2 | −0.18 | 0.07 | |
| HS7 | DistaloyAE | | 0.5 | 784 | 7.49 | 95.1 | 7.48 | 94.9 | −0.03 | 0.04 | |
| | | | | 980 | 7.60 | 96.4 | 7.56 | 95.9 | 0.09 | 0.17 | |
| | | | | 1176 | 7.65 | 97.1 | 7.60 | 96.4 | 0.09 | 0.23 | |
| | | | | 1372 | 7.69 | 97.6 | 7.63 | 96.8 | 0.15 | 0.28 | |
| | | | | 1568 | 7.71 | 97.8 | 7.64 | 97.0 | 0.24 | 0.32 | |
| | | | | 1960 | 7.74 | 98.2 | 7.66 | 97.2 | 0.27 | 0.38 | |
| C1 | AstaloyMo | 0.5 | None | 1176 | 7.62 | 96.7 | 7.61 | 96.6 | −0.03 | −0.02 | |
| C2 | KIP30CRV | | | 1176 | 7.50 | 95.8 | 7.55 | 96.4 | −0.39 | −0.16 | |

The green-compact density ratio was found by means of (Green-compact Density)/(Sintered-body Theoretical Density).

The sintered-body theoretical-density value is such that the following values were used.

AstaloyMo Material: 7.88 g/cm3

DistaloyAE Material: 7.88 g/cm3

KIP30CRV Material: 7.83 g/cm3

KIP103V Material: 7.85 g/cm3

TABLE 17

Density and Strength Characteristics of Samples with FMS II Added to Various Low Alloy Steels

| | Blended Composition | | | Powder Compact | | | Sintered Alloy | | | | |
|---|---|---|---|---|---|---|---|---|---|---|---|
| | | Gr | FMS | | | | | | | | |
| Sample No. | Fe-system Powder | Powder (% by mass) | Powder (% by mass) | Compacting Pressure (MPa) | G.D. (g/cm3) | Density Rate (%) | S.D. (g/cm3) | Density Rate (%) | Hardness Hv (30 kgf) | TRS (MPa) | Deflection (mm) |
| HS1 | AstaloyMo | 0.5 | 0.1 | 784 | 7.45 | 94.5 | 7.49 | 95.1 | 464 | 2954 | 1.09 |
| | | | | 1176 | 7.62 | 96.7 | 7.65 | 97.1 | 534 | 3125 | 1.03 |
| | | | | 1568 | 7.67 | 97.3 | 7.68 | 97.5 | 563 | 3407 | 1.18 |
| HS2 | | | 0.25 | 784 | 7.43 | 94.3 | 7.47 | 94.8 | 465 | 2915 | 1.09 |
| | | | | 1176 | 7.61 | 96.6 | 7.64 | 97.0 | 534 | 3346 | 1.19 |
| | | | | 1568 | 7.66 | 97.2 | 7.69 | 97.6 | 555 | 3313 | 1.14 |
| HS3 | | | 0.5 | 784 | 7.42 | 94.2 | 7.46 | 94.7 | 482 | 2913 | 1.05 |
| | | | | 1176 | 7.60 | 96.4 | 7.63 | 96.8 | 533 | 3183 | 1.04 |
| | | | | 1568 | 7.66 | 97.2 | 7.68 | 97.5 | 561 | 3263 | 1.07 |
| HS4 | | | 1 | 784 | 7.40 | 93.9 | 7.43 | 94.3 | 499 | 2842 | 0.98 |
| | | | | 1176 | 7.57 | 96.1 | 7.59 | 96.3 | 515 | 3131 | 1.02 |
| | | | | 1568 | 7.64 | 97.0 | 7.66 | 97.2 | 568 | 3226 | 1.04 |
| HS5 | KIP30CRV | | 0.5 | 784 | 7.24 | 92.5 | 7.31 | 93.4 | 480 | 2672 | 0.92 |
| | | | | 1176 | 7.49 | 95.7 | 7.52 | 96.0 | 573 | 2985 | 0.94 |
| | | | | 1568 | 7.58 | 96.8 | 7.59 | 96.9 | 552 | 3028 | 0.97 |
| HS6 | KIP103V | | 0.5 | 784 | 7.37 | 93.9 | 7.38 | 94.0 | 508 | 2759 | 0.98 |
| | | | | 1176 | 7.55 | 96.2 | 7.56 | 96.3 | 552 | 3140 | 1.02 |
| | | | | 1568 | 7.62 | 97.1 | 7.62 | 97.1 | 568 | 3179 | 1.00 |
| HS7 | DistaloyAE | | 0.5 | 784 | 7.49 | 95.1 | 7.48 | 94.9 | 463 | 2887 | 1.41 |
| | | | | 1176 | 7.65 | 97.1 | 7.56 | 95.9 | 502 | 3248 | 1.57 |
| | | | | 1568 | 7.71 | 97.8 | 7.64 | 97.0 | 526 | 3178 | 1.47 |

TABLE 17-continued

Density and Strength Characteristics of Samples with FMS II Added to Various Low Alloy Steels

| | Blended Composition | | | Powder Compact | | | Sintered Alloy | | | | |
|---|---|---|---|---|---|---|---|---|---|---|---|
| Sample No. | Fe-system Powder | Gr Powder (% by mass) | FMS Powder (% by mass) | Compacting Pressure (MPa) | G.D. (g/cm3) | Density Rate (%) | S.D. (g/cm3) | Density Rate (%) | Hardness Hv (30 kgf) | TRS (MPa) | Deflection (mm) |
| C1 | AstaloyMo | 0.5 | None | 1176 | 7.62 | 96.7 | 7.61 | 96.6 | 514 | 2938 | 0.97 |
| C2 | KIP30CRV | | | 1176 | 7.50 | 95.8 | 7.55 | 96.4 | 526 | 2512 | 0.67 |

1,350° C. 30 min., and Sintering in Nitrogen Atmosphere
The green-compact density ratio was found by means of (Green-compact Density)/(Sintered-body Theoretical Density).
The sintered-body theoretical-density value is such that the following values were used.
AstaloyMo Material: 7.88 g/cm3
DistaloyAE Material: 7.88 g/cm3
KIP30CRV Material: 7.83 g/cm3
KIP103V Material: 7.85 g/cm3

TABLE 18

Characteristics of Formed Bodies and Sintered Bodies of Samples with Fe—76.4% Si Alloy Powder Added

| | Blended Composition | | Powder Compact | | | Sintered Body | | | | |
|---|---|---|---|---|---|---|---|---|---|---|
| Sample No. | Gr Amount (% by mass) | Fe—Si Amount (% by mass) | Compacting Pressure (MPa) | G.D. (g/cm3) | Density Ratio (%) | S.D. (g/cm3) | Density Ratio (%) | ΔT (%) | ΔD (%) | Blistering |
| HS29 | 0.5 | 0.02 | 784 | 7.44 | 94.4 | 7.47 | 94.8 | −0.29 | −0.17 | |
| | | | 1176 | 7.62 | 96.7 | 7.64 | 97.0 | −0.29 | −0.08 | |
| | | | 1568 | 7.66 | 97.2 | 7.66 | 97.2 | −0.11 | 0.01 | |
| | | | 1960 | 7.67 | 97.3 | 7.63 | 96.8 | 0.30 | 0.07 | |
| HS21 | 0.5 | 0.05 | 784 | 7.43 | 94.3 | 7.48 | 94.9 | −0.42 | −0.17 | |
| | | | 1176 | 7.6 | 96.4 | 7.63 | 96.8 | −0.32 | −0.10 | |
| | | | 1568 | 7.66 | 97.2 | 7.68 | 97.5 | −0.30 | −0.05 | |
| | | | 1960 | 7.68 | 97.5 | 7.70 | 97.7 | −0.27 | −0.02 | |
| HS22 | 0.3 | 0.1 | 784 | 7.43 | 94.3 | 7.49 | 95.1 | −0.41 | −0.22 | |
| | | | 1176 | 7.63 | 96.8 | 7.67 | 97.3 | −0.37 | −0.13 | |
| | | | 1568 | 7.69 | 97.6 | 7.73 | 98.1 | −0.31 | −0.08 | |
| | | | 1960 | 7.71 | 97.8 | 7.74 | 98.2 | −0.41 | −0.04 | |
| HS22 | 0.5 | | 784 | 7.42 | 94.2 | 7.47 | 94.8 | −0.41 | −0.19 | |
| | | | 1176 | 7.59 | 96.3 | 7.63 | 96.8 | −0.43 | −0.11 | |
| | | | 1568 | 7.66 | 97.2 | 7.69 | 97.6 | −0.35 | −0.06 | |
| | | | 1960 | 7.67 | 97.3 | 7.70 | 97.7 | −0.46 | −0.03 | |
| HS23 | 0.5 | 0.2 | 784 | 7.41 | 94.0 | 7.46 | 94.7 | −0.41 | −0.19 | |
| | | | 1176 | 7.59 | 96.3 | 7.62 | 96.7 | −0.32 | −0.11 | |
| | | | 1568 | 7.63 | 96.8 | 7.67 | 97.3 | −0.46 | −0.09 | |
| | | | 1960 | 7.66 | 97.2 | 7.69 | 97.6 | −0.31 | −0.07 | |

Base Powder: AstaloyMo, 1,350° C., 30 min., and Sintering in Nitrogen
Fe—Si Alloy Powder: −500 mesh

TABLE 19

Characteristics of Green Compacts and Sintered Bodies of Samples with Fe—75.6% Mn Alloy Powder Added

| | Blended Composition | | Powder Compact | | | Sintered Body | | | | |
|---|---|---|---|---|---|---|---|---|---|---|
| Sample No. | Gr Amount (% by mass) | Fe—Mn Amount (% by mass) | Compacting Pressure (MPa) | G.D. (g/cm3) | Density Ratio (%) | S.D. (g/cm3) | Density Ratio (%) | ΔT (%) | ΔD (%) | Blistering |
| HS24 | 0.3 | 0.1 | 784 | 7.45 | 94.5 | 7.49 | 95.1 | −0.31 | −0.20 | |
| | | | 1176 | 7.64 | 97.0 | 7.61 | 96.6 | 0.20 | 0.06 | |
| | | | 1568 | 7.71 | 97.8 | 7.60 | 96.4 | 1.05 | 0.16 | Occurred |
| | | | 1960 | 7.73 | 98.1 | 4.66 | 59.1 | 60.3 | 1.68 | Occurred |

TABLE 19-continued

Characteristics of Green Compacts and Sintered Bodies of Samples with Fe—75.6% Mn Alloy Powder Added

| | Blended Composition | | Powder Compact | | | Sintered Body | | | | |
|---|---|---|---|---|---|---|---|---|---|---|
| | Gr | Fe—Mn | | | | | | | | |
| Sample No. | Amount (% by mass) | Amount (% by mass) | Compacting Pressure (MPa) | G.D. (g/cm3) | Density Ratio (%) | S.D. (g/cm3) | Density Ratio (%) | ΔT (%) | ΔD (%) | Blistering |
| | 0.5 | | 784 | 7.43 | 94.3 | 7.47 | 94.8 | −0.40 | −0.18 | |
| | | | 1176 | 7.60 | 96.4 | 7.56 | 95.9 | 0.21 | 0.10 | |
| | | | 1568 | 7.67 | 97.3 | 4.75 | 60.3 | 57.2 | 1.25 | Occurred |
| | | | 1960 | 7.67 | 97.3 | 4.59 | 58.2 | 61.85 | 1.56 | Occurred |

Base Powder: AstaloyMo, 1,350° C., 30 min., and Sintering in Nitrogen
Fe—Mn Alloy Powder: −500 mesh

TABLE 20

Characteristics of Green Compacts and Sintered Bodies of Samples with Pure Si Powder Added

| | Blended Composition | | Powder Compact | | | Sintered Body | | | | |
|---|---|---|---|---|---|---|---|---|---|---|
| | Gr | Si | | | | | | | | |
| Sample No. | Amount (% by mass) | Amount (% by mass) | Compacting Pressure (MPa) | G.D. (g/cm3) | Density Ratio (%) | S.D. (g/cm3) | Density Ratio (%) | ΔT (%) | ΔD (%) | Blistering |
| HS25 | 0.5 | 0.01 | 784 | 7.44 | 94.4 | 7.48 | 94.9 | −0.31 | −0.17 | |
| | | | 1176 | 7.61 | 96.6 | 7.63 | 96.8 | −0.31 | −0.07 | |
| | | | 1568 | 7.66 | 97.2 | 7.26 | 92.1 | 5.18 | 0.13 | Occurred |
| | | | 1960 | 7.69 | 97.6 | 4.51 | 57.2 | 65.08 | 1.55 | Occurred |
| HS26 | | 0.02 | 784 | 7.43 | 94.3 | 7.47 | 94.8 | −0.40 | −0.19 | |
| | | | 1176 | 7.62 | 96.7 | 7.64 | 97.0 | −0.25 | −0.07 | |
| | | | 1568 | 7.67 | 97.3 | 7.51 | 95.3 | 1.79 | 0.08 | Occurred |
| | | | 1960 | 7.69 | 97.6 | 6.20 | 78.7 | 23.17 | 0.35 | Occurred |
| HS30 | | 0.03 | 784 | 7.43 | 94.3 | 7.48 | 94.9 | −0.37 | −0.19 | |
| | | | 1176 | 7.61 | 96.6 | 7.63 | 96.8 | −0.27 | −0.09 | |
| | | | 1568 | 7.66 | 97.2 | 7.66 | 97.2 | −0.09 | 0.00 | |
| | | | 1960 | 7.67 | 97.3 | 7.65 | 97.1 | 0.11 | 0.07 | |
| HS27 | | 0.04 | 784 | 7.43 | 94.3 | 7.47 | 94.8 | −0.41 | −0.19 | |
| | | | 1176 | 7.61 | 96.6 | 7.64 | 97.0 | −0.38 | −0.10 | |
| | | | 1568 | 7.66 | 97.2 | 7.66 | 97.2 | −0.10 | −0.02 | |
| | | | 1960 | 7.68 | 97.5 | 7.68 | 97.5 | −0.15 | 0.02 | |
| HS28 | | 0.1 | 784 | 7.41 | 94.0 | 7.47 | 94.8 | −0.46 | −0.21 | |
| | | | 1176 | 7.60 | 96.4 | 7.64 | 97.0 | −0.36 | −0.11 | |
| | | | 1568 | 7.65 | 97.1 | 7.68 | 97.5 | −0.34 | −0.07 | |
| | | | 1960 | 7.66 | 97.2 | 7.69 | 97.6 | −0.43 | −0.04 | |

Base Powder: AstaloyMo, 1,350° C., 30 min., and Sintering in Nitrogen
Pure Si Powder: −500 mesh

TABLE 21

Graphite Addition Amount and Density as well as Dimensional Changes

| | | Powder Compact | | | Sintered Body | | | | |
|---|---|---|---|---|---|---|---|---|---|
| Sample No. | Gr Amount | Compactnig Pressure (MPa) | G.D. (g/cm3) | Density Ratio (%) | S.D. (g/cm3) | Density Ratio (%) | ΔT (%) | ΔD (%) | Blistering |
| HS8 | 0 | 784 | 7.46 | 94.7 | 7.61 | 96.6 | −0.85 | −0.56 | |
| | | 1176 | 7.69 | 97.6 | 7.79 | 98.9 | −0.5 | −0.44 | |
| | | 1568 | 7.77 | 98.6 | 7.85 | 99.6 | −0.44 | −0.31 | |
| | | 1960 | 7.80 | 99.0 | 7.86 | 99.7 | −0.32 | −0.21 | |
| | 0.3 | 784 | 7.45 | 94.5 | 7.50 | 95.2 | −0.46 | −0.22 | |
| | | 1176 | 7.64 | 97.0 | 7.56 | 95.9 | 0.6 | 0.2 | |
| | | 1568 | 7.71 | 97.8 | 5.75 | 73.0 | 30.56 | 1.25 | Occurred |
| | | 1960 | 7.75 | 98.4 | 6.10 | 77.4 | 24.46 | 0.92 | Occurred |

TABLE 21-continued

Graphite Addition Amount and Density as well as Dimensional Changes

| Sample No. | Gr Amount | Powder Compact: Compactnig Pressure (MPa) | Powder Compact: G.D. (g/cm3) | Powder Compact: Density Ratio (%) | Sintered Body: S.D. (g/cm3) | Sintered Body: Density Ratio (%) | Sintered Body: ΔT (%) | Sintered Body: ΔD (%) | Blistering |
|---|---|---|---|---|---|---|---|---|---|
| | 0.4 | 784 | 7.44 | 94.4 | 7.48 | 94.9 | −0.36 | −0.2 | |
| | | 1176 | 7.62 | 96.7 | 7.55 | 95.8 | 0.62 | 0.08 | |
| | | 1568 | 7.69 | 97.6 | 6.52 | 82.7 | 16.65 | 0.5 | Occurred |
| | | 1960 | 7.70 | 97.7 | 5.66 | 71.8 | 33.44 | 0.9 | Occurred |
| HS8 | 0.5 | 784 | 7.43 | 94.3 | 7.47 | 94.8 | −0.39 | −0.16 | |
| | | 1176 | 7.62 | 96.7 | 7.61 | 96.6 | −0.03 | −0.02 | |
| | | 1568 | 7.66 | 97.2 | 7.52 | 95.4 | 1.52 | 0.1 | Occurred |
| | | 1960 | 7.68 | 97.5 | 7.00 | 88.8 | 8.7 | 0.39 | Occurred |
| | 0.6 | 784 | 7.43 | 94.3 | 7.47 | 94.8 | −0.42 | −0.17 | |
| | | 1176 | 7.58 | 96.2 | 7.60 | 96.4 | −0.28 | −0.07 | |
| | | 1568 | 7.65 | 97.1 | 7.58 | 96.2 | 0.54 | 0.09 | |
| | | 1960 | 7.66 | 97.2 | 6.87 | 87.2 | 10.71 | 0.26 | Occurred |

Base Powder: AstaloyMo, 1,350° C., 30 min., and Sintering in Nitrogen
The green-compact density ratio was found by means of (Green-compact Density)/(Sintered-body Theoretical Density).

TABLE 22

Chemical Compositions of FMS Powders

| # | Nominal Composition | Chemical Composition (%): Mn | Si | P | C | O | Fe | Liquid-phase Temp. (° C.) |
|---|---|---|---|---|---|---|---|---|
| I | Fe—60Mn—20Si | 60.70 | 20.6 | 0.00 | 0.05 | 0.28 | Balance | 1080 |
| II | Fe—50Mn—33Si | 50.00 | 33.3 | 0.02 | 0.06 | 0.30 | Balance | 1250 |
| III | Fe—40Mn—40Si | 39.40 | 39.7 | 0.00 | 0.04 | 0.29 | Balance | 1150 |

FIGURE CAPTIONS

FIG. 1: Fe-FMS-0.6C/784 MPa Forming/1,150° C. Sintering
Traverse Rupture Force (MPa)
Mn Amount
Influence of Mn Amount Exerted to Traverse Rupture Force of 1,150° C.-Sintered Body FIG. 2: Fe-FMS-0.6C/784 MPa Forming/1,250° C. Sintering
Traverse Rupture Force (MPa)
Mn Amount
Influence of Mn Amount Exerted to Traverse Rupture Force of 1,250° C.-Sintered Body FIG. 3: Fe-FMS-0.6C/784 MPa Forming/1,150° C. Sintering
Deflection Amount (mm)
Mn Amount
Influence of Mn Amount Exerted to Deflection Amount in Traverse Test to 1,150° C.-Sintered Body FIG. 4: Fe-FMS-0.6C/784 MPa Forming/1,150° C. Sintering
Deflection Amount (mm)
Mn Amount
Influence of Mn Amount Exerted to Deflection Amount in Traverse Test to 1,250° C.-Sintered Body FIG. 5: Fe-FMS-0.6C/784 MPa Forming/1,150° C. Sintering
Dimensional Change ΔD (%)
Mn Amount
Influence of Mn Amount Exerted to Dimensional Change of 1,150° C.-Sintered Body FIG. 6: Fe-FMS-0.6C/784 MPa Forming/1,250° C. Sintering
Dimensional Change ΔD (%)
Mn Amount
Influence of Mn Amount Exerted to Dimensional Change of 1,250° C.-Sintered Body FIG. 7: Traverse Rupture Force (MPa)
Sintered-body Density (g/cm$^3$)
Relationship between Sintered-body Density and Traverse Rupture Force FIG. 8: Deflection Amount (mm)
Sintered-body Density (g/cm3)
Relationship between Sintered-body Density and Deflection Amount FIG. 9: Maximum Stress $\delta_{max}$ MPa
Number of Repetitions to Fracture $N_f$ Times
Three-point Bending Fatigue Test Result FIG. 10: (Units: mm)
Configuration, Tensile Test Piece FIG. 11: Astaloy CrM-X-0.5C
1,250° C. Sintering
784 MPa Forming
1,176 MPa Forming
Tensile Strength (MPa)
Relationship between Tensile Strength and FMS-powder Composition FIG. 12: Astaloy CrM-X-0.5C
1,250° C. Sintering
784 MPa Forming
1,176 MPa Forming
Elongation (&)
Relationship between Elongation and FMS-powder Composition FIG. 13: Residual C Amount after Sintering (%)
Formed-body Density (g/cm$^3$)
Relationship between Formed-body Density and After-sintering Residual Carbon Amount FIG. 14: 784 MPa Forming, 1,250° C. and 30 min. Sintering, and 40° C./min. Cooling
Tensile Strength
No Addition
Blended C Amount (%)

FIG. 15: 784 MPa Forming, 1,250° C. and 30 min. Sintering, and 40° C./min. Cooling
Elongation
No Addition
Blended C Amount (%)

FIG. 16: Formed Body
1,350° C.-Sintered Body
Density Ratio (%)
Forming Pressure (MPa)

FIG. 17A: Appearance of Sample in which Blistering Occurred

FIG. 17B: Cross-sectional Photograph of Sample in which Blistering Occurred

The invention claimed is:

1. A production process for an iron-based sintered alloy member, the production process comprising:

press forming a raw material powder at a compacting pressure of 1,200 MPa or more, in which an iron-system powder composed of at least one of pure iron (Fe) and iron alloy, and a carbon-system powder composed of carbon (C) mainly, are mixed with a silicon-system powder composed of silicon (Si), a Si alloy or a Si compound, thereby obtaining a powder compact having a green density ratio ($\rho/\rho0'\times100\%$), the ratio of a green density ($\rho$) to a sintered-body theoretical density ($\rho0'$), of 96% or more, wherein the amount of carbon in the raw material powder is 0.3-0.6% by mass;

wherein, when the entirety of the iron-based sintered alloy is taken as 100% by mass, Si is 0.01-0.15% by mass; C is 0.3-0.6% by mass; and Fe is the major balance; and sintering the powder compact in an oxidation preventive atmosphere, wherein the iron-based sintered alloy has a sintered density ratio ($\rho'/\rho0'\times100\%$), the ratio of a sintered density ($\rho'$) to a theoretical density ($\rho0'$) of the iron-based sintered alloy member, of 96% or more.

2. The production process for an iron-based sintered alloy member according to claim 1, wherein the sintered density ratio is within a range of ±1% with respect to the green density ratio.

3. The production process for an iron-based sintered alloy member according to claim 1, wherein the Si-system powder is an Mn—Si-system powder composed of alloy or compound of Mn and Si.

4. The production process for an iron-based sintered alloy member according to claim 3, wherein the Mn—Si-system powder is an Fe—Mn—Si powder composed of alloy or intermetallic compound of Fe, Mn and Si.

5. The production process for an iron-based sintered alloy member according to claim 4, wherein the Fe—Mn—Si powder is such that, when the entire Fe—Mn—Si powder is taken as 100% by mass, Mn is 15-75% by mass; Si is 15-75% by mass; the sum of Mn and Si is 35-95% by mass; the major balance is Fe; and oxygen (O) is 0.4% by mass or less.

6. The production process for an iron-based sintered alloy member according to claim 5, wherein the Fe—Mn—Si powder, when the entire raw material powder is taken as 100% by mass, is included in an amount of 0.01-5% by mass.

7. The production process for an iron-based sintered alloy member according to claim 1, wherein the Si-system powder is composed of particles whose particle diameters are 50 μm or less.

8. The production process for an iron-based sintered alloy member according to claim 1, wherein the press-forming comprises: filling the raw material powder into a die with a higher fatty acid-system lubricant applied on the inner surface; and generating a metallic soap film on the surface of the raw material powder, which contacts with the die inner surface, and warm pressurizing the raw material powder filled within the die.

9. The production process for an iron-based sintered alloy member according to claim 1, wherein the sintering is carried out within an ultra-low-oxygen-partial-pressure inert gas atmosphere whose oxygen partial pressure is equivalent to $10^{-19}$ Pa or less.

10. The production process for an iron-based sintered alloy member according to claim 1, wherein the sintering is carried out at 1,200° C. or more.

11. The production process for an iron-based sintered alloy member according to claim 1, wherein when the entirety of the iron-based sintered alloy is taken as 100% by mass, Si is 0.03-0.15% by mass; C is 0.3-0.6% by mass; and Fe is the major balance.

12. The production process for an iron-based sintered alloy member according to claim 1, wherein the amount of carbon in the raw material powder is 0.3-0.5% by mass.

* * * * *